US007410327B2

(12) United States Patent
Baugh et al.

(10) Patent No.: US 7,410,327 B2
(45) Date of Patent: Aug. 12, 2008

(54) ARCTIC PLATFORM

(75) Inventors: Benton F. Baugh, Houston, TX (US); Craig Watson, Houston, TX (US); Keith K Millheim, The Woodlands, TX (US); Ali G. Kadaster, The Woodlands, TX (US)

(73) Assignee: Anadarko Petroleum Corporation, The Woodlands, TX (US)

( * ) Notice: Subject to any disclaimer, the term of this patent is extended or adjusted under 35 U.S.C. 154(b) by 0 days.

(21) Appl. No.: 11/704,614

(22) Filed: Feb. 9, 2007

(65) Prior Publication Data

US 2007/0163186 A1 Jul. 19, 2007

Related U.S. Application Data

(63) Continuation of application No. 10/820,597, filed on Apr. 8, 2004, now abandoned.

(60) Provisional application No. 60/461,602, filed on Apr. 8, 2003.

(51) Int. Cl.
*E02D 27/00* (2006.01)

(52) U.S. Cl. ..... 405/204; 405/228; 405/195.1

(58) Field of Classification Search ..... 405/204, 405/195.1, 203, 224, 228, 208
See application file for complete search history.

(56) References Cited

U.S. PATENT DOCUMENTS

| | | | | | |
|---|---|---|---|---|---|
| 2,881,591 | A | | 4/1959 | Reeve | |
| 3,176,470 | A | * | 4/1965 | Stiff | 405/218 |
| 3,720,065 | A | | 3/1973 | Sherard | |
| 3,878,662 | A | * | 4/1975 | Cernosek | 52/169.9 |
| 3,902,547 | A | | 9/1975 | Waters | |
| 3,908,784 | A | * | 9/1975 | Blurton et al. | 180/119 |
| 4,117,794 | A | | 10/1978 | Sjogren | |
| 4,161,376 | A | * | 7/1979 | Armstong | 405/204 |
| 4,290,716 | A | * | 9/1981 | Lamy | 405/203 |
| 4,629,365 | A | * | 12/1986 | Kuriiwa | 405/204 |
| 4,666,340 | A | * | 5/1987 | Cox | 405/204 |
| 4,723,876 | A | | 2/1988 | Spalding et al. | |
| 4,784,526 | A | * | 11/1988 | Turner | 405/204 |
| 4,836,716 | A | | 6/1989 | Spalding et al. | |
| 5,660,055 | A | | 8/1997 | Eriksson | |

(Continued)

FOREIGN PATENT DOCUMENTS

CN 2527698 Y 2/2002

(Continued)

*Primary Examiner*—Frederick L Lagman
(74) *Attorney, Agent, or Firm*—Raymond R. Ferrera

(57) ABSTRACT

The instant disclosure relates to a system and method of constructing drilling and production platforms that are particularly useful in remote, inaccessible and/or environmentally sensitive operating environments. According to one aspect of the invention, an arctic drilling platform is provided wherein various methods and means of interlocking neighboring platform modules are provided. Methods and means for sealing the intersections formed between a plurality of interlocked platform modules are also disclosed. According to further aspects of the invention, improved platform floor plans are provided, and various wellhead cellar layouts and sealing means are also described. Methods and means of enhancing the usefulness of modular storage platforms are disclosed, and a number of support post installation and removal techniques are also provided. Also taught are a variety of methods of adjusting the height and level of an assembled drilling platform, and methods and means of adding extension members useful for extending the length of a support post are also described.

4 Claims, 48 Drawing Sheets

U.S. PATENT DOCUMENTS

| | | | | |
|---|---|---|---|---|
| 6,045,297 | A * | 4/2000 | Voorhees et al. | 405/303 |
| 6,048,135 | A * | 4/2000 | Williford et al. | 405/203 |
| 6,161,358 | A * | 12/2000 | Mochizuki et al. | 405/201 |
| 6,298,928 | B1 * | 10/2001 | Penchansky | 405/232 |
| 6,499,914 | B1 * | 12/2002 | Patout et al. | 405/203 |
| 6,533,045 | B1 * | 3/2003 | Cooper | 175/122 |
| 6,745,852 | B2 * | 6/2004 | Kadaster et al. | 405/204 |
| 2002/0046531 | A1 * | 4/2002 | Bockhorn et al. | 52/651.01 |
| 2002/0074125 | A1 * | 6/2002 | Fikes et al. | 166/352 |
| 2002/0112888 | A1 * | 8/2002 | Leuchtenberg | 175/48 |

FOREIGN PATENT DOCUMENTS

| | | | |
|---|---|---|---|
| DE | 3429696 | A1 | 2/1986 |
| EP | 0964102 | A1 | 12/1999 |
| FR | 1433234 | A | 3/1966 |
| FR | 2264136 | A | 10/1975 |
| RU | 2123100 | C1 | 12/1998 |
| SU | 583272 | | 12/1977 |
| SU | 870700 | | 10/1981 |
| WO | WO 0009857 | | 2/2000 |
| WO | WO 0149966 | A | 7/2001 |
| WO | WO 03035987 | A | 5/2003 |

* cited by examiner

ARCTIC PLATFORM

RELATED APPLICATION DATA

The instant application, filed under 35 U.S.C. § 111(a), claims the benefit under 35 U.S.C. § 120 as a continuation of U.S. Non-Provisional patent application Ser. No. 10,820,597, filed under 35 U.S.C. § 111(a) on Apr. 8, 2004 now abandoned, which claimed the benefit under 35 U.S.C. § 119(e) of U.S. Provisional Application No. 60,461,602, filed under 35 U.S.C.§ 111(b) on Apr. 8, 2003.

FIELD OF THE INVENTION

The present invention relates generally to the field of oil and gas drilling and production. In a specific, non-limiting embodiment, the invention comprises a system and method of drilling oil and gas wells in arctic, inaccessible or environmentally sensitive locations without significantly disturbing an associated ground surface.

DESCRIPTION OF THE PRIOR ART

The drilling and maintenance of land oil and gas wells requires a designated area on which to dispose a drilling rig and associated support equipment. Drilling locations are accessed by a variety of means, for example, by roadway, waterway or another suitable access route. In particularly remote locations, access to a drilling site is sometimes achieved via airlift, either by helicopter, fixed wing aircraft, or both.

Some potential drilling and production sites are further constrained by special circumstances that make transportation of drilling equipment to the drilling site especially difficult. For example, oil and gas reserves may be disposed in locales having accumulations of surface and near-surface water, such as swamps, tidal flats, jungles, stranded lakes, tundra, muskegs, and permafrost regions. In the case of swamps, muskegs, and tidal flats, the ground is generally too soft to support trucks and other heavy equipment, and the water is generally too shallow for traditional equipment to be floated in. In the case of tundra and permafrost regions, heavy equipment can be supported only during the winter months.

Moreover, certain production sites are disposed in environmentally sensitive regions, where surface access by conventional transport vehicles can damage the terrain or affect wildlife breeding areas and migration paths. Such environmental problems are particularly acute in, for example, arctic tundra and permafrost regions. In these areas, road construction is frequently prohibited or limited to only temporary seasonal access.

For example, substantial oil and gas reserves exist in the far northern reaches of Canada and Alaska. However, drilling in such regions presents substantial engineering and environmental challenges. The current art of drilling onshore in arctic tundra is enabled by the use of special purpose vehicles, such as Rolligons™ and other low impact vehicles that can travel across the arctic tundra, and by ice roads that are built on frozen tundra to accommodate traditional transport vehicles. Ice roads are built by spraying water on a frozen surface at very cold temperatures, and are usually about 35 feet wide and 6 inches thick. At strategic locations, the ice roads are made wider to allow for staging and turn around capabilities.

Land drilling in arctic regions is currently performed on ice pads, the dimensions of which are about 500 feet on a side; typically, the ice pads comprise 6-inch thick sheets of ice. The rig itself is built on a thicker ice pad, for example, a 6- to 12-inch thick pad. A reserve pit is typically constructed with about a two-foot thickness of ice, plus an ice berm, which provides at least two feet of freeboard space above the pit's contents. These reserve pits, sometimes referred to as ice-bermed drilling waste storage cells, typically have a volume capacity of about 45,000 cubic feet, suitable for accumulating and storing about 15,000 cubic feet of cuttings and effluent. In addition to the ice roads and the drilling pad, an arctic drilling location sometimes includes an airstrip, which is essentially a broad, extended ice road formed as described above.

Ice roads can run from a few miles to tens of miles or longer, depending upon the proximity or remoteness of the existing infrastructure. The fresh water needed for the ice to construct the roads and pads is usually obtained from lakes and ponds that are generally numerous in such regions. The construction of an ice road typically requires around 1,000,000 gallons of water per linear mile. Over the course of a winter season, another 200,000 gallons or so per mile are required to maintain the ice road. Therefore, for a ten-mile ice road, a total of 2,000,000 gallons of water would have to be picked up from nearby lakes and sprayed on the selected route to maintain the structural integrity of the ice road.

An airstrip requires about 2,000,000 gallons of water per mile to construct, and a single drill pad requires about 1,700,000 gallons. For drilling operations on a typical 30-day well, an additional 20,000 gallons per day are required, for a total of about 600,000 gallons for the well. A 75-man camp requires another 5,000 gallons per day, or 150,000 gallons per month, to support. Sometimes, there are two to four wells drilled from each pad, frequently with a geological side-track in each well, and thus even more water is required to maintain the site. Thus, for a winter drilling operation involving, for example, 7 wells, 75 miles of road, 7 drilling pads, an airstrip, a 75-man camp, and the drilling of 5 new wells plus re-entry of two wells left incomplete, the fresh water requirements are on the order of tens of millions of gallons.

Currently, arctic land exploration drilling operations are conducted only during the winter months. Roadwork typically commences in the beginning of January, simultaneous with location building and rig mobilization. Due to the lack of ice roads, initial mobilizations are done with special purpose vehicles that are suitable for use even in remote regions of the arctic tundra.

Drilling operations typically commence around the beginning of February, and last until the middle of April, at which time all equipment and waste-pit contents must be removed before the ice pads and roads melt. However, in the Alaskan North Slope, the tundra is closed to all traffic from May 15 to July 1 due to nesting birds. If the breakup is late, then drilling prospects can be fully tested before demobilizing the rig. Otherwise, the entire infrastructure has to be removed, and then rebuilt the following season.

From the foregoing, it is clear there are several drawbacks associated with current arctic drilling and production technology. For example, huge volumes of water are pumped out of ponds and lakes and then allowed to thaw out and become surface run-off again. Also, the ice roads can become contaminated with lubricant oil and grease, antifreeze, and rubber products. In addition to the environmental impact, the economic costs associated with arctic drilling can be prohibitively high. Exploration operations can be conducted only during the coldest times of the year, which typically lasts less than 4 or 5 months. Thus, using ice pads, actual drilling and testing can be conducted in a window of only two to four months or less, and actual production and development can occur during less than half the year. At the beginning of each drilling season, the ice roads and pads must all be rebuilt, and equipment must again be transported to and removed from the site, all at substantial financial and environmental cost. As for the commercial development of hydrocarbons in the arctic tundra, the current state of the art requires the use of a gravel pad for year round operations. When production activities are completed (for example, at the end of the lifecycle of the field), the gravel pads must be removed and the site remediated. Such remediation efforts can be very costly and difficult to accomplish.

SUMMARY OF THE INVENTION

According to one aspect of the invention, a method of constructing a drilling or production platform is provided, the method including: drilling a post hole into a ground surface; inserting a support post into said post hole, wherein said support post has an adjustable shoulder member; adding a fluid slurry to said post hole to freeze said support post within an interior region of said post hole; disposing a modular platform section on top of said adjustable shoulder member to establish a platform deck surface; and adjusting said adjustable shoulder member so that said platform deck surface is disposed substantially level.

According to a further aspect of the invention, a method of constructing a drilling or production platform is provided, the method including: drilling or hammering a support post into a ground surface, wherein said support post further comprises an adjustable shoulder member; disposing a modular platform section on top of said adjustable shoulder member to establish a platform deck surface; and adjusting said adjustable shoulder member so that said platform deck surface is disposed substantially level.

According to a further aspect of the invention, a method of constructing a platform suitable for drilling and producing oil, gas and hydrate reserves is provided, the method including: disposing a platform section atop a plurality of support posts; disposing two substantially parallel support beam sections between two of said support posts; and disposing a deck section atop said two substantially parallel support beams to provide a bridging support means between said two substantially parallel beams.

According to a further aspect of the invention a method of constructing a drilling or production platform is provided, the method including: providing a first platform section supported by support posts, wherein each of said support posts are disposed proximate to the corners of said first platform section; providing a second platform section, wherein said second platform section further comprises a hooking member that hooks onto a first side of said first platform section; providing a plurality of support posts to support a side of said second platform section disposed opposite said first side of said second platform section; and providing a third platform section, wherein said third platform section further comprises a hooking member that hooks said second platform section.

According to a still further aspect of the invention, a method of assembling a plurality of interlocking modular platform sections useful for supporting drilling equipment on a deck surface is provided, the method including: disposing a first modular platform section and a second modular platform section atop a plurality of platform support posts; disposing a hook and hook receiving member proximate an interface formed between said first platform section and said second platform section, wherein said hook is disposed along a side portion of said first platform section, and said hook receiving member is disposed on a side portion of said second platform section, and thereby.

According to a still further aspect of the invention, a method of communicating utilities between a deck section and a platform section of a drilling or production platform is provided, the method including: disposing a deck section atop a platform section; disposing one or more holes in a top surface of said deck section to permit utility communication between an interior region of said deck section and a deck surface disposed atop said deck section; and disposing one or more holes between a lower surface of said deck section and an upper surface of said platform section.

According to a still further aspect of the invention, a method of heating a drilling or production platform support post is provided, the method including: disposing a fluid conduit through a body portion of said support post; disposing a hollow fluid transfer member around or near an outer surface of said support post, wherein said fluid conduit disposed in a body portion of said support post is in fluid communication with said hollow fluid transfer member; and drawing a cooling or warm fluid into said fluid conduit and passing said fluid through said hollow fluid transfer member.

According to a further aspect of the invention, a method of removing a drilling or production platform support post is provided, the method including: disposing a fluid conduit through a body portion of said support post; disposing a hollow fluid transfer member around or near an outer surface of said support post, wherein said fluid conduit is disposed in fluid communication with said hollow fluid transfer member; drawing a warm fluid into said fluid conduit and passing said fluid through said hollow fluid transfer member to heat the surrounding ground; and applying a pulling force to said support post to pull said support post from the ground.

According to a still further aspect of the invention, a method of removing a drilling or production platform support post is provided, the method including: disposing a fluid conduit through a body portion of said support post; disposing a hollow fluid transfer member around or near an outer surface of said support post, wherein said fluid conduit is in fluid communication with said hollow fluid transfer member; disposing a vent between said fluid conduit and a surrounding ground surface using jets or ports; drawing a fluid or gas into said fluid conduit and passing said fluid through said hollow fluid transfer member, through said vent and out to the surrounding ground surface; and applying a pulling force to said support post to pull said support post from the ground.

According to a still further aspect of the invention, a method of adjusting the height of a modular drilling or production platform section is provided, the method including: disposing a modular platform section atop an adjustable shoulder nut disposed on a support post, wherein a top portion of said support post further comprises a lift receiving means; disposing a lifting means proximate to said lift receiving means, and then mutually engaging said lifting means and said lift receiving means; lifting said modular platform section off of said adjustable shoulder nut and then supporting said modular platform section using a support means; raising said adjustable shoulder nut; and replacing said modular platform section atop said adjustable shoulder nut using said support means.

According to a still further aspect of the invention, a method of sealing an intersection formed between a plurality of interlocked platform modules, the method including: disposing four interlocked platform modules so that a four-way intersection is formed therebetween; disposing a sealing member over said four-way intersection, wherein said sealing member comprises a body member and a plurality of leg members; and augmenting the seal using a deformable sealing material.

DETAILED DESCRIPTION

Figure 1:
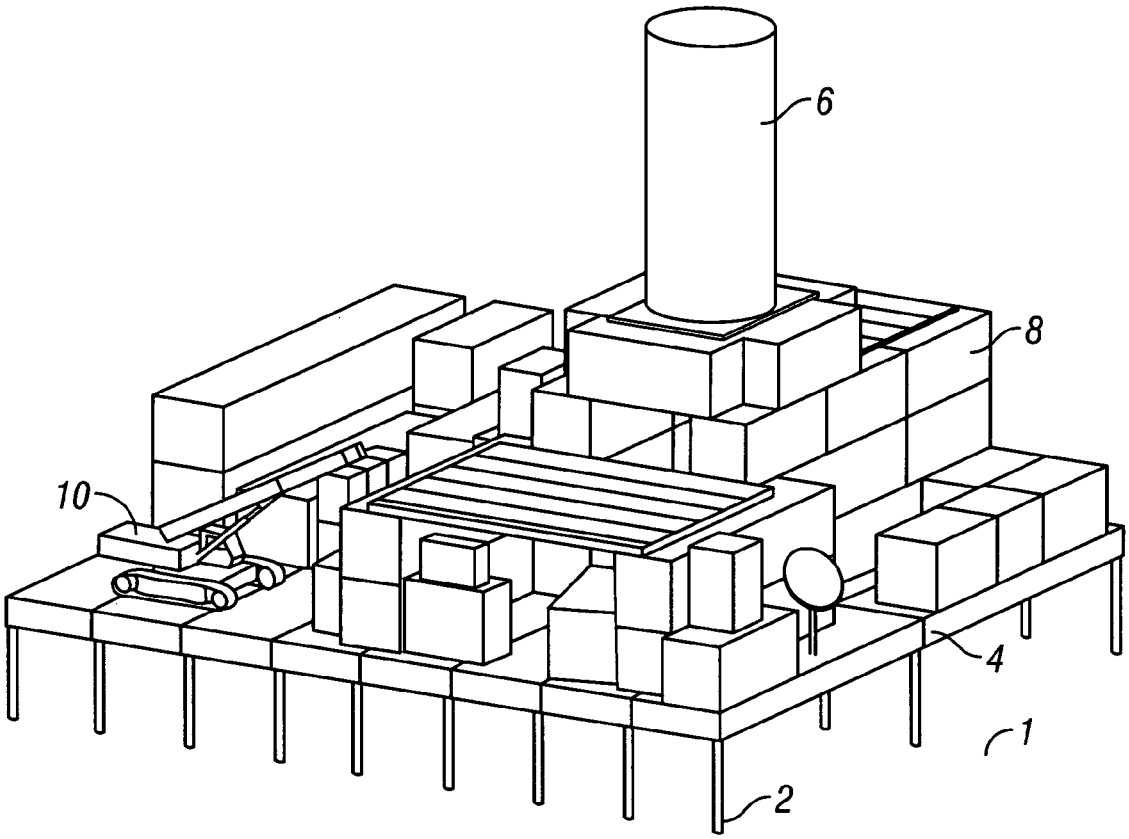
FIG. 1 is a modular drilling or production platform according to the invention.

Referring now to a specific, though non-limiting, embodiment of the invention shown in FIG. 1, a tundra region 1 is shown in which a number of support posts 2 are disposed in a number of post holes drilled into the tundra. The support posts 2 support a substantially level drilling or production platform 4 comprised of numerous interconnected modular platform sections. In certain embodiments, a cylindrical (or other shape) winterizer 6 encloses and winterizes a drilling rig (not shown), and a number of easily transportable modular platform sections 8 are installed around the drilling rig. In some embodiments, for example, where drilling is carried out at very cold temperatures (e.g., in arctic tundra regions), the rig area is heated during drilling operations. In a particular embodiment in which the platform is used for hydrate production, the rig area is only heated to an intermediate temperature of about +10 degrees F., so that recovered hydrates will not thaw and can be preserved for analysis. In other embodiments, however, the rig area is cooled to permit more comfortable drilling conditions during warmer summer seasons.

According to an alternative embodiment, a crane 10 is positioned on a deck portion of platform 4, and is sufficiently mobile to move around on the deck area so that the crane can be used to carry out a number of different lifting and support functions. For example, in one example embodiment, crane 10 is used to assist in the initial outfitting of the platform, and thereafter to move spools of drilling string and other drilling supplies around the platform during drilling and production operations. One or more cranes can also be fixed mounted at key points.

In other embodiments, a group of interconnected housing modules are assembled to provide living quarters for personnel working on the rig. In some embodiments, the housing platform employs a support post and platform module construction method similar to the platform described above, except that housing modules are disposed on the top of the platform deck instead of drilling modules.

Figure 2:
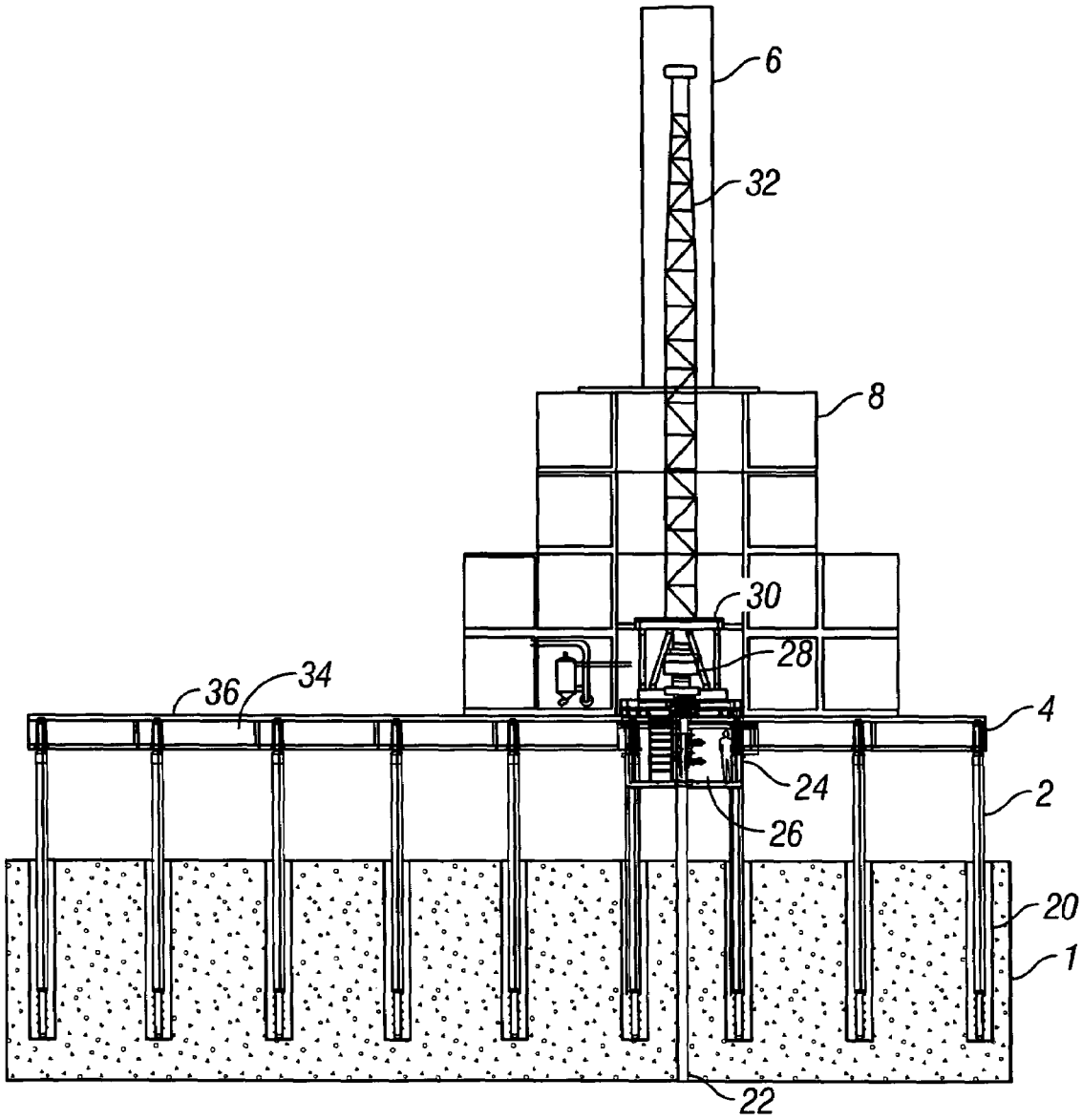
FIG. 2 is a section of a well bore included in the drilling or production platform shown in FIG. 1, taken at a right angle along a length of the platform.

Referring now to an example embodiment shown in FIG. 2, an arctic platform is provided wherein a plurality of support posts 2 are inserted into a plurality of corresponding post holes 20 that have been drilled into the tundra. In one embodiment, support posts 2 are fixed in the post holes 20 by a process known as ad freeze, which comprises pouring a fluid slurry (for example, a slurry of water, sand and gravel) into the post holes 20 in order to fix the support posts 2 in place after the slurry freezes and hardens. In other embodiments, the support posts are drilled or hammered directly into the ground surface. In a further embodiment, a plurality of modular, interconnectible platform sections 4 are installed atop and supported by the support posts 2 after the support posts have been frozen in place; in still further embodiments, a plurality of drilling container sections 8 are then stacked on top of the platform sections 4 to permit convenient local storage of drilling bits and other equipment related to the drilling operation.

In the particular embodiment depicted in FIG. 2, the well being drilled 22 is disposed beneath a wellhead cellar 24 that supports a wellhead 26 and blowout prevention stack 28. In the depicted embodiment, a substructure housing member 30 is disposed above the blowout prevention stack 28 during drilling operations so that the wellhead and blowout stack are safely housed beneath the housing structure 30. In certain other embodiments, however, drilling rig 32 is disposed above the substructure housing 30 so that drilling rig 32 is instead contained within a winterizer 6.

Similar to the embodiment shown in FIG. 1, drilling platform 4 is comprised of a plurality of interconnectible, modular platform sections 34 and associated deck sections 36. In a presently preferred embodiment, drilling or production platform 4 comprises 8 platform sections in width, and is supported by 9 rows of evenly spaced support posts 2 frozen into corresponding post holes 20 drilled in the tundra.

Figure 3:
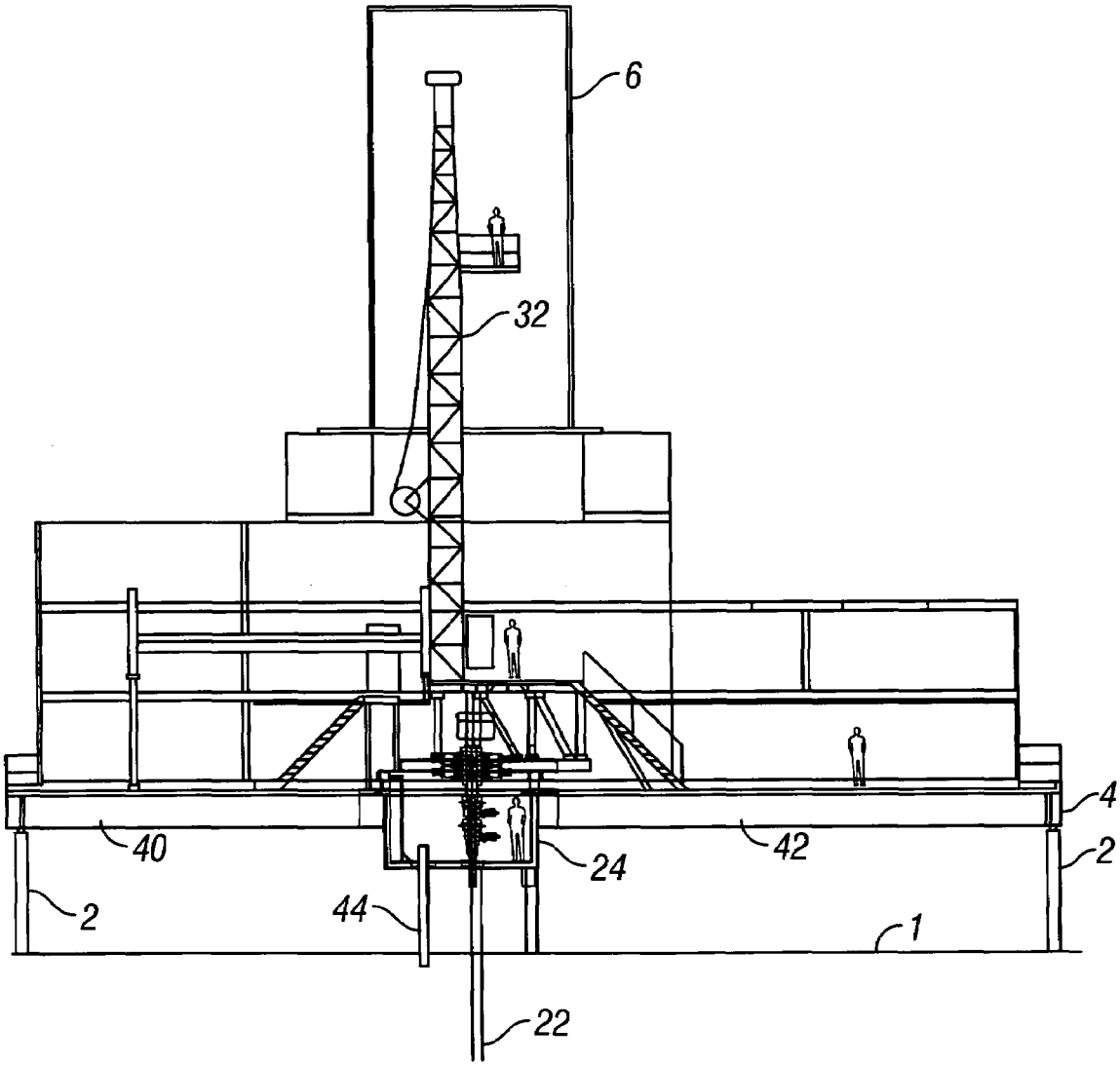
FIG. 3 is a section of a well bore included in the drilling or production platform shown in FIG. 1, taken along a centerline of the platform.
Figure 4:
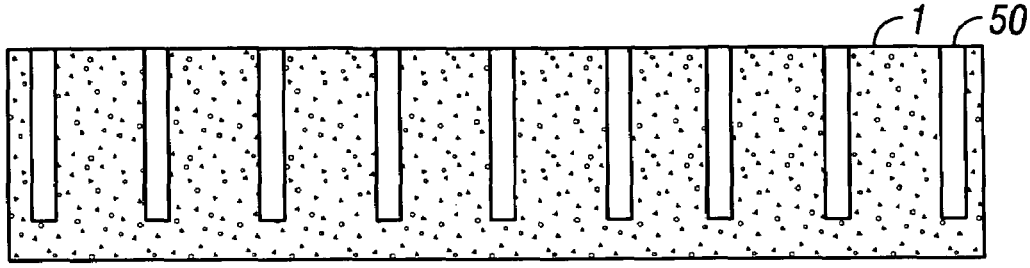
FIG. 4 is a sectional view of a surface tundra region in which a plurality of post holes has been drilled.

Referring now to the example embodiment of FIG. 3, a drilling platform 4 is shown in cross section through a centerline of the well bore, drawn along a length of drilling rig 32. In some embodiments, wellhead cellar 24 is disposed in operative communication with a pair of long wellhead platform sections 40 and 42. In the particular embodiment depicted in FIG. 3, drilling platform 4 further comprises three rows of support posts 2. According to a presently preferred embodiment, arctic drilling platform 4 further comprises about sixteen individual, interconnected platform modules, each of which are about 12.5 feet wide and about 50 feet long; the resulting drilling platform 4 is therefore substantially square, and measures about a 100 feet on each side. In the aforementioned embodiment, there are about twenty-seven support posts 2, each of which supports the weight and alignment of various platform sections. In further embodiments, one or more additional support posts 2 are strategically installed to lend additional stability and load capacity to the system.

In other embodiments, additional wells 44 are drilled to serve as backup wellbores in the event the primary wellbore encounters technical problems such as a broken drill bit or a jammed drilling string. According to a further embodiment, additional wells 44 are used to drill an underground pipeline routed to a remote location so that production removed from the primary well can be pipelined to a remote location in coordination with the ongoing drilling operation. The ability to drill an underground pipeline is particularly useful in environmentally sensitive sites in that removal and transportation of oil, gas and/or hydrates reserves can all be carried out deep beneath the ground surface, thereby reducing disturbance of the surrounding tundra region. The additional wells 44 can also be used to establish a field size.

According to a method of practicing the invention shown in FIGS. 4-9, a plurality of holes 50 are first drilled into a ground surface or frozen tundra region 1. In some embodiments, post holes 50 are evenly spaced apart; however, in other embodiments, additional support posts are strategically installed to lend greater stability and structural rigidity to the platform system. In other embodiments, only a few post holes (or even a single hole) are drilled to receive the support posts of a smaller, stand-alone work module, for example, a nearby secondary well drilled to relieve or apply fluid pressure to the drilling operation.

Figure 5:
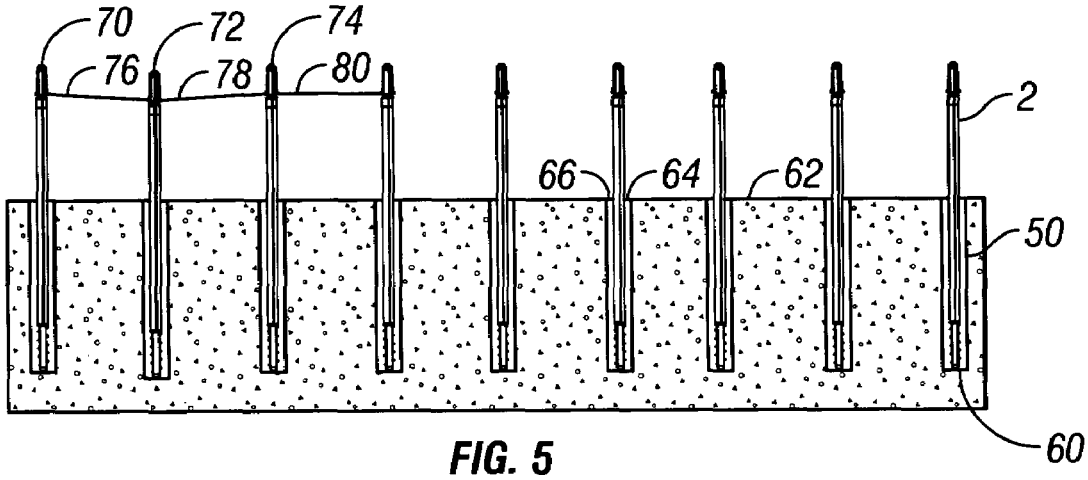
FIG. 5 is the sectional view of FIG. 4, further comprising a plurality of support posts disposed in the post holes.

According to the embodiment shown in FIG. 5, a plurality of support posts 2 are then inserted into each of the post holes 50, with lower portions of the posts being supported by a plurality of post hole ground surfaces 60, and intermediate portions of the posts being supported by one or more support brackets 64 and 66 attached to provide a temporary surface fitting at the surface level 62 of tundra region 1 while the support posts are being frozen in place within the post holes. According to a further embodiment, once the support posts 2 have been fixed in drilled post holes 50, a slurry comprised of water, sand and gravel mixture is poured into the hole and allowed to freeze. According to still further embodiments, adjustable support brackets 64 and 66 are inserted near the top of the hole during the slurry freezing process, so that the tops of the support posts 2 stay accurately aligned during the slurry freezing process. In the example embodiment of FIG. 5, a plurality of adjustable shoulder nuts 70, 72 and 74 are disposed near the tops of each of the support posts 2; in the depicted embodiment, the adjustable nuts are disposed at different elevations (as indicated by lines 76, 78 and 80) due to localized inaccuracies in the depths of the post holes.

Figure 6:
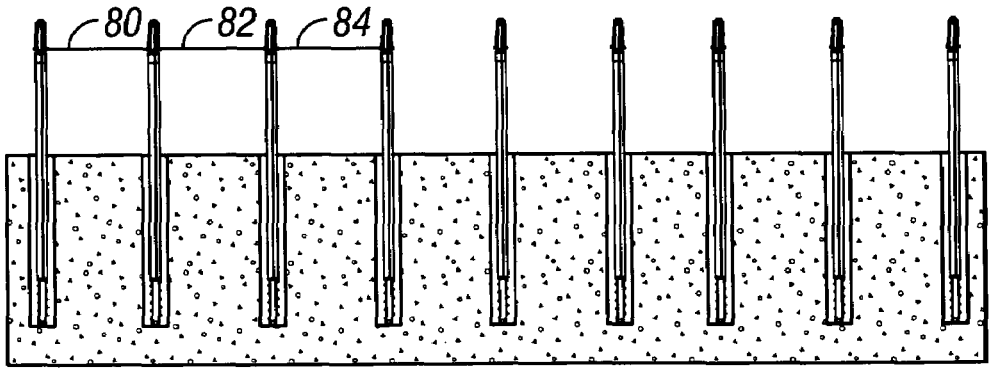
FIG. 6 is the sectional view of FIG. 5, further comprising a plurality of support posts having adjustable shoulders.

As seen in the example embodiment shown in FIG. 6, adjustable shoulder nut 72 is then raised (for example, by threading the nut up the shaft of a complementary threading formed on a portion of the support post) up to the same elevation level as the other adjustable nuts 70 and 74 (as indicated by lines 80, 82 and 84). In this manner, a level plane is formed to support the later installation of a drilling platform, although in other embodiments, portions of the drilling platform are assembled prior to the drilling of the post holes, and whole sections of previously assembled platform modules are installed on the legs, and then leveled using the adjustable nuts.

Those of ordinary skill in the art will appreciate that when various platform sections are of a common cross-sectional thickness, it is convenient to set each of the adjusting nuts at about the same height. However, in other embodiments it is beneficial to set the adjustable nuts at different predetermined heights rather than a common height, depending upon the actual structural requirements imposed by various operational environments, for example, to build up the pitch of a side of the platform disposed on a downward slope.

Figure 7:
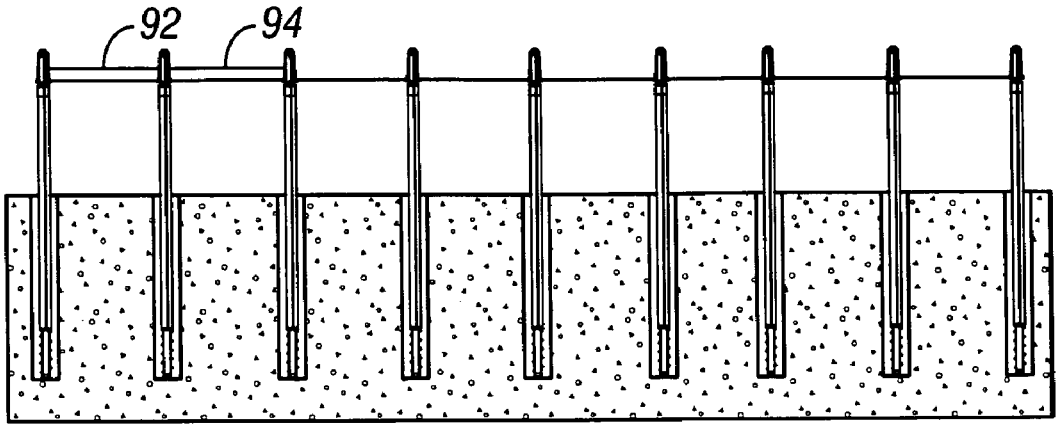
FIG. 7 is the sectional view of FIG. 6, further comprising a group of interconnected modular platform sections disposed on top of the platform support posts.

FIG. 7 shows the cross-sectional platform view of FIG. 6, further comprising a pair of interconnected modular platform sections 92 and 94 installed over a plurality of adjustable shoulder nuts. In one example embodiment, four interconnected modular platform sections are installed over the shoulder nuts of four support posts, for example, the two platform sections 92 and 94 depicted herein and two additional modular sections (not shown) disposed directly behind sections 92 and 94. When the installation of deck sections is complete, workers are provided with a level and secure platform surface from which to drill, and effluent and metal cuttings can be contained in the box-like lower body portions of the deck sections. In still further embodiments, a canvas tarp or the like is disposed beneath and around an outer perimeter of the deck sections, and serves as a skirt or trap to ensure that as much waste as possible is captured and recovered from the drilling site.

Figure 8:
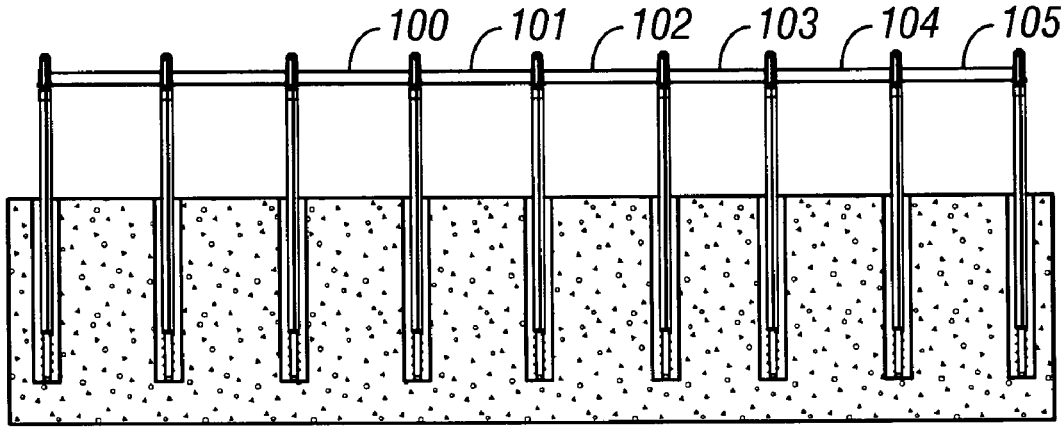
FIG. 8 is the sectional view of FIG. 7, further comprising a full level of interconnected modular platform sections disposed on top of the platform support posts.

Referring now to the example embodiment of FIG. 8, a full level of interconnected modular platform sections 100-105 is then installed over each of the adjustable shoulder nuts. According to one aspect of the invention, minor adjustments to the heights of the shoulder nuts are then effected in order to correct the level of the platform on an as-needed basis. According to various other embodiments, the leveling corrections can be effected when the individual deck sections are being installed, or after all or some of the sections have already been assembled and interlocked.

Figure 9:
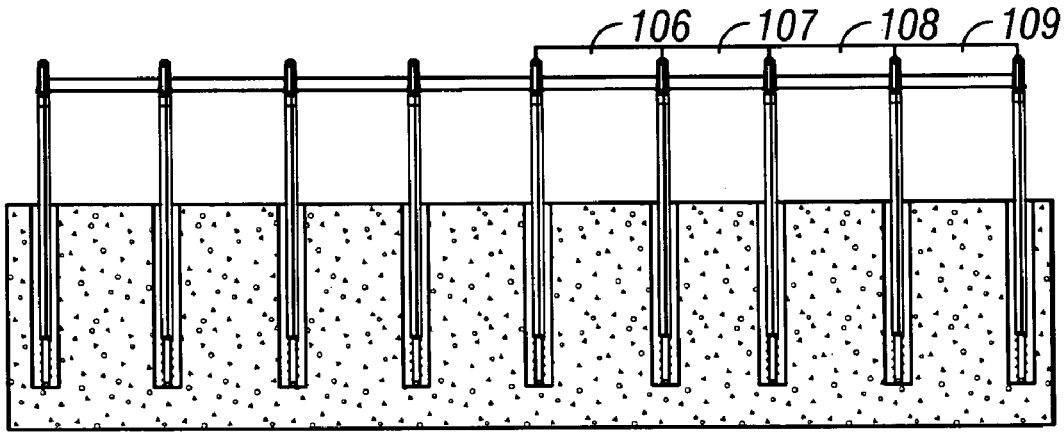
FIG. 9 is the sectional view of FIG. 8, further comprising a plurality of deck sections installed atop the modular platform sections.

In the example embodiment of FIG. 9, a plurality of modular storage sections 106-109 is then installed above at least a portion of the platform deck. In some embodiments, the various storage sections 106-109 are strategically arranged so as to conveniently contain the equipment and supplies required to drill and maintain a well, for example, drill string and associated casings, lubricants, power generators, etc.

Figure 10:
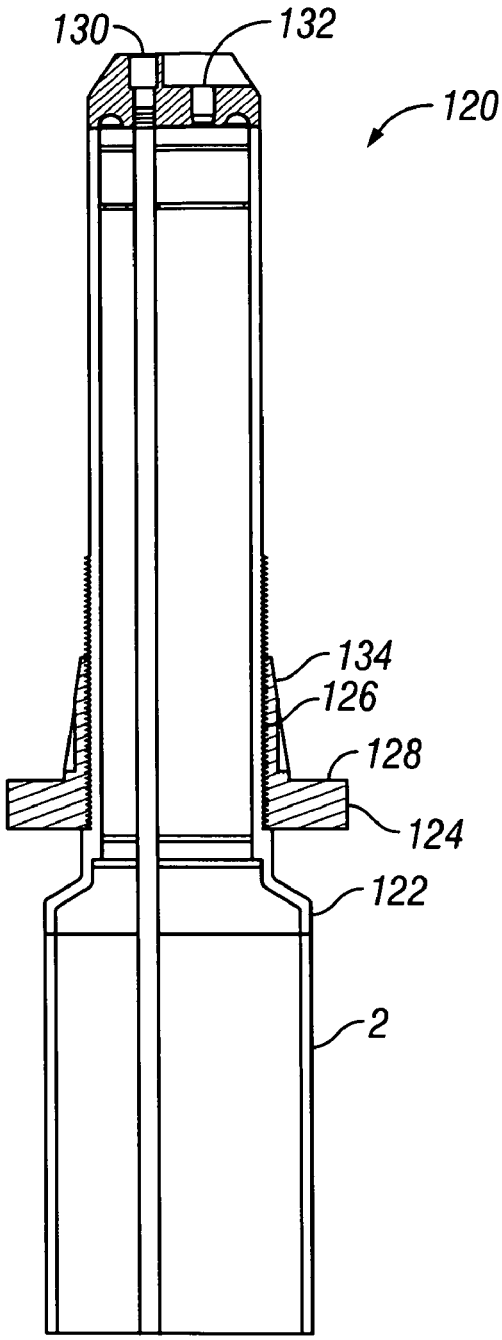
FIG. 10 is the topmost portion of a support post, further comprising an adjustable nut disposed at the bottom of the adjustment stroke.

According to the example embodiment shown in FIG. 10, the upper portion 120 of a support post 2 further comprises an adjustable shoulder nut 124 disposed at the bottom of the adjustment stroke. In some embodiments, upper post portion 120 has a reduced cross section 122, and an adjustable shoulder nut 124. In further embodiments, adjustable shoulder nut 124 further comprises an internal threaded region 126, and a tapered, upwardly facing shoulder member 128.

According to one aspect of the invention, support posts 2 are installed with each of the adjustable shoulder nuts 124 set at the bottom of the adjustment stroke; in other embodiments, however, the adjustable shoulder nuts 124 are set at predetermined positions other than at the bottom of the stroke, or even in random positions, depending upon the particular operational requirements of the drilling environment. In other embodiments, a tapered section 134 is provided at the top of adjustable nut 124 to allow wedges or shims to be dropped inside a space formed when a module is placed onto a post, thereby lending lateral support to the post as well as vertical support. In still other embodiments, one or more fluid receiving fittings 130 are provided at the top of the support post for receiving and circulating a heating or cooling fluid within a body portion of the post, and a threaded receiving member 132 is provided for attachment of a lifting means. In alternative embodiments, receiving member 132 is not threaded, and instead comprises a slip-toothed fastening assembly; in still further embodiments, receiving member 132 comprises an inverted nut and bolt receiving assembly for receiving a lifting means that has been lowered from the deck surface disposed above.

Figure 11:
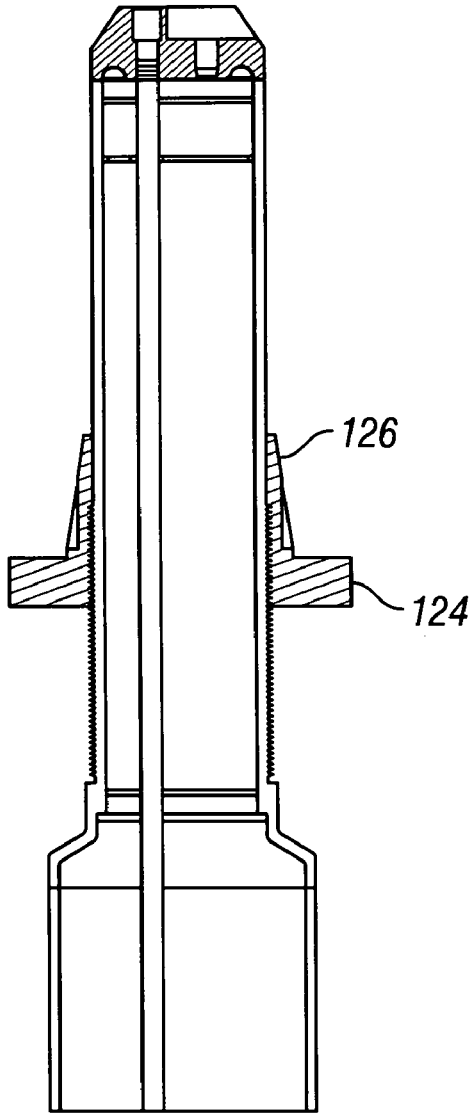
FIG. 11 is the topmost portion of a support post, further comprising an adjustable nut disposed at a position higher than the bottom of the adjustment stroke.

According to further examples of the invention, FIG. 11 shows an adjustable nut that was initially set at a position higher than the bottom of the adjustment stroke, for example, near the middle of the adjustment stroke in order to build up a platform section disposed on a downward slope. In FIG. 11, adjustable shoulder nut 124 has been threaded up the support post to a higher position as a method of setting an upper shoulder 126 of the adjustable nut at the same elevation as the shoulders on neighboring posts.

Figure 12:
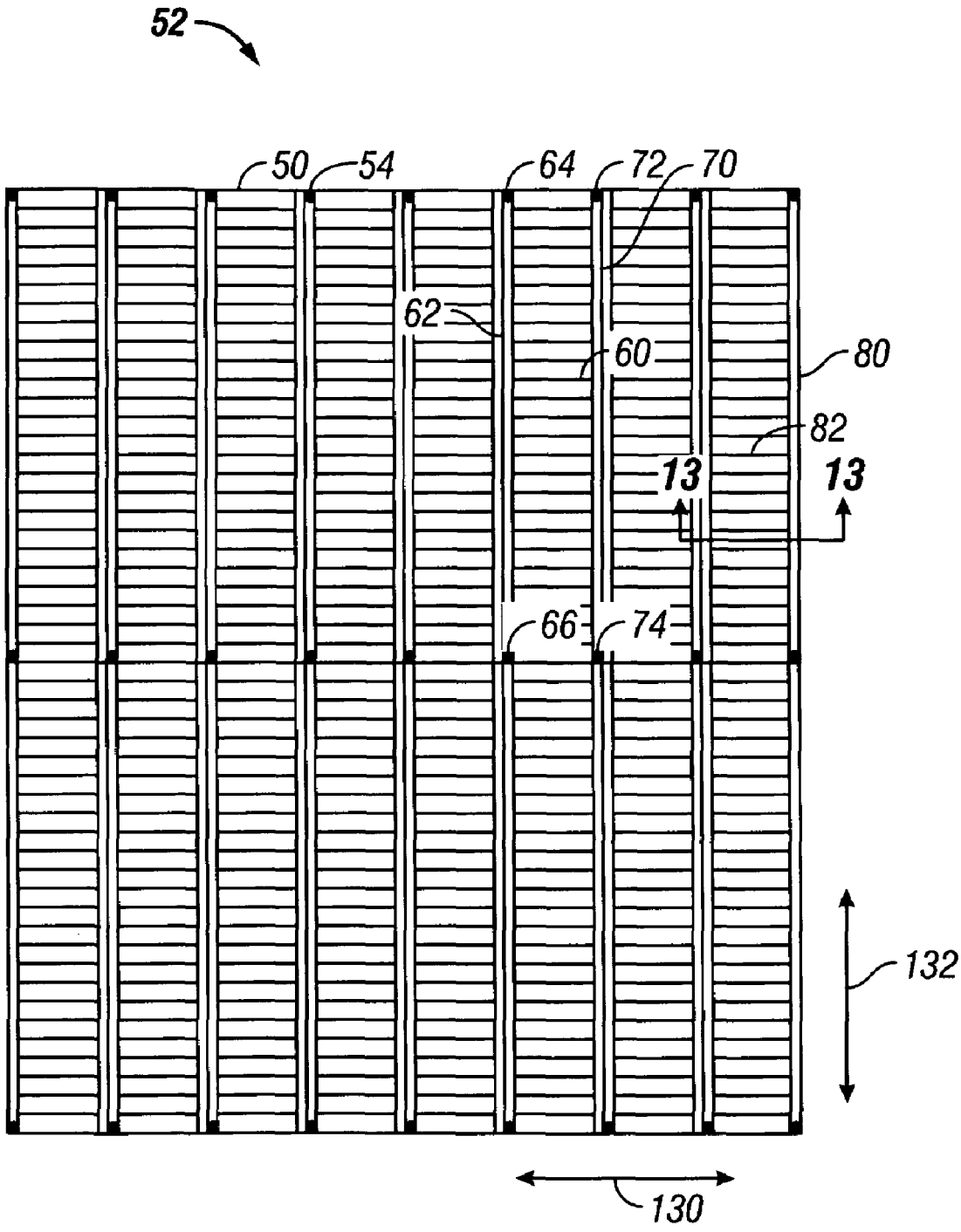
FIG. 12 is a group of interconnected modular platform sections, installed atop a plurality of platform support posts.

According to the example embodiment of FIG. 12, a plurality of interconnected modular platform sections 50 is provided, each of which is installed atop a plurality of support posts. According to a further embodiment, the lengths of the platform sections are elongated relative to their widths; in a presently preferred embodiment, the lengths of the platform modules are elongated relative to their widths by a ratio of about 4:1. For example, in one particular embodiment, each platform section is about 12.5 feet wide and about 50 feet long. In the depicted embodiment, sixteen such platform sections are combined to provide a substantially square deck surface that is about 100 feet in both length and width.

According to a detailed embodiment, platform 52 is supported by twenty seven different support posts 54, each of which engage various platform sections from beneath the platform. Along the left side of platform section 60 is a beam member 62, which provides bridging support between support posts 64 and 66. Along the right side of platform section 60 is another beam member 70, which provides bridging support between support posts 72 and 74. In one embodiment, the underside of platform section 80 is a flat plate and includes a plurality of stiffening members 82; in some embodiments, stiffening members 82 are not intended to be structural or load bearing members, and are instead designed to support an accumulation of liquids and effluent that usually develops on a drilling platform.

According to one example embodiment, an interlocking method of securing the platform modules to one another permits disposition of but a single support post at each platform intersection, and adjacent platform modules are all supported by that single post. Although the interior corners of each platform section are near to and supported by a single support post, the support post is not necessarily attached to each of the surrounding platform sections. In one embodiment, for example, platform sections are attached to the support posts in such a fashion as to provide greater support in the direction of a line between support post 64 and support post 66; in this embodiment, greater support would also be provided between support post 72 and support post 74. In this configuration, however, only minimal support is provided in the direction from support post 64 to support post 72, and from support post 66 to support post 74, said minimal support deriving from the rigidity produced when adjoining portion of platform sections are interlocked rather than by attachment of the platform section to a support post.

Figure 13:
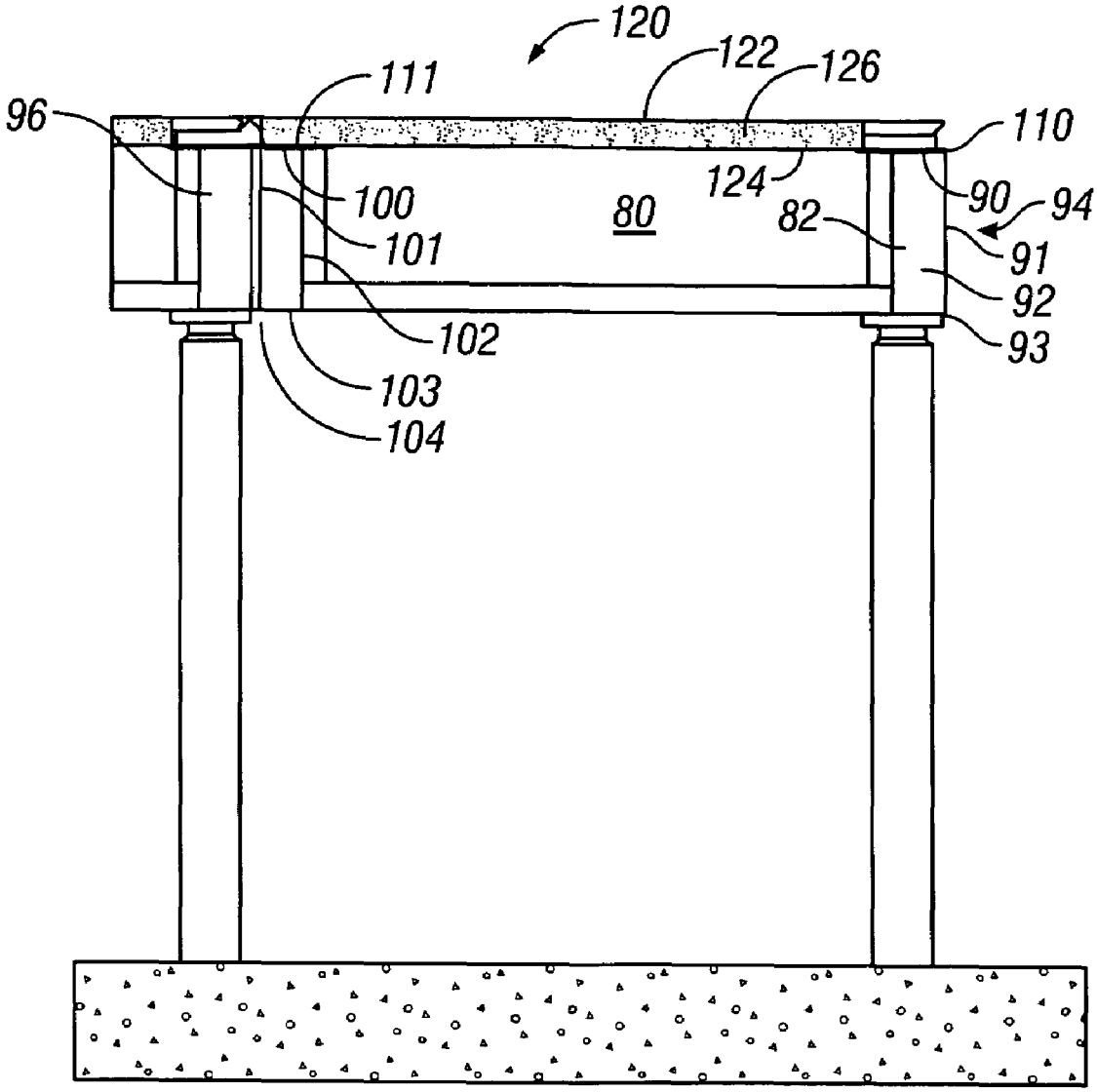
FIG. 13 is a cross-sectional view of the installed platform sections shown in FIG. 12.

According to an example embodiment depicted in FIG. 13, a load placed anywhere on the individual deck sections will be supported initially by the deck surface 120, which in turn transfers the weight load in the direction indicated by arrow 130 (see FIG. 12) toward beam sections 82 and 96 disposed beneath the deck. The weight of the load is then transmitted down the side beams in the direction of arrow 132 (see FIG. 12) toward the support posts, which in turn directs the weight into the surface of the tundra. According to a further embodiment, rectangular beam 82 is established by assembly of a plurality of interlocked platform modules disposed on a side 94 portion of platform section 80; likewise, opposed rectangular beam 96 is established by assembly of a plurality of interlocked platform modules disposed on another side 104 of platform section 80.

On top areas 110 and 111 of beam sections 82 and 96, a deck section 120 is installed and then locked into place. In one example embodiment, deck section 120 provides direct support for the various equipment and supply packages loaded on top of the deck. According to another embodiment, beam sections 82 and 96 provide support in the direction of the support posts 64 and 72 shown in FIG. 12.

In a further embodiment, deck section 120 comprises a composite structure having a top plate 122 and a bottom plate 124, separated by a foam mixture 126 disposed in an interior region established within the platform modules. In one particular embodiment, foam mixture 126 is a polyurethane foam mixture that not only stabilizes and supports the structural integrity of the top and bottom plates, but also provides a compressive strength sufficient to support heavy equipment loads placed on top of the deck surface 120. According to a further embodiment, the polyurethane foam mixture 126 also dampens the loud noises and structural vibrations typically created during drilling operations.

Figure 14:
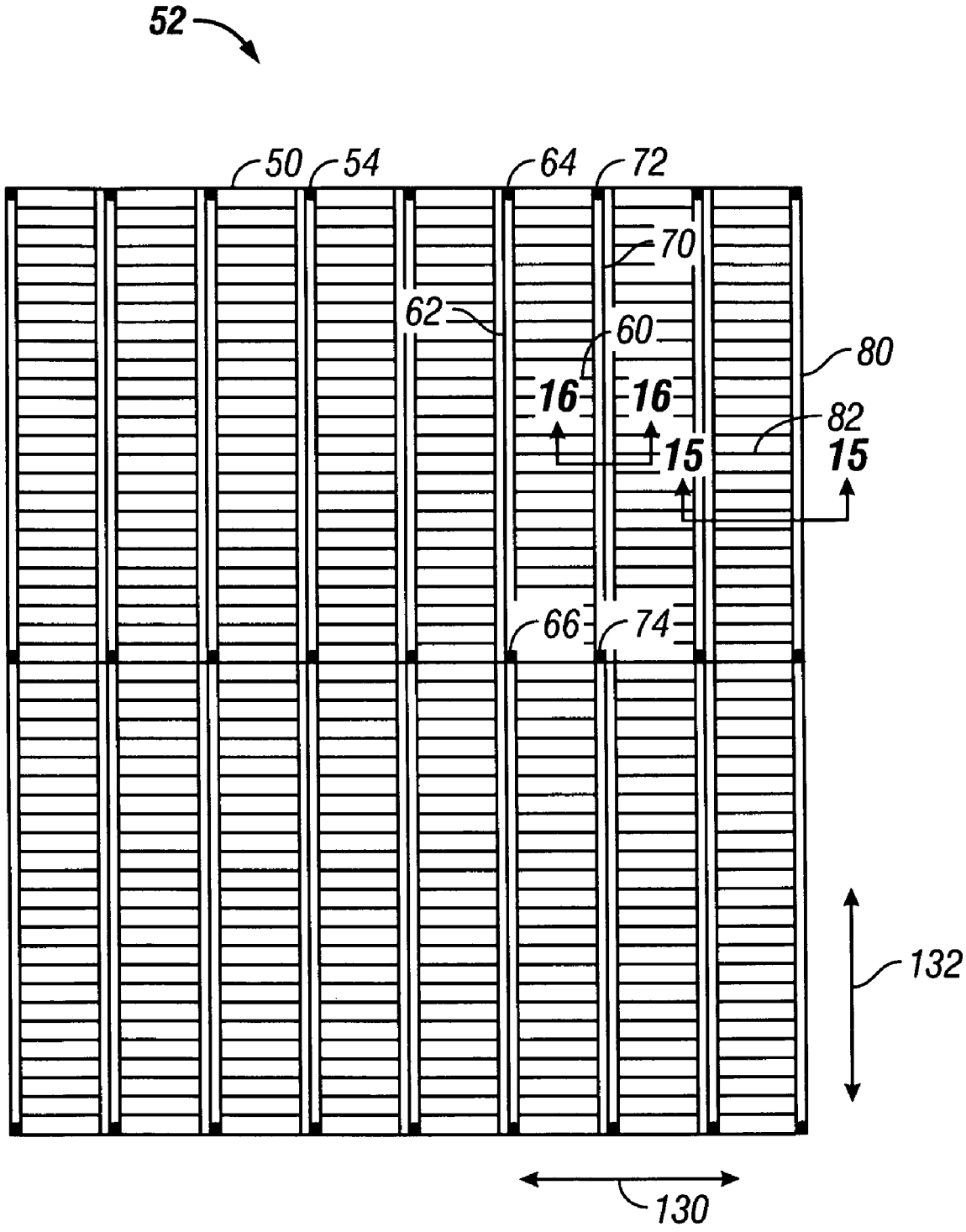
FIG. 14 is a top view of assembled modular platform sections according to the invention.
Figure 15:
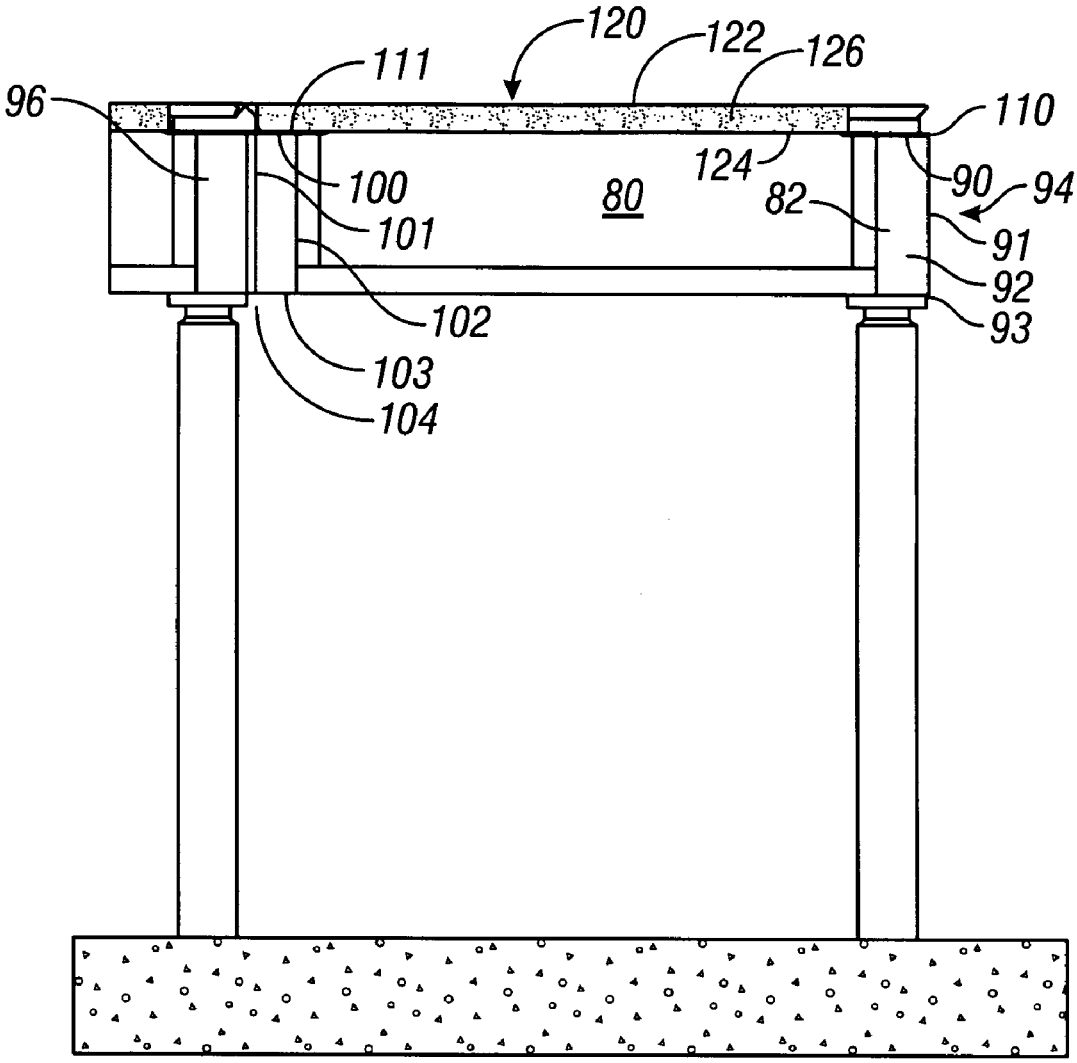
FIG. 15 is a cross-sectional view of the assembled platform sections of FIG. 14.

Turning now to methods and means of interlocking the platform modules, FIGS. 14 and 15 show a plurality of assembled modular platform sections similar to the embodiments described in FIGS. 12 and 13.

For example, the platform is supported by twenty-seven support posts 54, which engage the various platform sections from underneath. Along the one side of platform section 60 is a beam member 62 that provides bridging support between support posts 64 and 66. Along the other side of platform section 60 is another beam member 70, which provides bridging support between support posts 72 and 74. The bottom of platform section 80 is a flat plate and includes a plurality of stiffening members 82, which are not intended to be structural or load bearing in nature other than having sufficient capacity to support an accumulation of fluids that build up during drilling operations.

A single support post is disposed at each platform intersection, and the adjacent platform modules are all supported by that single post. While each platform section corner is near to and supported by a support post, the support post is not necessarily disposed in that platform section; the corners of some of the platform sections are supported by only the interlocking connection members disposed therebetween.

Figure 16:
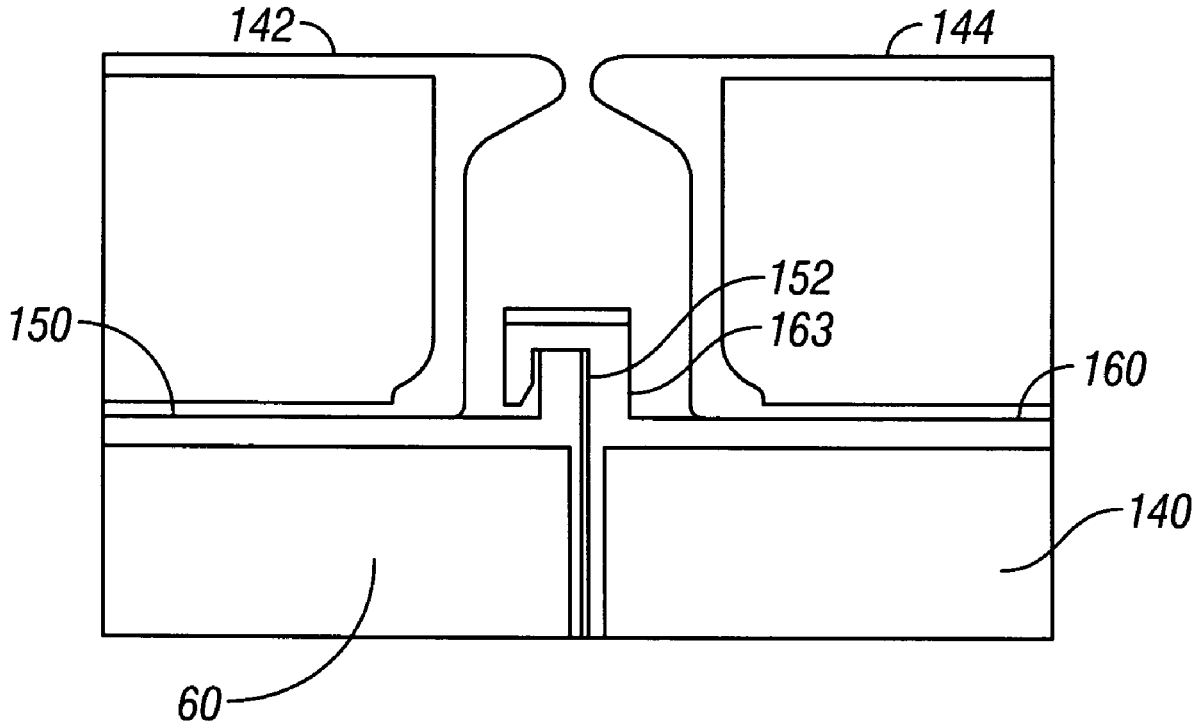
FIG. 16 is a partial view of the assembled platform sections shown in FIG. 14.

According to the example interlocking platform connection system shown in FIG. 16, a first platform section 60 is disposed adjacent to a second platform section 140; a first deck section 142 is installed over platform section 60, and a second deck section 144 is installed over platform section 140. According to certain embodiments, a fence member 152 projects upwardly from an upper surface 150 of platform section 60. According to a further embodiment, upper surface 160 of platform section 140 has a hook 162 disposed over the fence member 152. According to the example embodiment of FIG. 16, hook 162 is formed structurally integral with platform section 160, and provides support for the side of platform section 160; in other embodiments, however, hook 162 is not formed structurally integral with platform section 160, and is instead mechanically affixed to the system to provide support for the side of platform section 160.

Figure 17:
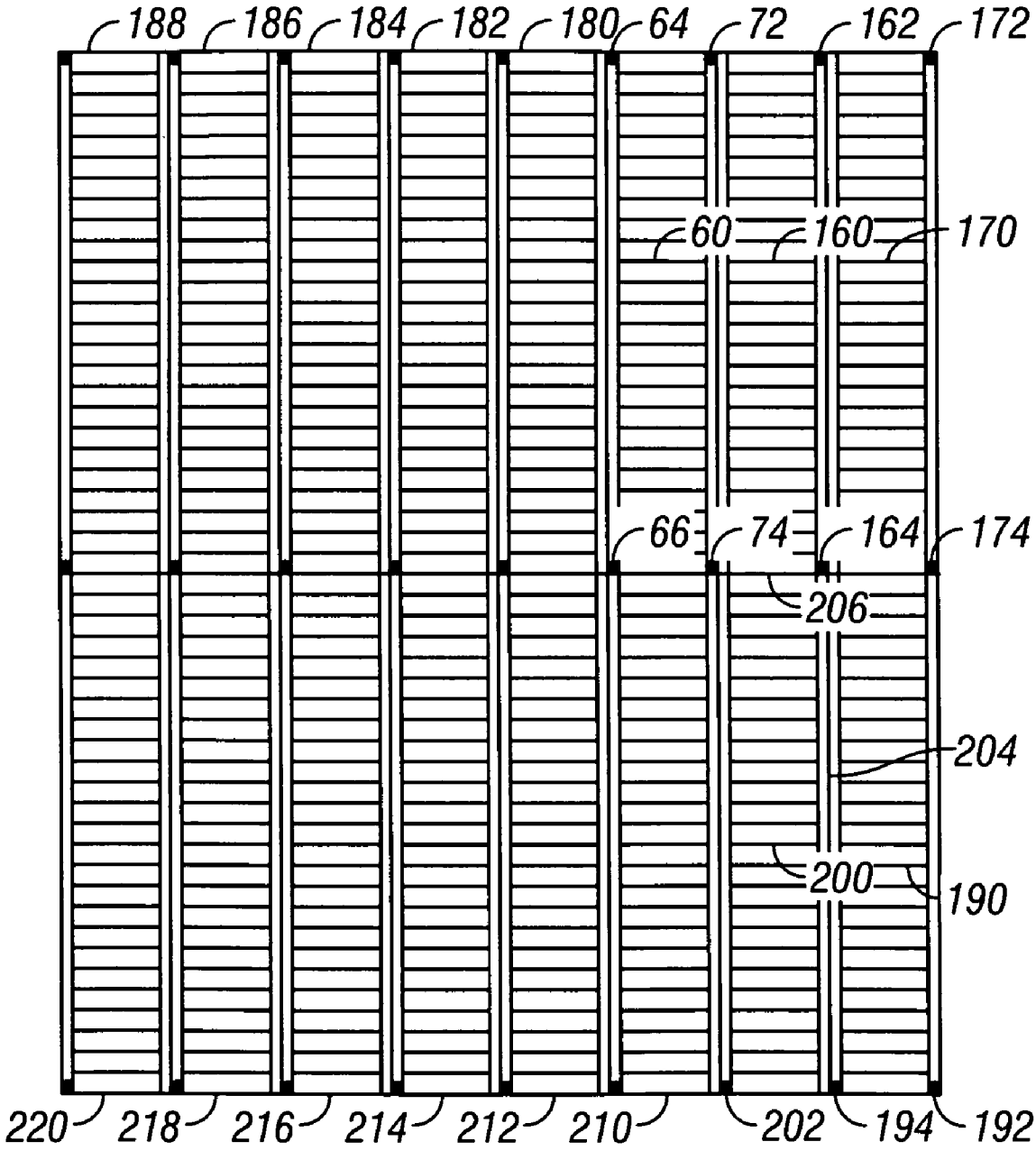
FIG. 17 is a top view of a group of interconnected modular platform sections.
Figure 18:
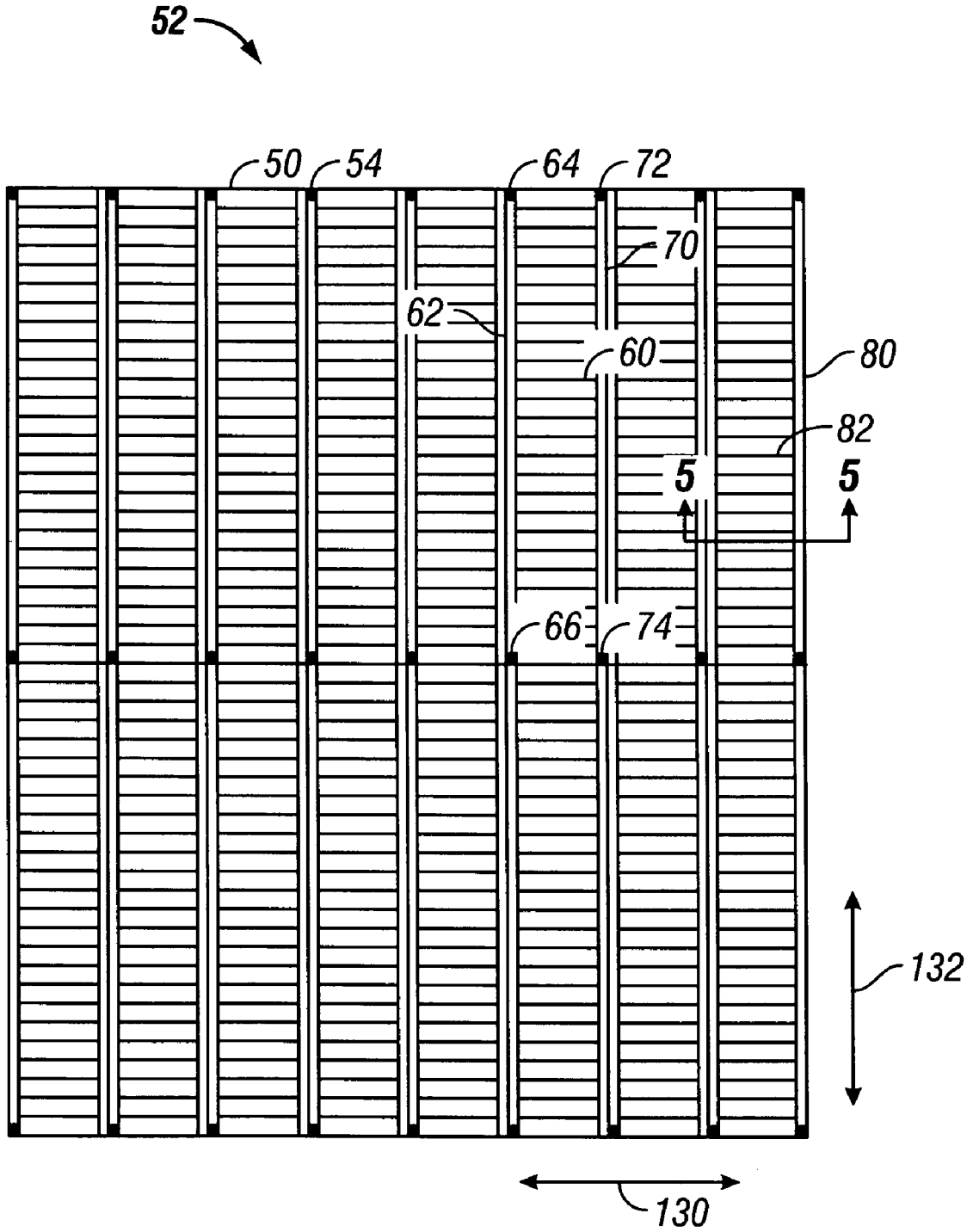
FIG. 18 is a top view of a group of interconnected modular platform sections.
Figure 19:
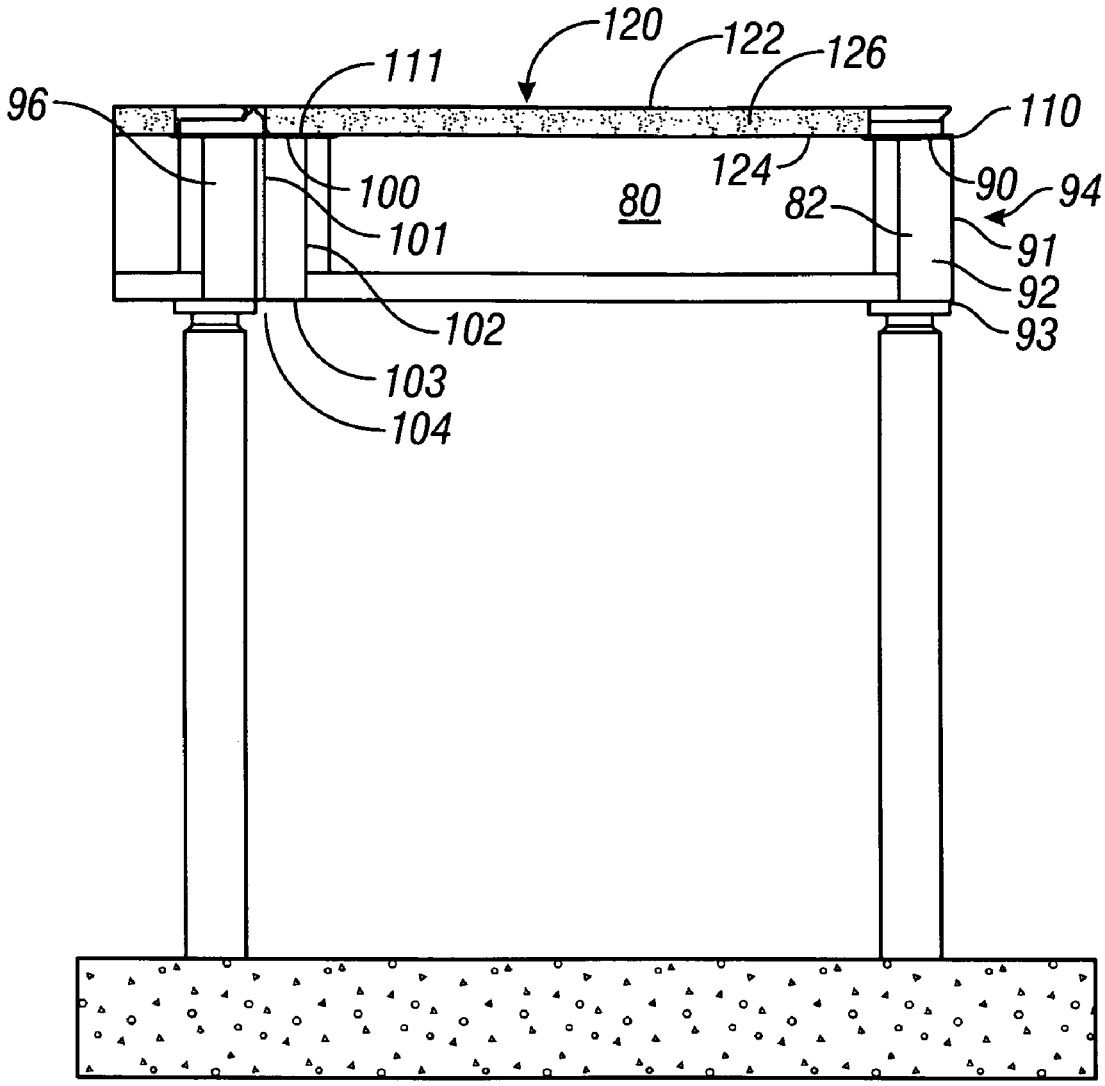
FIG. 19 is a cross-sectional view of the interconnected modular platform sections shown in FIG. 18.
Figure 20:
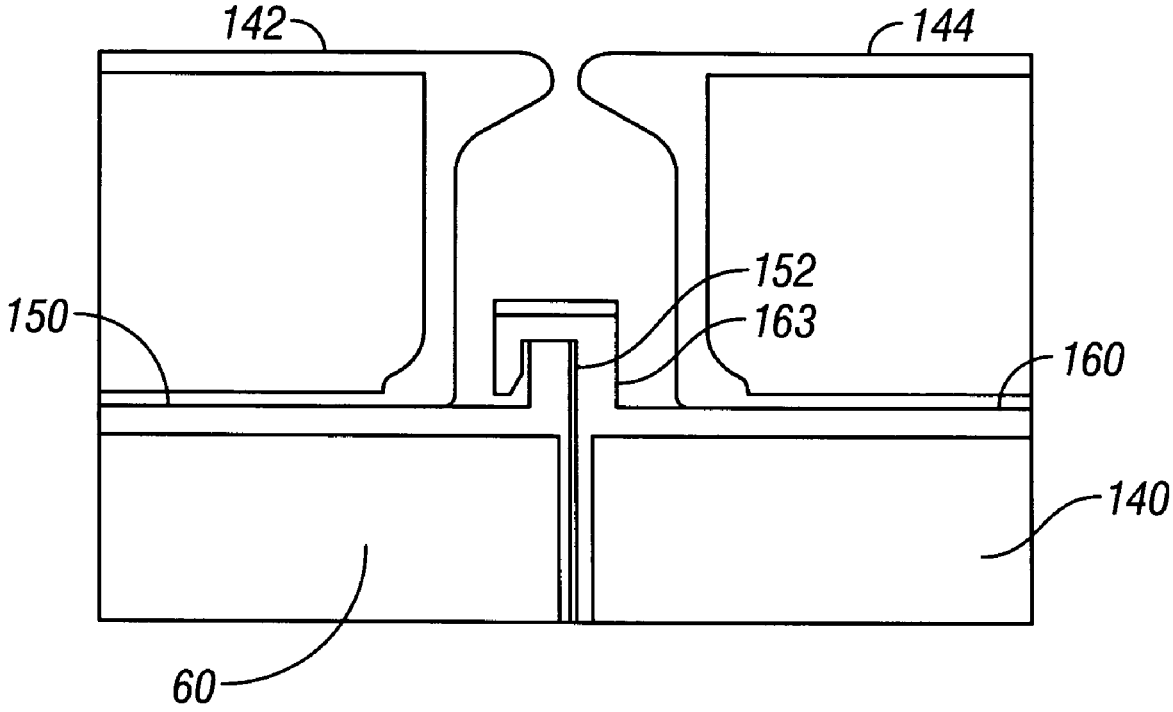
FIG. 20 depicts a connecting means useful for interconnecting a plurality of modular platform sections.
Figure 21:
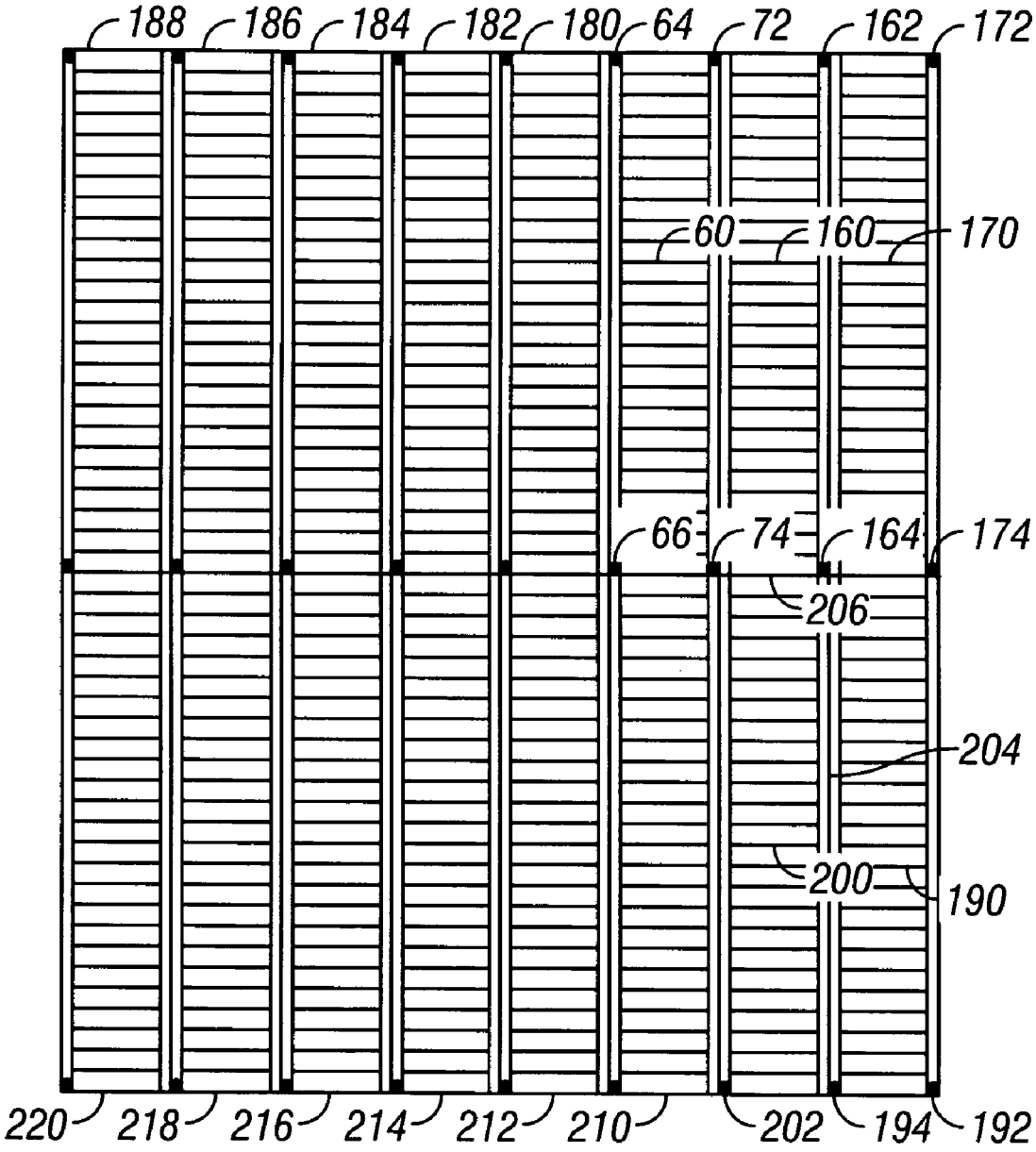
FIG. 21 is a top view of a group of modular platform sections that are interconnected using a connecting means according to the invention.

According to the example embodiment of FIG. 17, a first platform section 60 is logically supported by at least four different support posts 64, 66, 72 and 74. According to a further embodiment, however, a second platform section 160 is supported by only two additional support posts 162 and 164, while support on the opposite side is achieved by means of a hooking member 163 engaged over a portion of fence member 152 shown in FIG. 16. According to a still further embodiment, platform section 170 is supported by only two additional support posts 172 and 174, though platform section 170 also gains support from support posts 162 and 164 on the opposite side by means of the mentioned hook and fence member combination. According to a still further embodiment, additional platform sections 180, 182, 184, 186 and 188 are successively installed, in each instance installation requiring only two additional support posts and an opposed, complementary hook and fence member combination to ensure a secure and reliable connection.

Similarly, platform section 190 employs two additional support posts 192 and 194 at the end of the platform section disposed furthest away from platform section 170. However, platform section 190 gains additional support from attachment to support posts 164 and 174, and also from a hook and fence member combination disposed at the end most proximate to platform section 170. Consequently, platform section 200 requires only a single additional support post 202, provided said support post is employed in combination with a hook and fence member support means at each of intersections 204 and 206. Additional platform sections 210, 212, 214, 216, 218 and 220 will also require only a single additional support post each, again provided the configuration includes an appropriate hook and fence member combination on two of the sides disposed opposite the support post.

Turning now to other example methods and means for connecting platform sections together, FIGS. 18-21 again show a drilling platform comprised of a group 52 of platform sections that have been interconnected for support of equipment storage modules that will later be installed on top of various portions of the platform. As shown, the platform sections are supported by twenty-seven support posts 54, which engage various platform sections from locations disposed beneath the platform. Those of ordinary skill in the art, however, will appreciate that any number of platform and deck sections can be assembled into a single unitary whole (or even several discrete modular platform units), and any number of support posts can be employed to support the structure, depending on the various field requirements imposed by actual operating environments. Those of ordinary skill in the art will also appreciate that by employing the example platform assembly methods described above, weight loads can be directed and distributed in virtually any direction along the platform, and additional interconnections between platform sections can be established to either support weight loads disposed on deck sections, or to otherwise lend stability and structural rigidity to the resulting platform system.

Figure 22:
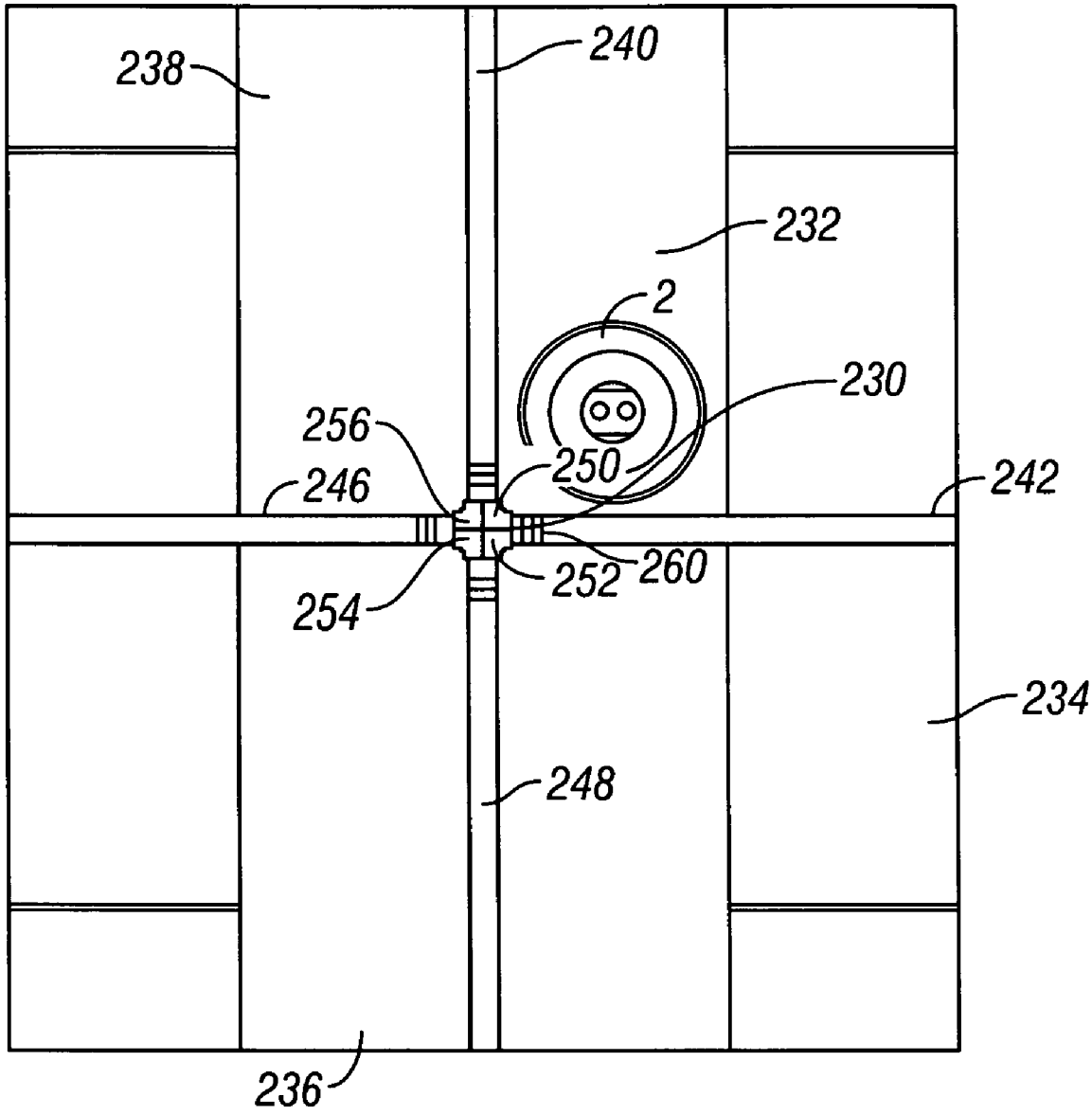
FIG. 22 is a depiction of an intersection established between four interconnected modular platform sections.

Referring now to the example embodiment of FIG. 22, a support post 2 is shown disposed near an intersection 230 of four interconnected platform modules 232, 234, 236 and 238. Moving out radially from intersection 230, a plurality of connecting hooks 240, 242, 246 and 248 are disposed over complementary fence members 250, 252, 254 and 256, so that the several associated platform sections are securely interconnected. The hook and fence member assemblies also serve to effectively seal the intersection 240 where the platform sections are joined, at least insofar as accumulated water and the like will easily pass from one platform section to another across body portions of the hook and fence locking assemblies.

Intersection 230, however, is more problematic. For example, virtually any liquid can pass through the space formed at the center of the four-corner intersection, and then pass between platform sections and down onto the ground surface disposed below. According to one aspect of the invention, therefore, a sealing member is provided to close the space formed at intersection 230, the seal generally being disposed on the top side portion of the intersection, although installation of the seal from the bottom side of the intersection 230 is also contemplated. The sealing member, which in this case is referred to as an x-seal because of its shape, extends in each of four directions at least as far as a series of sealing grooves 260 that have been cut into body portions of each of the associated fence members 250, 252, 254 and 256.

Figure 23:
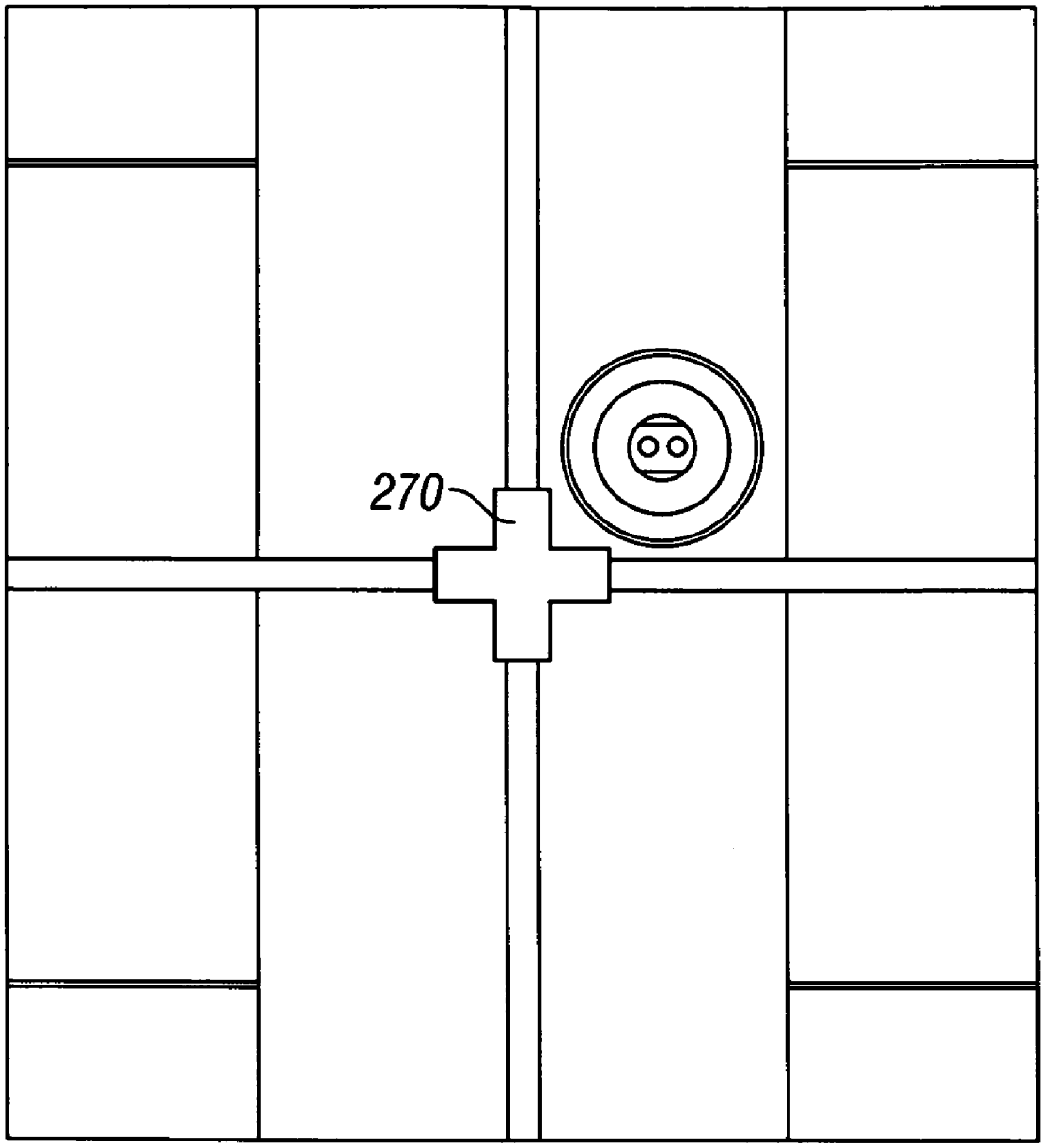
FIG. 23 is a view of the intersection of four interconnected modular platform sections shown in FIG. 22, wherein the intersection is substantially sealed by a sealing means.

For example, as seen in FIG. 23, a platform sealing member 270 is dropped over a four-corner intersection where four assembled platform modules have been interconnected. The body of the seal is substantially in direct contact with body portions of the fence members 250, 252, 254 and 256 (see FIG. 22), and therefore also directs water or other accumulated fluids across away from the intersection 230 of the interconnected platform modules. Since there is still a potential for dirty water or other fluids to land on top of a fence member and then seep underneath an end portion of one of the x-seals, a plurality of small grooves disposed in the fence members cut crossways across the fence members so that any fluid that would otherwise tend to run along the bottom of the x-seal will instead be diverted in another direction by means of fluid contact with any one of the series of small cut grooves 260 depicted in FIG. 22.

Figure 24A:
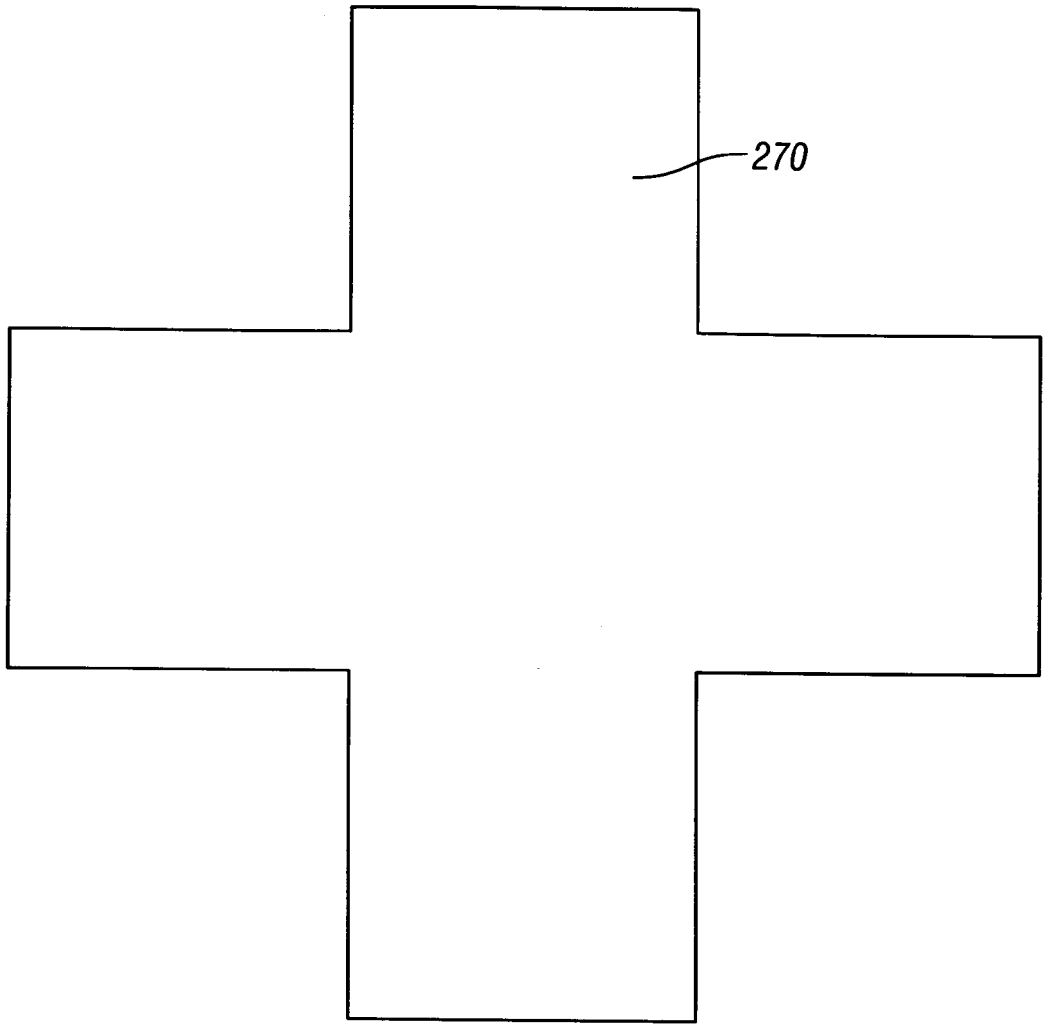
FIG. 24*a* is a top view of an x-shaped sealing member useful for substantially sealing a gap formed at the intersection of a plurality of interconnected modular platform sections.
Figure 24B:
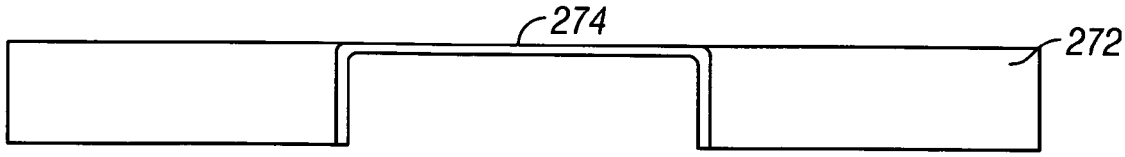
FIG. 24*b* is a side view of the x-shaped sealing member shown in FIG. 24*a*.

According to an example of the invention shown in FIGS. 24*a* and 24*b*, an appropriate x-shaped seal member 270 is shown, which in some embodiments comprises a thin metal plate 274 equipped with a plurality of leg members 272, which depend from and around various portion of thin plate 274. In some embodiments, leg members 272 are formed structurally integral with thin plate 274, though in other embodiments leg members 272 comprise a plurality of separate pieces (e.g., a number of small metal rectangles) affixed to thin plate 274 using a known connection method, for example, welding the metal rectangles to the thin plate.

Figure 25:
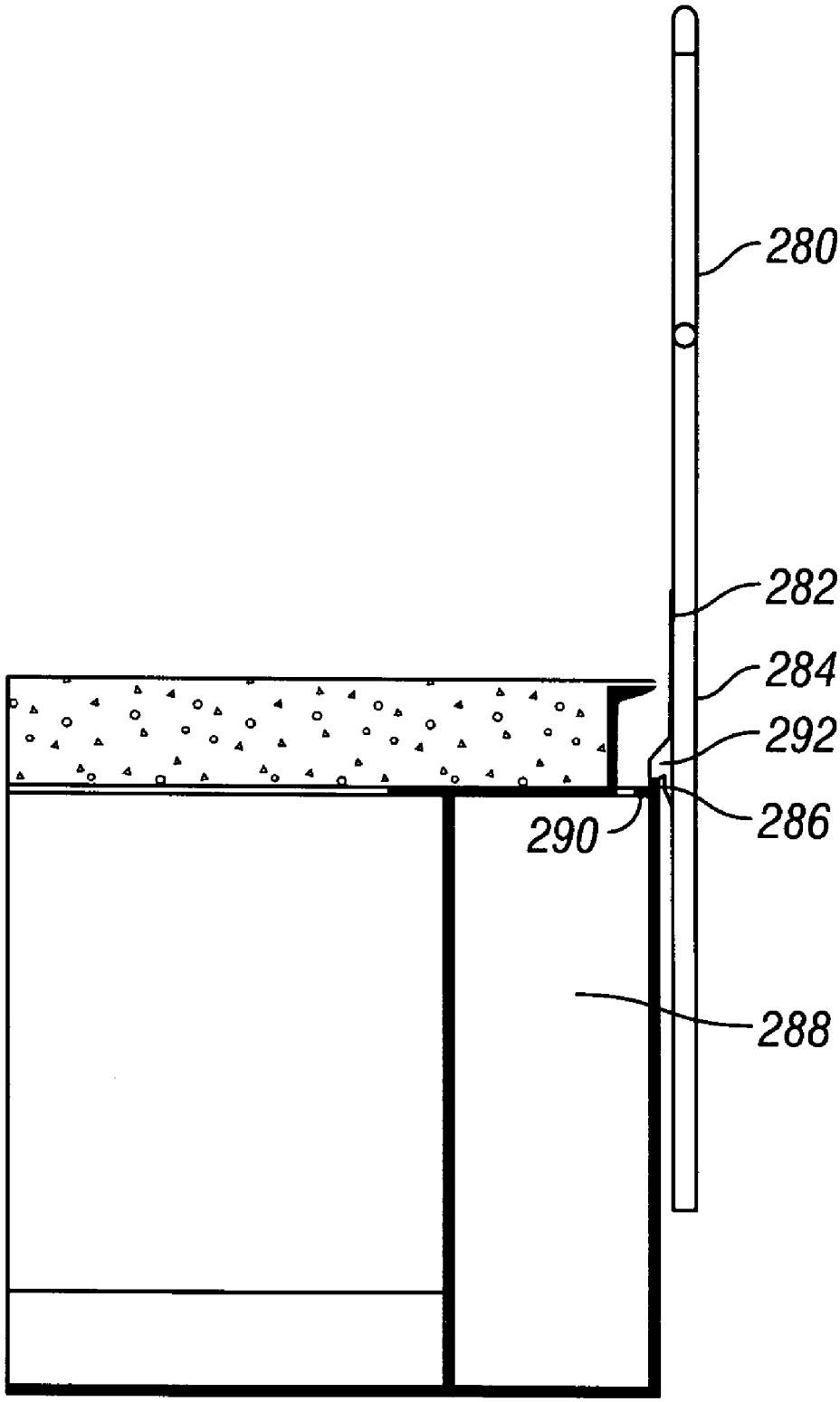
FIG. 25 is a sectional view of a fluid waste retention member disposed on an outer perimeter portion of a modular platform section.

As seen in FIG. 25, a further embodiment is provided wherein an outer perimeter of assembled platform modules is fitted with a safety fence 282 so that liquids that splash off the surface of the drilling platform will not pass over the sides of the platform and down onto the ground surface below. According to some embodiments, safety fence 280 comprises or retention plate 282, which is either welded on or mechanically affixed to a body portion 284 of safety fence 280. In other embodiments, retention plate 282 includes a portion having a double bend 284 that slips into and engages a top portion of platform section 288 at a predetermined location so as to establish the desired fluid retention fence 280. According to still further embodiments, the presence of safety fence 280 causes splashing liquids to be diverted back toward the interior surfaces of the interconnected platform sections, though in one particular embodiment, re-directed fluid flow is allowed to drain into a container portion of a platform section by means of one or more drain holes 290. In other embodiments, cable races are attached to the retention plates or, in further embodiments, to the platform perimeter.

Figure 26A:
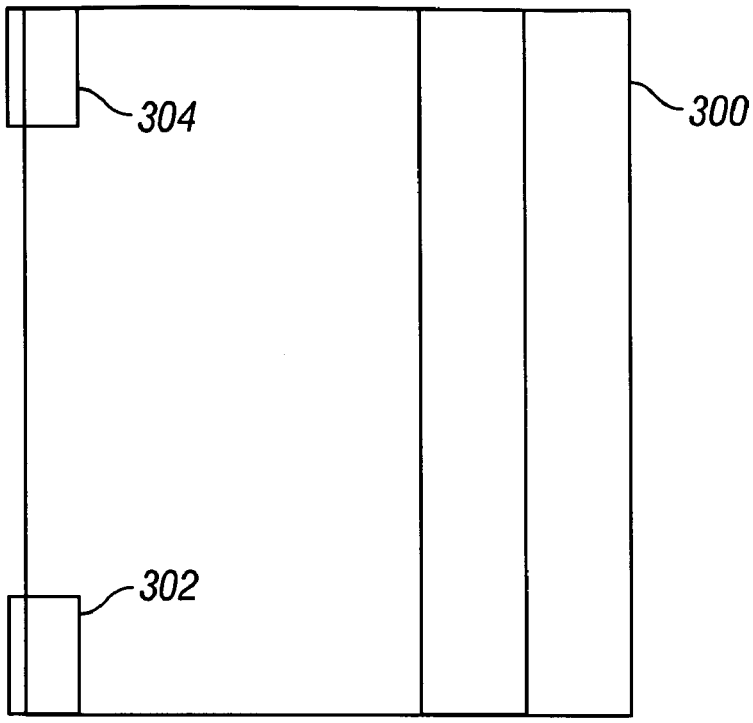
FIGS. 26*a* and 26*b* are plan views of a fence sealing member that has been clipped onto a portion of a fluid retention fence using a clip tab.
Figure 26B:
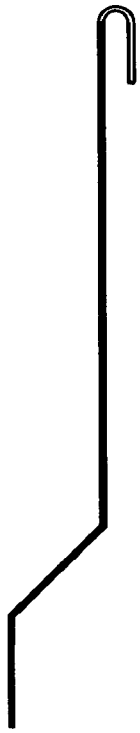

Referring now to the example embodiments of FIGS. 26*a* and 26*b*, it will be understood that individual fluid waste retention fence members are necessarily going to be fabricated in advance at finite, predetermined lengths. According to one particular embodiment, for example, the fluid waste retention fence member measures about twelve and one-half feet long.

According to an example method of practicing the invention, as successive fluid retention safety members are installed next to other pieces of the fence, cracks that form between the kick plates are sealed using one or more fence seals 300. In certain embodiments, fence seal sections 300 are fastened to a waste retention member using known fastening means such as a screw or a nut and bolt assembly. In one particular embodiment, the fence seal 300 is clipped onto those portions of the fence disposed nearest the gaps formed between fence sections using one or more clip tabs 302 and 304. In a further embodiment, fence seal 300 is clipped onto the safety fence by hooking each of clip tabs 302 and 304 over a top lip portion of the kick plate. According to a particular example embodiment, a vertical fence seal portion 300 is fabricated so that it is about the same height as the terminal vertical portion of the kick plate, so that water or other fluids are directed back toward the interconnected platform sections.

Figure 27A:
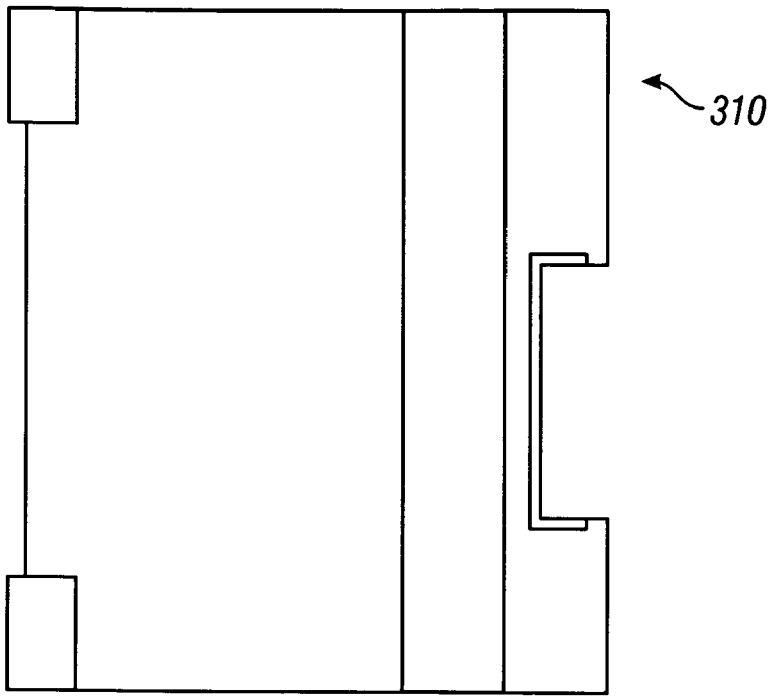
FIGS. 27*a* and 27*b* are plan views of a retaining fence gap sealing member equipped with a seal extension member.
Figure 27B:
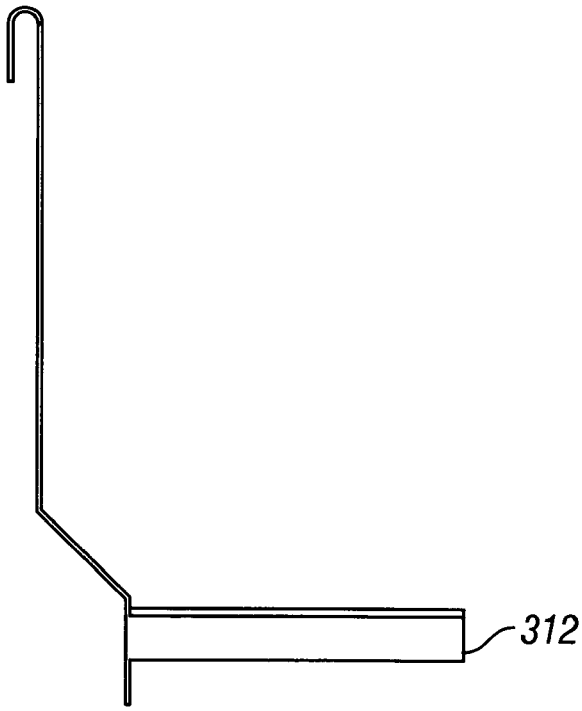

Referring now to the example embodiments of FIGS. 27*a* and 27*b*, a retaining fence gap sealing member 312 is provided, in which the sealing member further comprises an extension member disposed thereon that is similar in both nature and function to the previously discussed four-way seal, so that excess water that seeps along an interior surface of the fence seal will again be redirected to a region contained within the perimeter of the fence. According to a specific example embodiment, platform sections on which the fence members are affixed have a plurality of cut grooves disposed beneath the sealing member that further prevents seeping fluids from migrating down the sides of the platform sections.

Figure 28A:
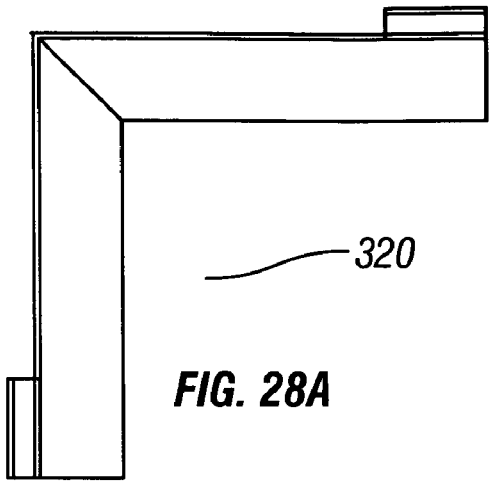
FIGS. 28*a* and 28*b* are plan views of a fence corner seal, in which the corner seal is bridging a gap formed between corner sections of a fluid retention fence.
Figure 28B:
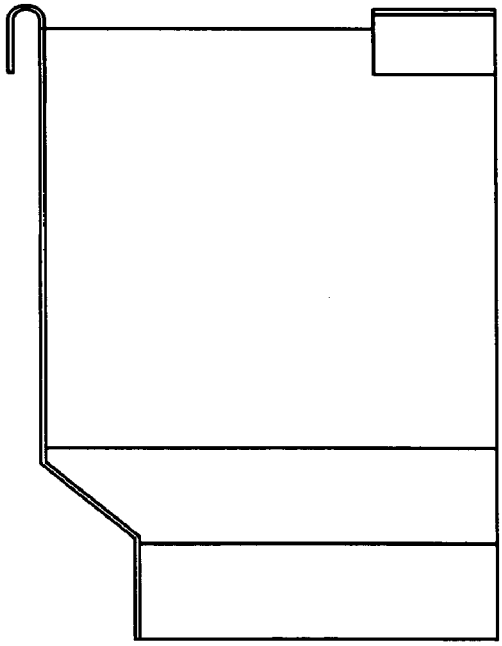

In the further embodiments of FIGS. 28*a* and 28*b*, a fence corner seal 320 is disposed so that the gap that forms between two sections of fence installed at corners of the platform is bridged. In practice, the corner seal functions similar to the other fence seals discussed above, except that the corner seal also engages multiple sections of the fence. In a presently preferred embodiment, each of the fence sections upon which the corner seal is installed is disposed at about a ninety-degree angle relative to the other.

Figure 29:
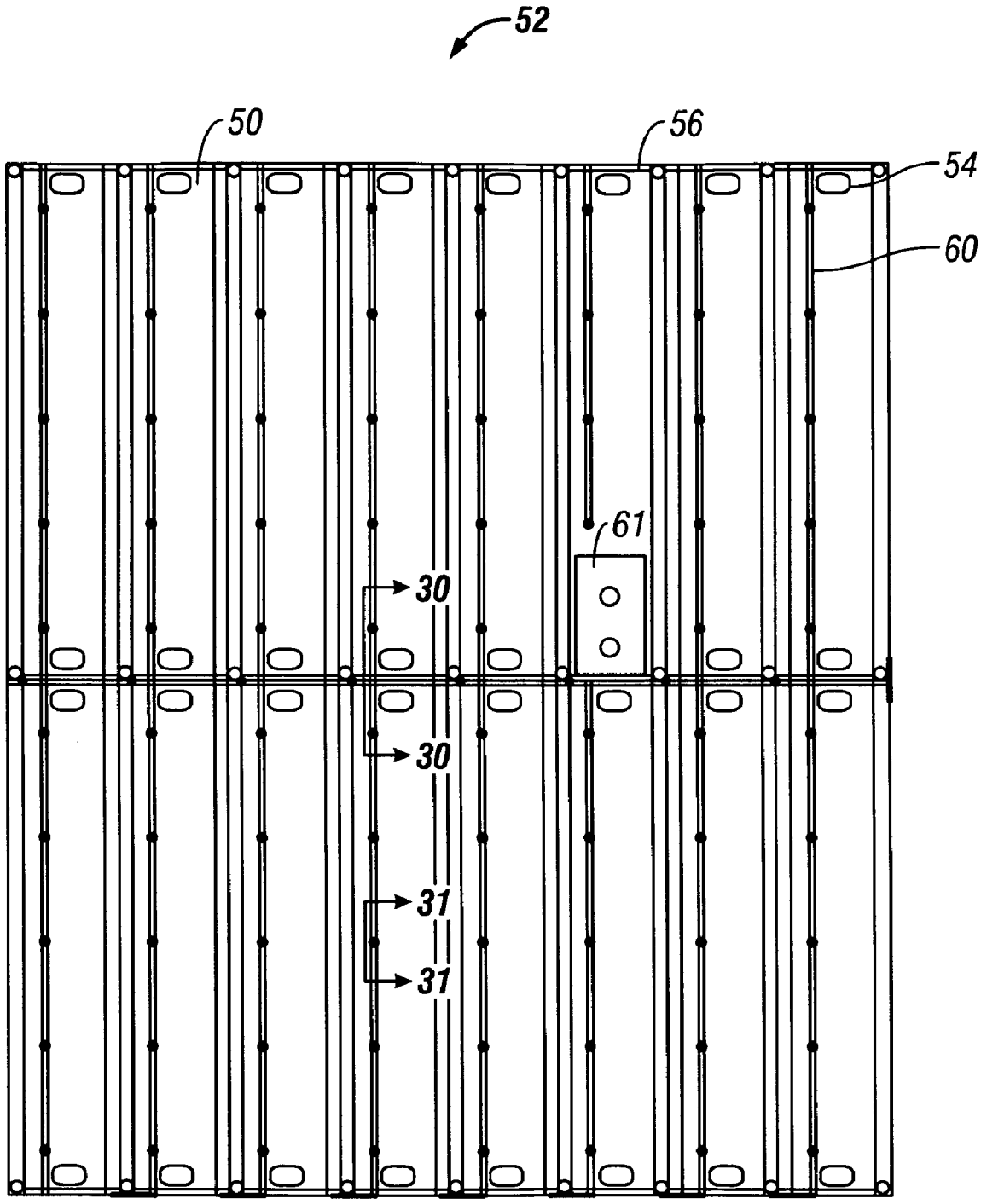
FIG. 29 is a top view of a group of assembled modular deck sections following installation atop a plurality of associated platform sections.

According to the example embodiment of FIG. 29, a number of assembled modular platform sections 50 are depicted following the installation of a plurality of deck sections atop upper portions of the platform sections. According to one embodiment, one or more manholes 54 is disposed at each end of the deck sections, except for platform section 56, which has a shortened deck (and thus a manhole 54 disposed at only one end) due to the location of the platform's wellhead cellar 61.

According to further embodiments, within a body portion of each of the deck sections is a utilities communication pipe 60, which, in certain embodiments, is configured to run along an entire length (or width) of the platform section. According to one embodiment, utility pipe 60 has a predetermined number of regularly spaced junctions, permitting convenient access points for installation and maintenance of utilities related equipment (e.g., fiber optics bundles, electrical wiring, etc.). In other embodiments, utilities communication pipe 60 comprises a plurality of junctions disposed at irregularly spaced locations disposed along a length of the pipe. According to a specific example embodiment, after the disclosed arctic drilling platform has been fully assembled, communication pipes 60 (and the various junctions and utility access points disposed thereupon), serves as the framework for distribution of power and other utilities around the surface of the platform during drilling operations.

According to a further embodiment, each of the deck sections are slightly greater in length than the utilities communication pipes contained within, so that sufficient room remains within the interior of the deck module to install one or more power boxes, water junctions, or utility cross-connections, near the terminal ends of the communication pipes. In various embodiments of the invention, one or more utilities communication pipes 60 are used to accommodate installation of electrical power lines, telephone lines, fiber optic connections, gas hoses, fuel lines, etc.

Figure 30:
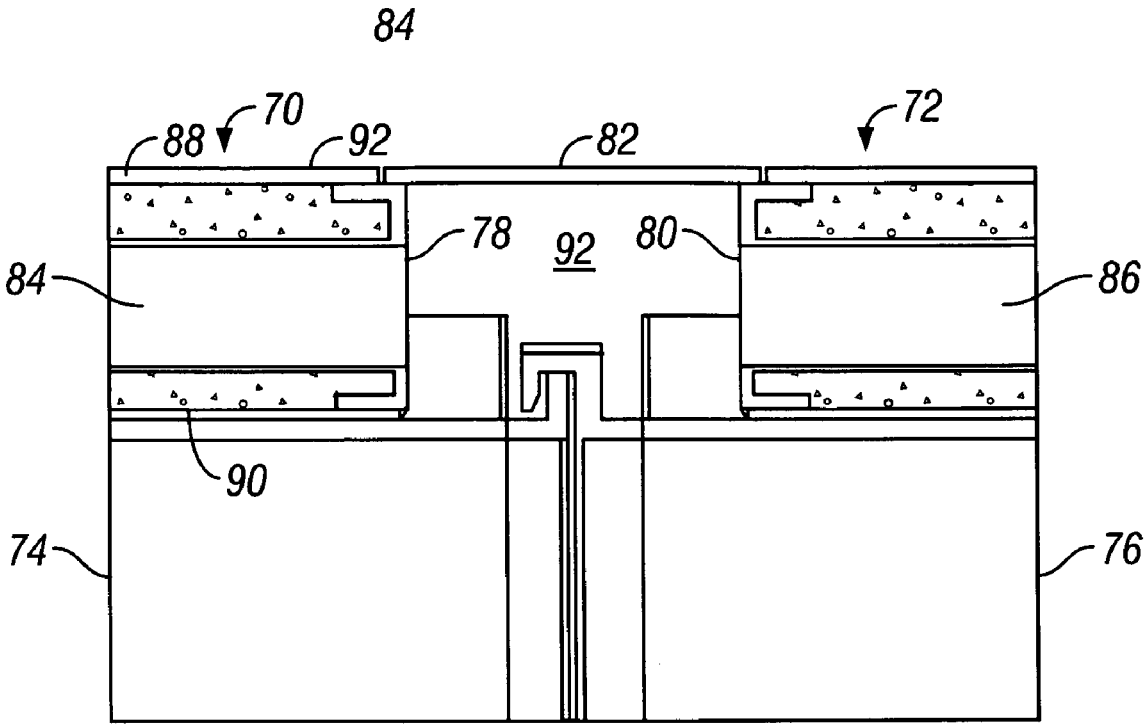
FIG. 30 is a cross-sectional view of the platform shown in FIG. 29.

As seen in the example embodiment of FIG. 30, a crawl space is disposed between the ends of deck sections 70 and 72. As depicted, deck sections 70 and 72 are disposed atop platform sections 74 and 76, though those of ordinary skill in the art will appreciate that the deck sections can also be assembled in combination with other types of platform modules. According to a still further embodiment, deck sections are constructed by stacking one or more layers, wherein each layer further comprises one or more communication pipes.

According to a presently preferred embodiment, there is a space or gap of about 12 inches disposed between innermost portions 78 and 80 of deck sections 70 and 72; the space or gap is disposed above the topmost portions of platform sections 74 and 76, and below a manhole cover 82 laid on a top lip established by the end points of deck sections 70 and 72. In further embodiments, pipes 84 and 86 extend into the deck in order to facilitate utilities communication. Deck section 70 has an upper plate 88 and a lower plate 90, each of which are usually formed from a metal or composite material of some type. For example, according to one embodiment, upper plate 88 and/or lower plate 90 are formed from an aluminum plate, though in other embodiments an aluminum alloy or other combination of materials is preferred. According to still further embodiments, an insulation material is installed in the space or gap established between the utilities communication pipes. For example, in one embodiment, polyurethane foam is placed into the space between the communications pipes to lend compressive resistance to the deck plate disposed above the crawl space.

Figure 31:
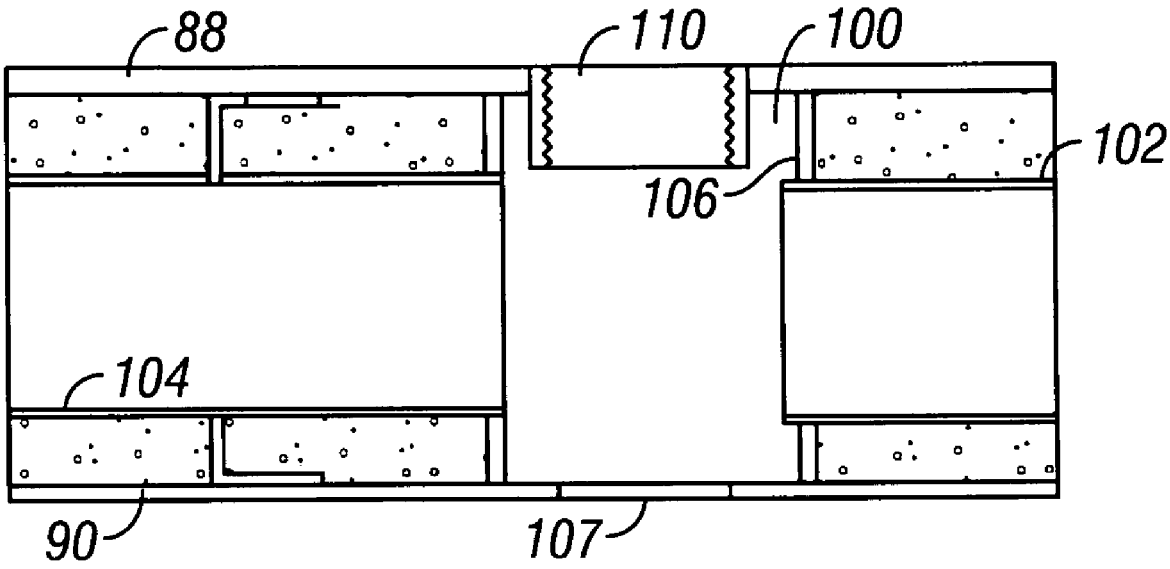
FIG. 31 is a cross-sectional view of the platform shown in FIG. 29.

According to the example embodiment of FIG. 31, a utility junction 100 is disposed in proximity to utilities communication pipes 102 and 104. The horizontal utility pipes intersect a vertical junction pipe 106 that has been cut to reflect the actual height of the space established between upper plate 88 and lower plate 90. A drain hole 106 is opened in the lower plate 90, so that utility lines and the like can be fed into and through the platform sections disposed below. On the top side of the deck section, a vertical pipe having a threaded engagement means 110 is prepared, so that utility lines can also be drawn out of the engagement means 110 and up into other modules affixed on top of the deck. According to a further embodiment, a plug is threaded into the threaded engagement means 110 when the portal is not in use, thereby providing a smooth deck surface that is substantially uninterrupted by open manholes.

Figure 32:
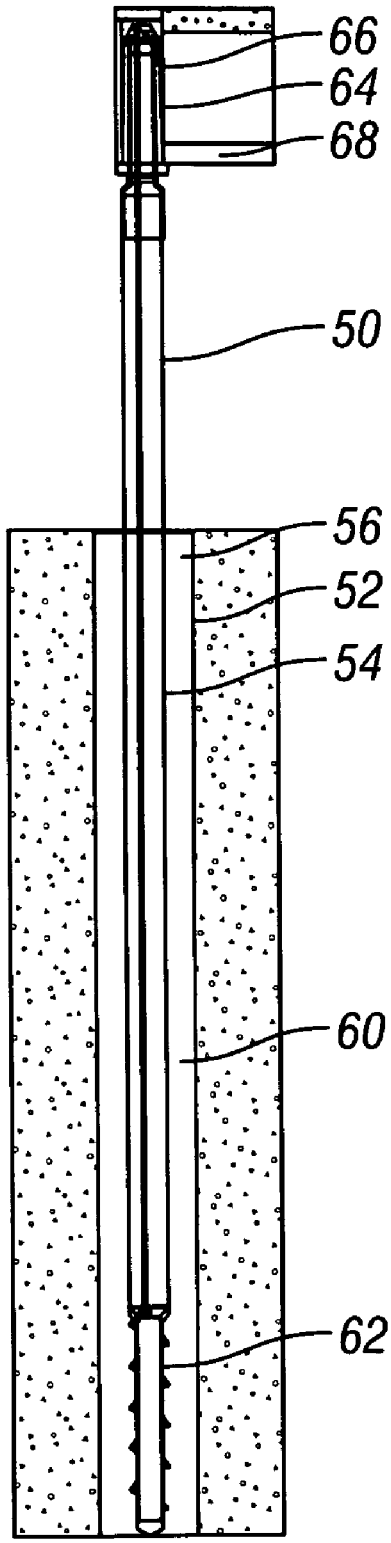
FIG. 32 is a cross-sectional view of a support post disposed in a post hole.

FIG. 32 is a detailed view of a support post 50 according to the invention. In some embodiments, support post 50 is inserted into a post hole 52 that has been drilled into a ground surface. In other embodiments, support post 50 has an interior space 54 established for receiving a slurry 56 of water, sand and gravel. In still other embodiments, an external surface of the support post is smooth or flat. When the platform is assembled in a very cold environment, for example, a frozen tundra, slurry 56 will also freeze and lend additional stability and rigidity to support post 50. According to further embodiments, a lower portion 60 of support post 50 has a spiral support fin 62, and an upper post end 64 is configured to fit into a receiving socket 66 disposed in the bottom of platform section 68.

Figure 33:
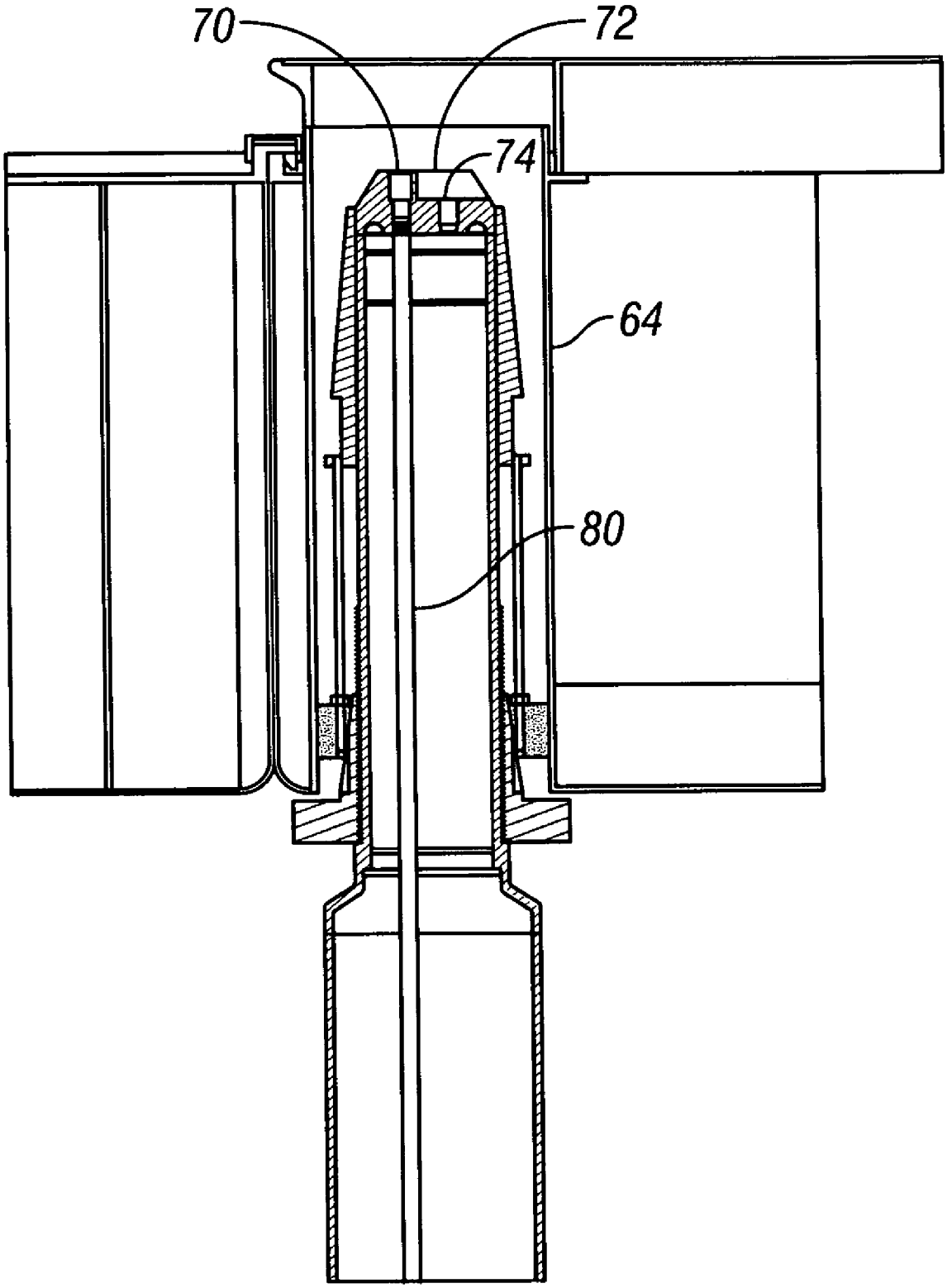
FIG. 33 is a cross-sectional view of an upper end of the support post shown in FIG. 32.

FIG. 33 is a detailed view of an upper end 64 of the support post 50 shown in FIG. 32, further comprising a process fitting 70 that allows fluids to be pumped down into a conduit or pipe 80 disposed in a body portion of the support post 50. According to one example embodiment, fluids pumped into pipe 80 travel to the bottom of support post 50, and a return flow is established by directing accumulated fluid pressure toward a process fitting disposed in flanged member 72. In other embodiments, support post 50 further comprises a plurality of threaded ports 74, so that support post 50 can be installed using an attached padeye or other fitting device (not shown).

Figure 34:
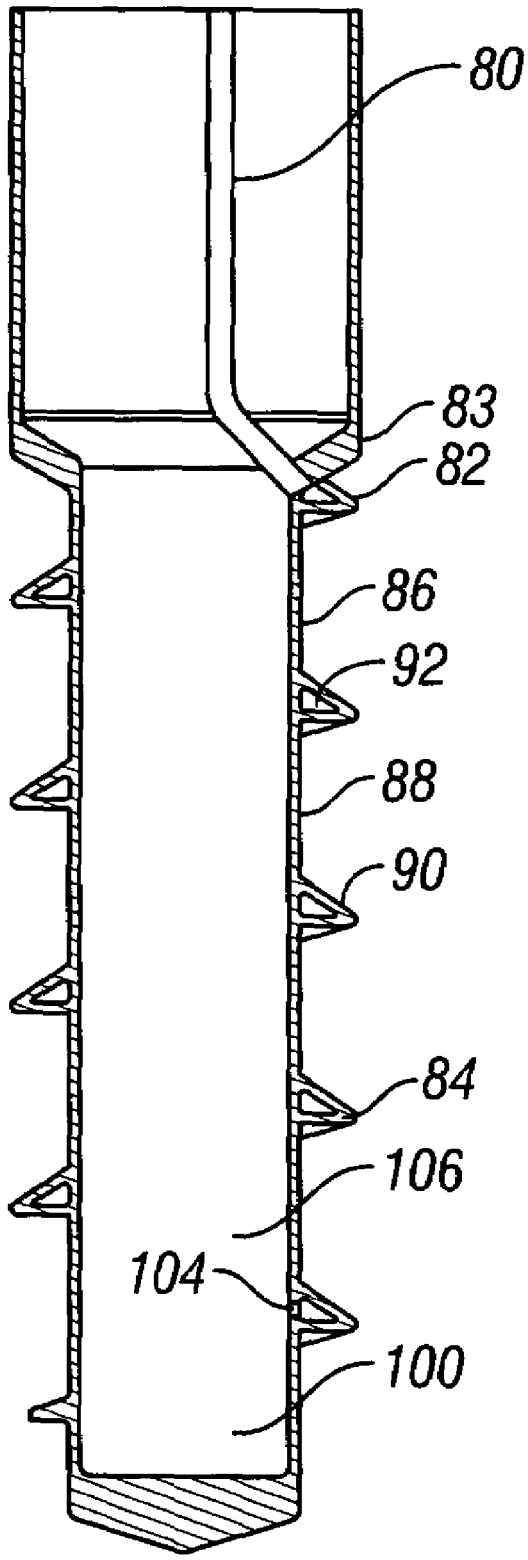
FIG. 34 is a detailed view of a lower end of the support post shown in FIG. 32.

According to the example embodiment of FIG. 34, a terminus portion of fluid transport pipe 80 extends downwardly from a body portion of support post 50, and then exits through a reducer port 83 and spiral fin member 82. According to a specific embodiment, spiral fin 82 is fabricated from two metal plates, viz., a lower, rolling spiral plate 84 that extends substantially perpendicularly from an outer diameter 86 of lower pipe section 88, and an upper, conical spiral plate 90 that extends downwardly at an angle of about thirty to forty five degrees. Rolling spiral plate 84 and conical spiral plate 90 are joined together by, for example, a known welding or sintering process, so as to establish a hollow fluid transport space 92 disposed within spiral fin 82. In other embodiments, the exterior surface of the support post is substantially smooth and the fluid transport space is located within an interior region of the support post.

According to one example embodiment, a fluid solution is pumped downward through pipe 80 and into spiral fin 82. The fluid circulates around the spiral fin 82 down to the bottom of the post 100, and then vents into an internal bore 106 of support post 50 through transport hole 104. The fluid solution then circulates back up the body of internal bore 106. In this configuration, a liquid or gaseous medium can be pumped down the pipe 80 and around spiral fin 82, and then back up the internal bore 106 of support post 50 to either cool or heat the ground surface area surrounding support post 50. According to other embodiments, a very cold fluid or gas is pumped through pipe 80 into the body of the post, so as to ensure that the surrounding ground surface will remain firmly frozen. According to a further embodiment, however, a warm fluid or gas is instead pumped through pipe 80 in order to melt the ground surface around the support post, so that the support post can then be removed from its moorings and more easily retrieved when drilling operations are complete. According to a still further embodiment, the fluid transportation means is vented to a surrounding ground surface using jetting ports or the like in order to make removal of the support posts easier.

According to one particular embodiment, a fluid such as a food-grade glycol, which has a freezing temperature well below the lowest anticipated temperature of the surrounding tundra, is employed to facilitate the aforementioned freezing steps. In case of an accidental spill, food-grade glycol is also biodegradable, and thus will have only a limited impact on the surrounding ground surface. Those of ordinary skill in the art, however, will appreciate that many other fluid solutions, for example, chilled air, heated air or hot steam, can be pumped through the support post 50 in order to carry out the aforementioned freezing and heating.

On heavily weighted platforms, individual support posts often bear a heavy load. Since in some embodiments the support posts are frozen into the surrounding ground surface using a slurry, there can be a tendency for the underlying ice to either shift or compact, thereby causing one or more of the posts to sink more deeply into the ground and destabilize the rest of the platform. In most cases, the sinking of a post is in proportion to the load it bears, and will vary from post to post. While it is anticipated that the incremental sinking of any individual post will usually have a negligible impact on the stability of the platform, those of ordinary skill in the art will appreciate that a mechanical adjustment will sometimes be required to bolster the structural support capacity of some sinking posts. According to the invention, there are at least two different effective methods of improving the support capacity of sinking posts.

Figure 35:
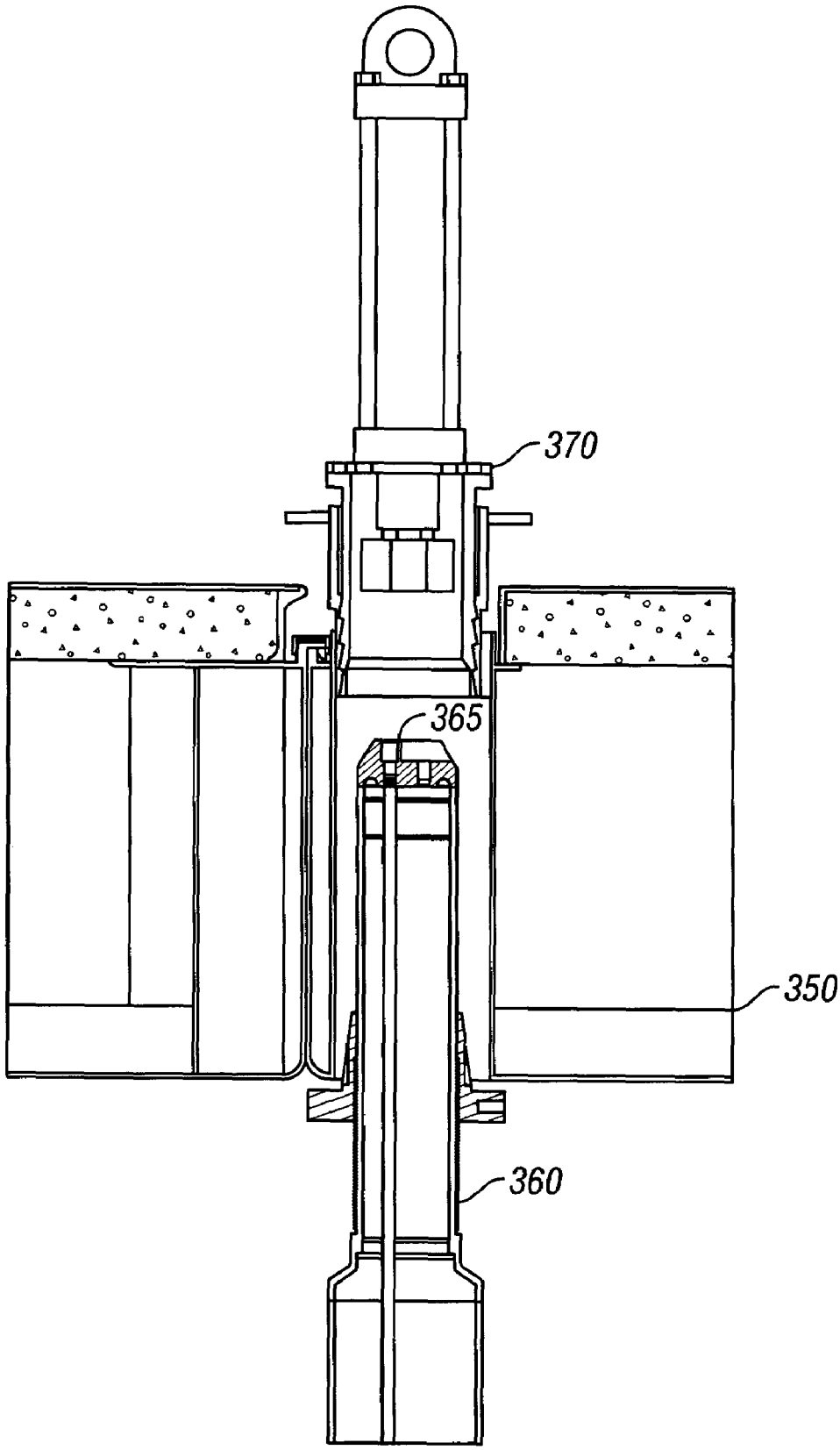
FIG. 35 is a platform and deck assembly supported by a support leg, wherein a jacking assembly is disposed above a lift socket located on a topmost portion of the support leg.
Figure 36:
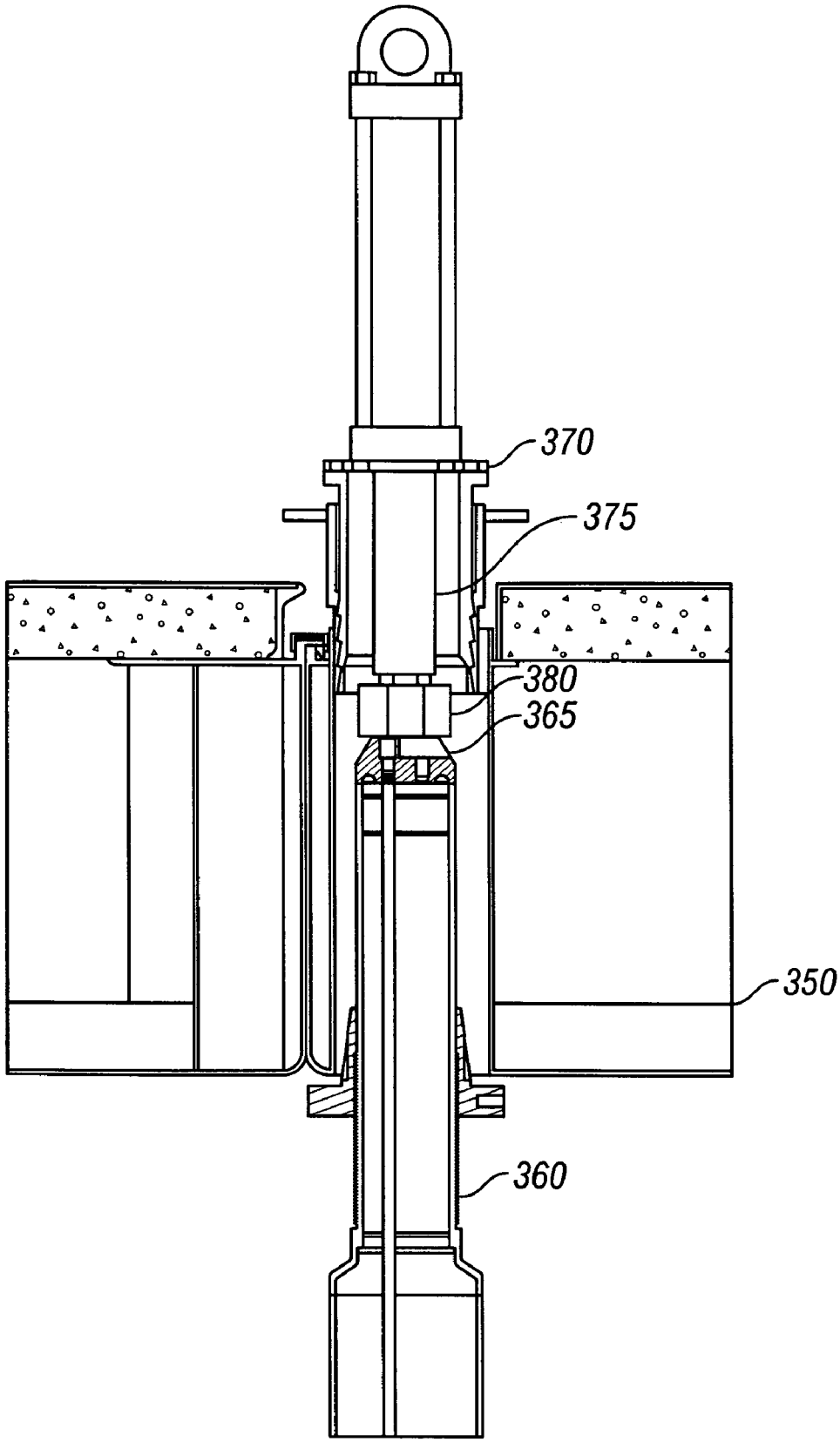
FIG. 36 is the platform and deck assembly shown in FIG. 35, wherein a hydraulic cylinder is extended down from the jacking assembly until contact with the support post is established.

According to the embodiment shown in FIG. 35, for example, a platform and deck assembly 350 is supported by a support post 360, wherein a jacking assembly 370 is disposed above a lift socket 365 located on a topmost portion of the support post 360. As seen in the embodiment of FIG. 36, a hydraulic cylinder 375 is then extended down from the jacking assembly 370 until contact with the support post lifting socket 365 is established. According to some embodiments, the engagement means provided to ensure a reliable mechanical interface between cylinder head portion 380 and lifting socket 365 is a slip-toothed sprocket assembly. In other embodiments, the engagement means comprises a known fastener assembly, for example, a nut and bolt assembly. Those of ordinary skill in the art, however, will recognize that virtually any type of engagement means could be used to hold the cylinder head 380 in place against the support post receiving socket 365, so long as the engagement means is sufficient to reliably facilitate the secure attachment of cylinder head 380 to the top of the support post.

In further embodiments, hydraulic cylinder 375 is shaped like a piston, and exerts a downward force against the head of the support post so as to engage the two members via the fastening means. According to still further embodiments, however, the hydraulic cylinder member 375 is a telescoping cylinder, so that successive, concentric portions of the cylinder are revealed as the cylinder is extended to engage with the support post lifting socket 365, and the platform and deck assembly 350 are then lifted.

Figure 37:
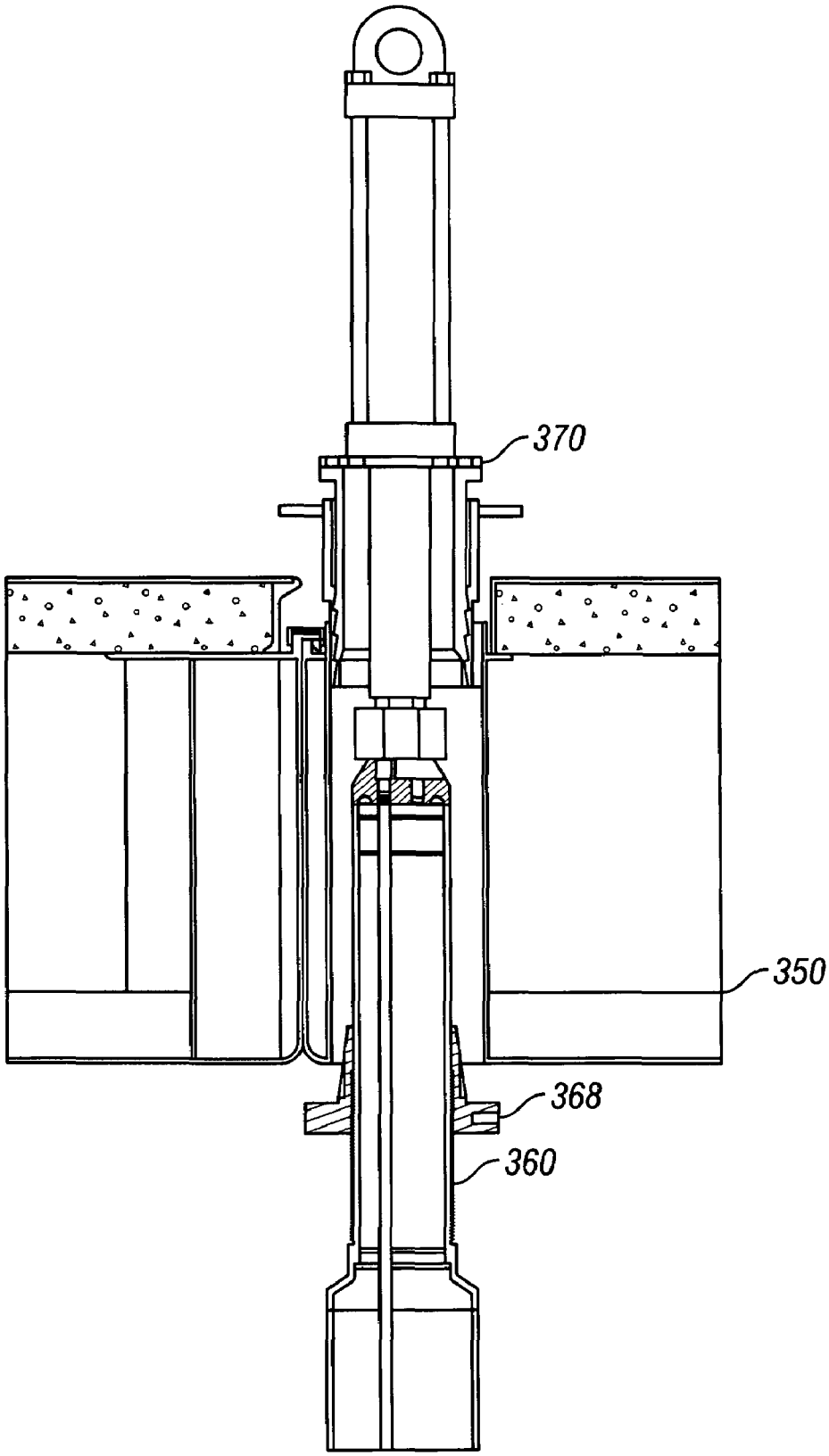
FIG. 37 is the platform and deck assembly shown in FIG. 35, wherein a jacking assembly has lifted the platform and deck assembly off an adjustable nut disposed on the support post.
Figure 38:
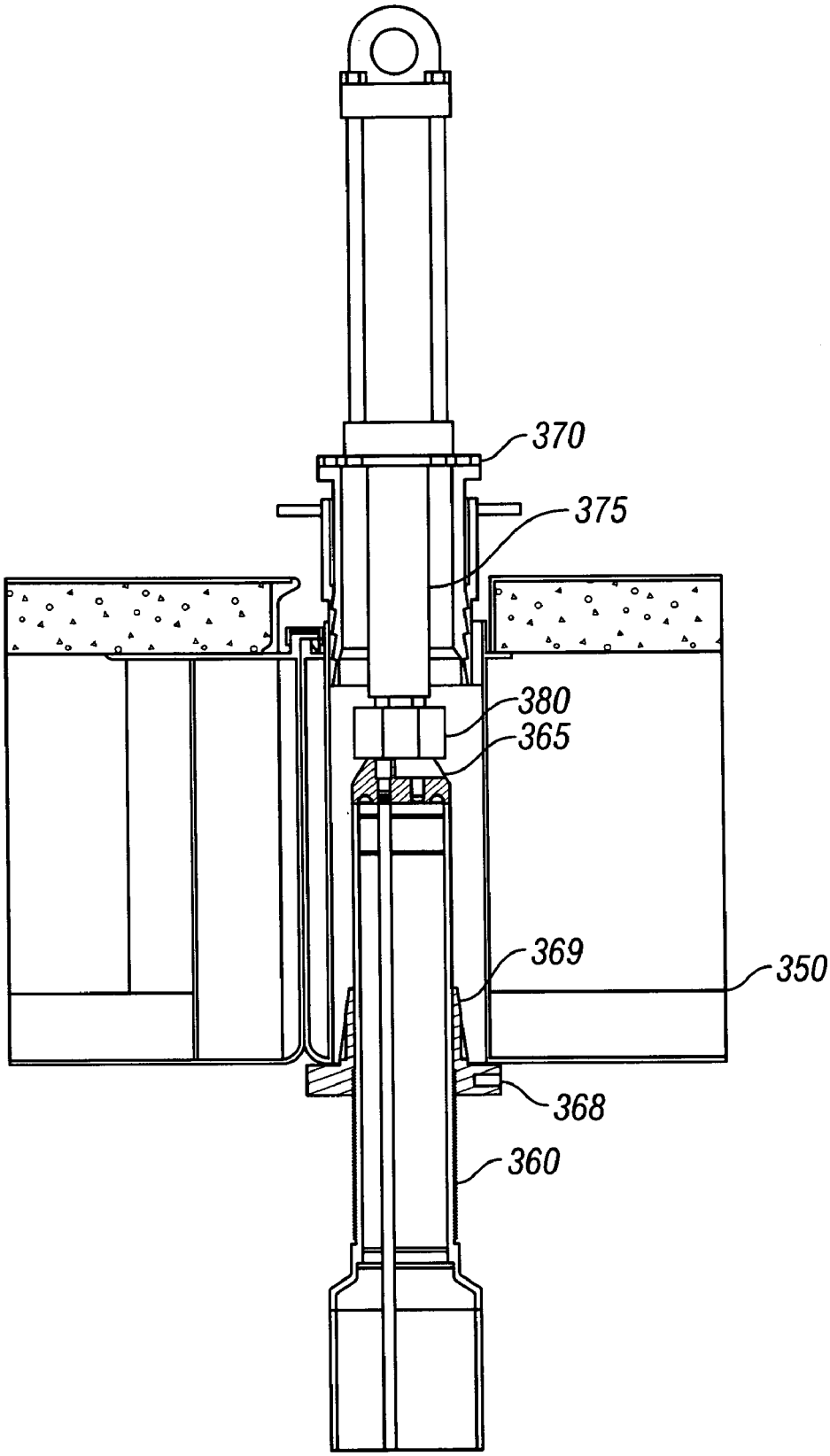
FIG. 38 is the platform and deck assembly of FIG. 35, wherein the adjustable nut has been raised to again support the weight of the lifted platform and deck assembly.
Figure 39:
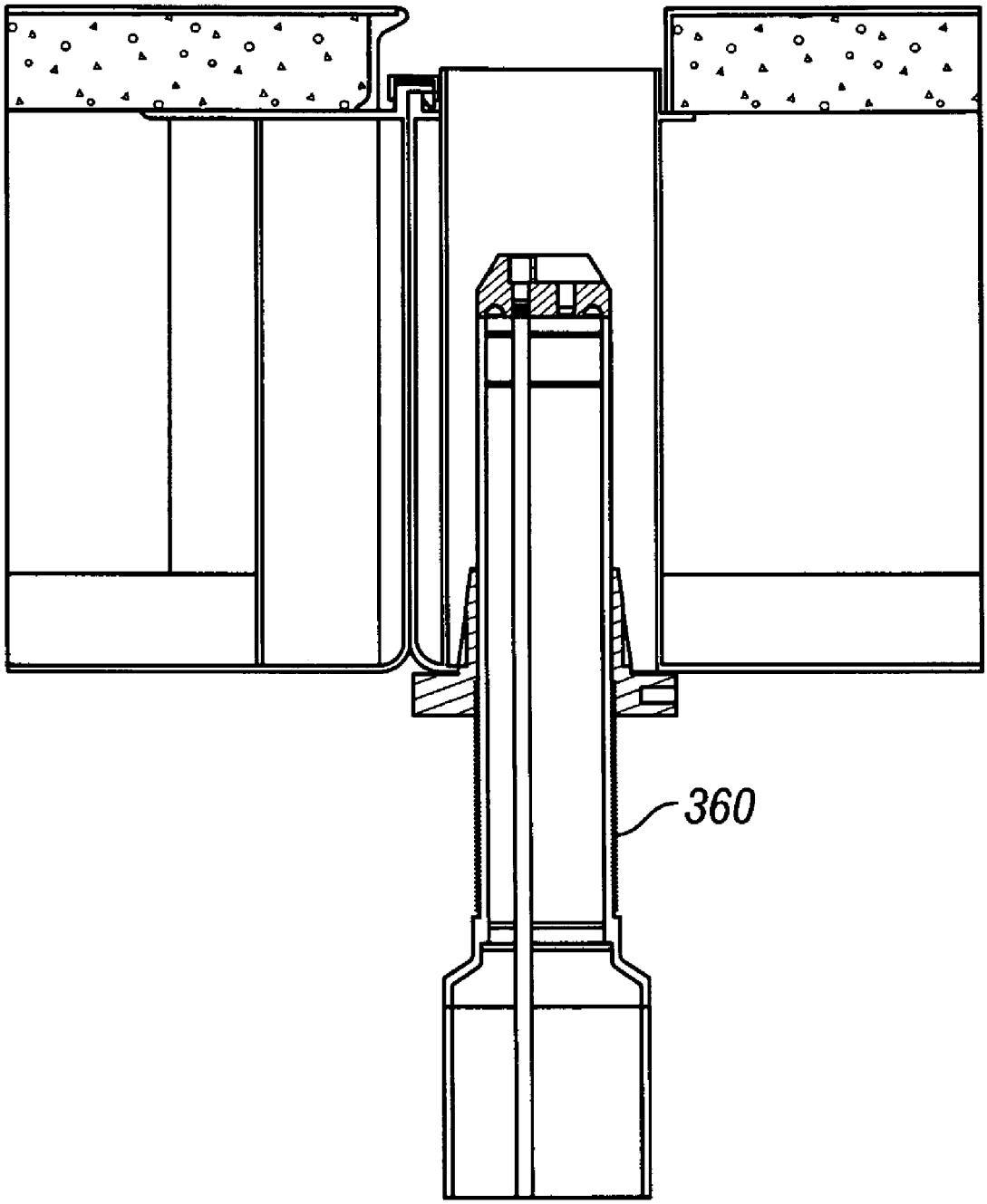
FIG. 39 is the platform and deck assembly of FIG. 35, shown after the jacking assembly has been removed and adjustment of the platform height has been completed.

As seen in the example embodiment of FIG. 37, once the platform and deck assembly 350 have been lifted off of the shoulder of adjustable nut 368 by means of attached jacking assembly 370, adjustable nut 368 is relieved of its weight load and can then be height-adjusted without further disturbing the level or stability of the surrounding platform. As seen in the example embodiment shown in FIG. 38, after adjustable nut is 368 has been re-adjusted to a desired setting, platform and deck assembly 350 is set back down onto a flanged receiving portion 369 of adjustable nut 368 by means of hydraulic cylinder 375, and cylinder head 380 is unfastened or otherwise withdrawn from support post lifting socket 365. As shown in the example embodiment of FIG. 39, after the desired platform height adjustment is completed, jacking assembly 370 can then be removed from the vicinity of support post 360 and used elsewhere on the platform if desired.

Figure 40:
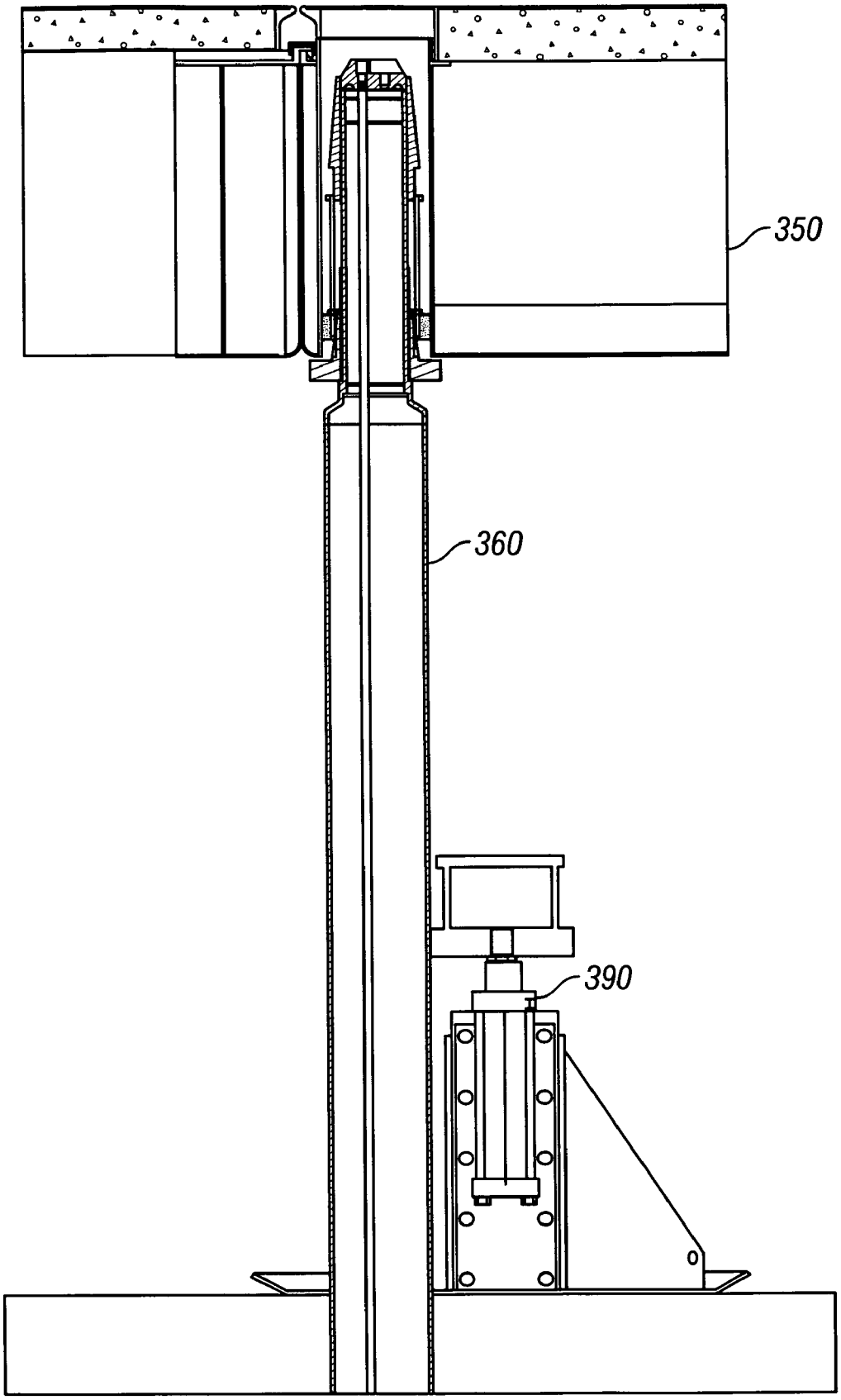
FIG. 40 is a jacking assembly installed beneath a platform and deck assembly so that the platform can be lifted from the bottom.

As shown in the example embodiment of FIG. 40, platform and deck assembly 350 need not necessarily be lifted from above in order to relieve the weight load disposed on the support post 360. For example, jacking assembly 390 can also be installed underneath the platform and deck assembly 350, and then used to lift the platform off of the support post 360 by pushing a top surface of the cylinder against a bottom surface of the platform and deck assembly 350 and then driving the cylinder upward using the cylinder's hydraulic system.

In instances where the hydraulic cylinder is piston shaped, the stroke distance of the hydraulic cylinder effectively determines the extent of support post height adjustment that can be effected. However, in other embodiments, one or more cylinder retaining pins can also be disposed in-between the jacking assembly's telescopic cylinder members in order to provide a standardized range of support post height adjustments. According to a particular embodiment, for example, a plurality of retaining pins is inserted through regularly spaced receiving holes formed in body portions of the inner, middle and outer telescopic cylinder members. As the cylinder progresses through a stroke cycle and retaining pins are inserted into the receiving holes, a basic height for the jack assembly is established at one of several predetermined elevations.

According to a detailed example embodiment, a bottom jack assembly is positioned adjacent to a side portion of a platform in such a fashion that the jack's hydraulic cylinder traverses a first portion of its stroke distance. A chain or other lifting means is then wrapped around the raised cylinder head, and the pins are removed from the cylinder's telescopic body sections. When the cylinder is retracted, the telescopic sections are pulled back in and the pins are reinserted. The cylinder is again extended, and slack in the restraining chain is withdrawn, so that the height of the cylinder head is raised; at that point, the cylinder head is held in place by only the shortened restraining chain. The pins are then pulled out of the receiving holes again, and the cylinder is retracted. As before, the telescopic cylinder members are raised to a higher position and then re-pinned, this process being repeated until the cylinder head has been raised to its desired height using only the hydraulic lift strength of the jack assembly. After the height of hydraulic cylinder head is basically adjusted, the jack assembly is slid into place under a desired portion of the platform, and the cylinder head is again extended to permit final adjustment of the height of the support posts.

According to the further embodiment of FIG. 41, an installed support post 54 comprises a tube-like member 50 disposed through a body portion of a platform section 52, wherein the support post 54 is inserted from below into a cylindrical interior space formed in post tube 50. An adjustable nut 56 is disposed on a body portion of support post 54 so as to engage a bottom surface 58 of platform section 52. According to some embodiments, engagement between adjustable nut 56 and platform bottom surface 58 further comprises an insulating member 60. When the insulating member 60 is formed from a poorly conductive material such as, for example, Delrin or UHMW polyethelene, the insulating member serves to establish an electrical ground between the steel adjusting nut 56 and the aluminum platform section 52.

According to other aspects of the invention, a tapered receiving member 62 disposed on an upper portion of adjustable nut 56 resides within tube member 50 after the support post is installed. A first chocking assembly 70 is then lowered down into the space formed between the tube member 50 and support post 54 so as to engage both the tapered receiving member 62 and an inner wall surface 78 of tube member 50. In the particular embodiment depicted in FIG. 41, a lower wedge member 72 is disposed to engage the adjustable nut 56 at a lower location, and to support an additional tapered receiving section 74 disposed on a topmost portion of chocking assembly 70. Likewise, an upper wedge 76 is disposed to engage the topmost portion of tapered receiving section 74 and inner wall surface 78 of tube member 50.

Figure 41:
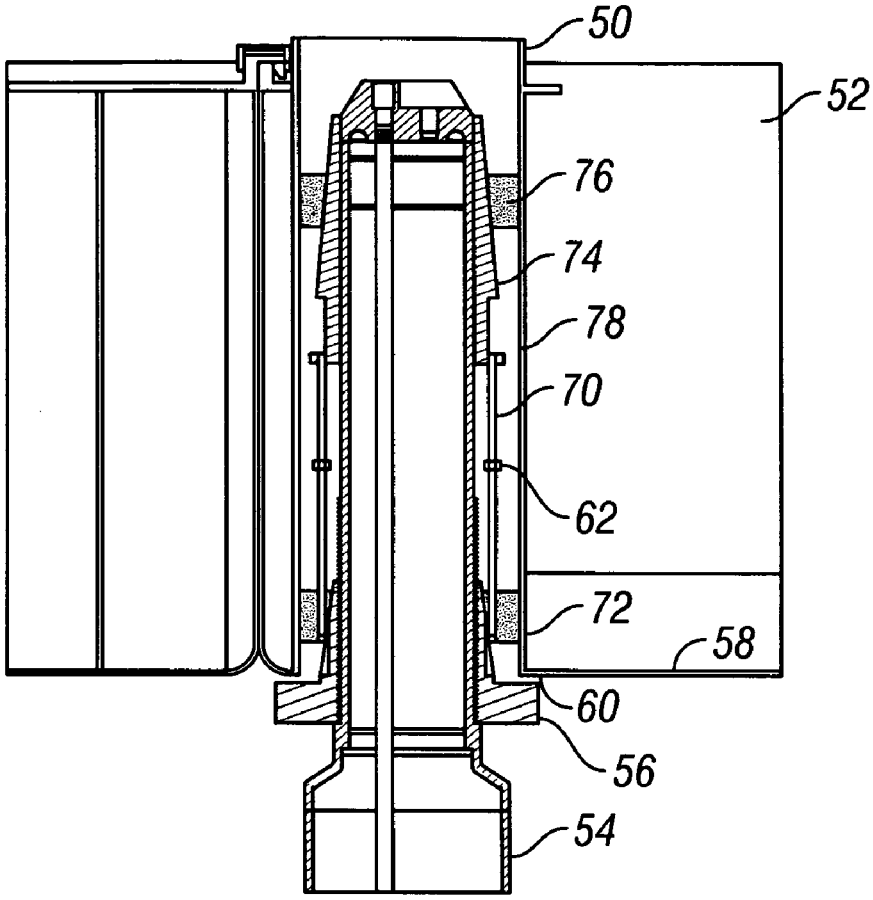
FIG. 41 is a cross-sectional view of a support post, wherein a wedge section is disposed on a tapered shoulder portion of an adjustable nut.
Figure 42:
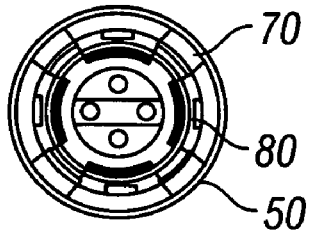
FIG. 42 is a top view of the support post head shown in FIG. 41.

FIG. 42 is a top view of the support post head shown in FIG. 41. According to one example embodiment, several chocking assemblies 70 are disposed around a perimeter region of support post head 80 in order to hold the support post 54 securely in place and lend additional stability and structural rigidity to the system after installation is complete.

Figure 43:
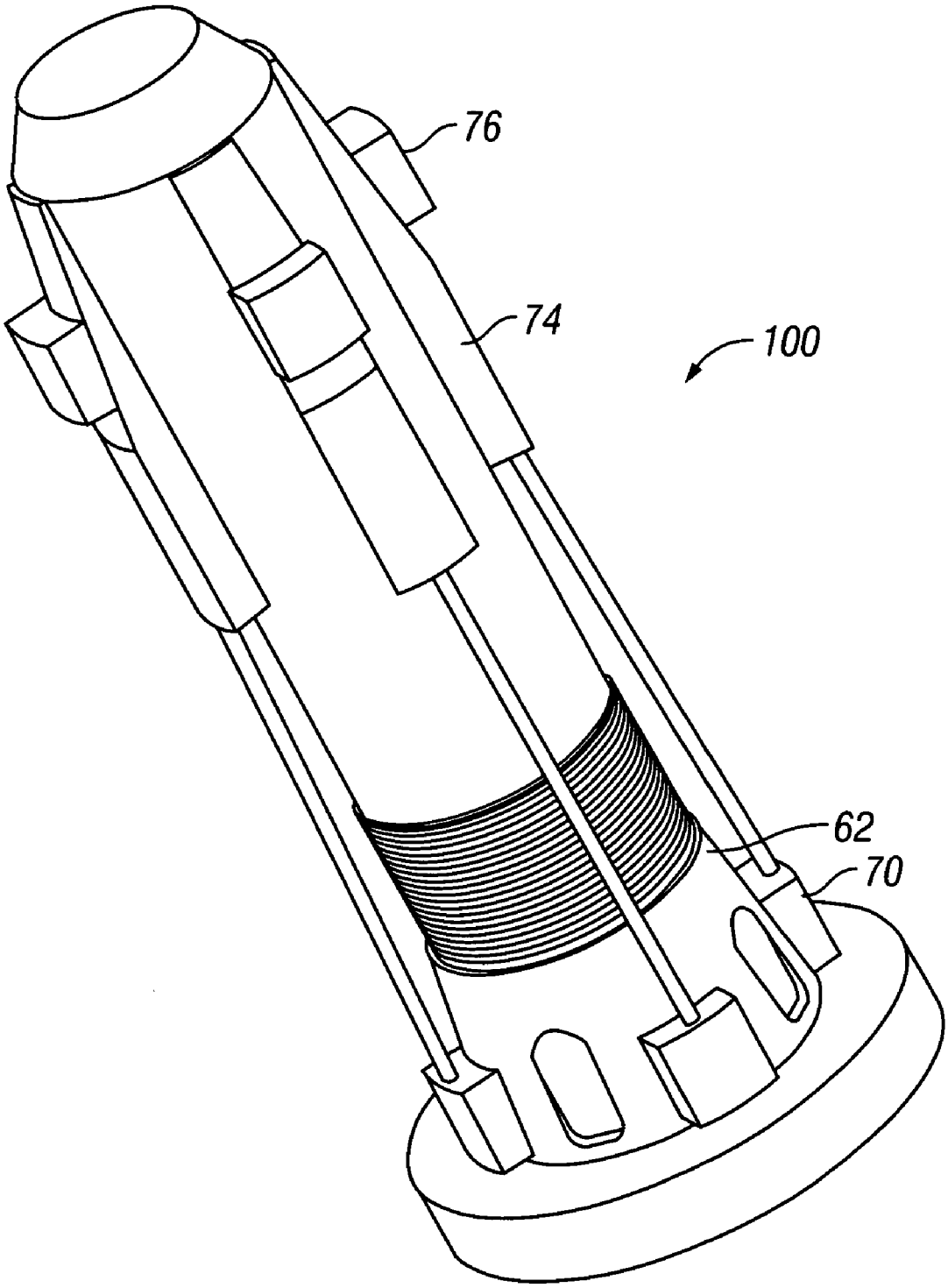
FIG. 43 is a partial rotational view of the support post head shown in FIG. 41.

For example, disposition of multiple chocking members 70 and 74 provides a fixed side distance between the support post and an interior surface of the platform section tube member, so that side loads (e.g., forces being delivered to the sides of the platform, such as strong winds) will be uniformly absorbed across an entire cross-section of the support post portion installed within the tube member. Since both top and bottom portions of the support post are engaged with interior surfaces of the tube member, the support post and tube member assembly is substantially fixed, and lends additional structural rigidity to the platform system. If, on the other hand, the support post is fixed at only the bottom of the tube member, a pivot-like connection between the support post and platform section results, and a high inertial moment established near the ground surface reduces stability of the assembled platform system. FIG. 43 is a perspective view of the support post head shown in FIG. 41, wherein several of the design features described above with respect to FIG. 42 are emphasized.

Figure 44:
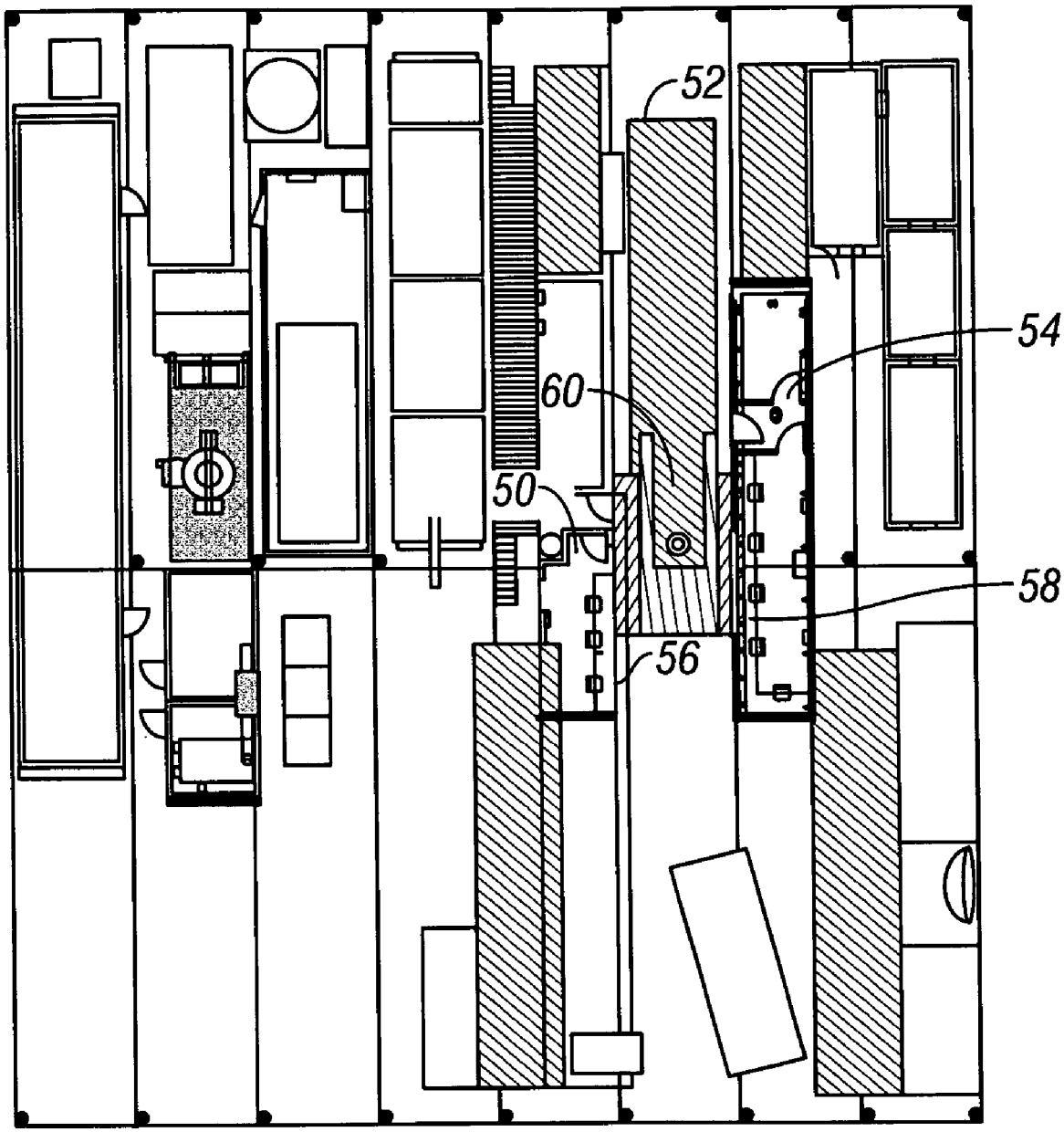
FIG. 44 is a platform floor plan according to an example embodiment of the invention.

Turning now to other aspects of the invention, FIG. 44 is a proposed platform floor plan in which the general arrangements of storage buildings and other necessary structures are depicted. Care must be given to the layout and grouping of platform structures so that related equipment is strategically stored, safe and comfortable housing is available for platform personnel, and to ensure that the rig is in compliance with strict fire and safety codes.

For example, according to specifications promulgated by the American Petroleum Institute (e.g., the API 500 specifications), a five-foot radius around the bell of any drilling rig is considered a Division One explosion environment, and all electrical equipment used in the area must be configured to accommodate the requirements associated with a Class One Division One area. Most enclosed structures that have a door opening out to a Division One environment are considered Class One Division Two explosive environments, environments that, under the API regulations, are regulated nearly as restrictively as Class One Division One areas. In practice, virtually all electrical equipment used on the rig, including computers and telephones, must be reviewed for electrical explosion potential in order to comply with the mentioned industry regulations.

In the example embodiment of FIG. 44, a driller's doghouse 50 is disposed on one side of the drilling rig 52, and a company man house 54 is disposed on an opposite side of the rig 52. Both the driller's doghouse and the company man house have a picture window 56 and 58, so that personnel can look onto the drilling floor 60.

It would also be desirable for both the driller's doghouse and the company man house to have a doorway that permits personnel stationed in these offices to walk out onto the rig floor to perform work or conduct discussions regarding rig activities; however, the presence of a doorway between the rig floor and either the driller's doghouse or the company man house would cause these areas to be classified as Division Two areas, and since both the drillers and the company men often have need for telephones and portable computers and the like, most of which are not explosion-proofed, it has in the past been the case that convenient doors between the rig floor and the personnel stations are not present.

Figure 45:
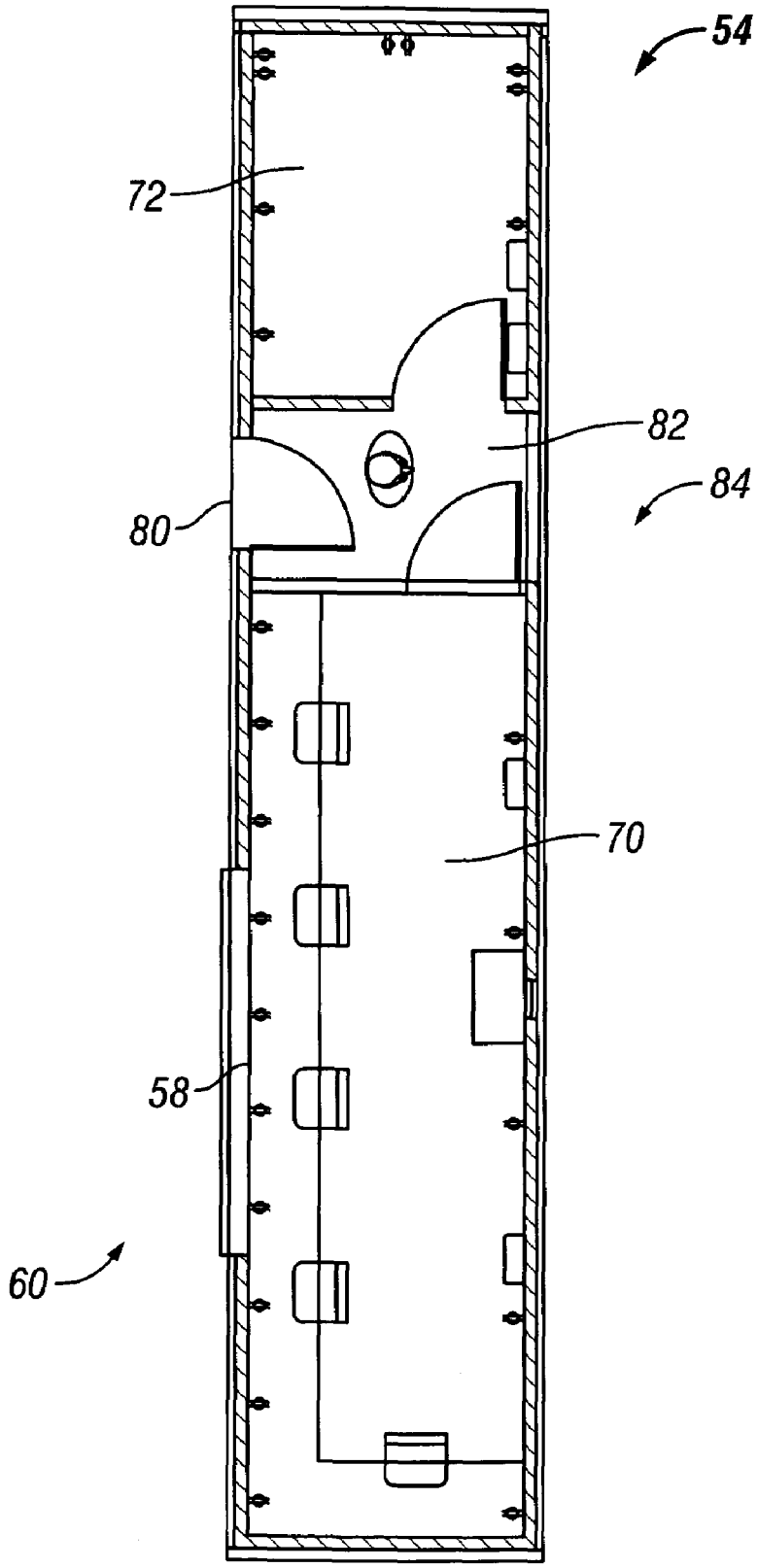
FIG. 45 is a platform building isolated from the example floor plan of FIG. 44.

As seen in the example embodiment of FIG. 45, in which a building structure from the floor plan of FIG. 44 is isolated in greater detail, rig floor access difficulties are overcome by constructing a company man house 54 that is actually a combination of a company man room 70 and a computer and communications room 72. In a substantially central portion of the company man house 54, a door 80 opens into a small hallway 82, rather than directly into the company man room 70. According to one embodiment, the small hallway 82 passes straight through the company man house 54 and is fully opened to the environment on a side 84 opposite the door 80. Since door 80 opens into a hallway 82 that is open to the environment, hallway 82 becomes a non-classified area, and company men can use the telephones and computers provided in computer room 72 without conflicting with the industry regulations.

Figure 46:
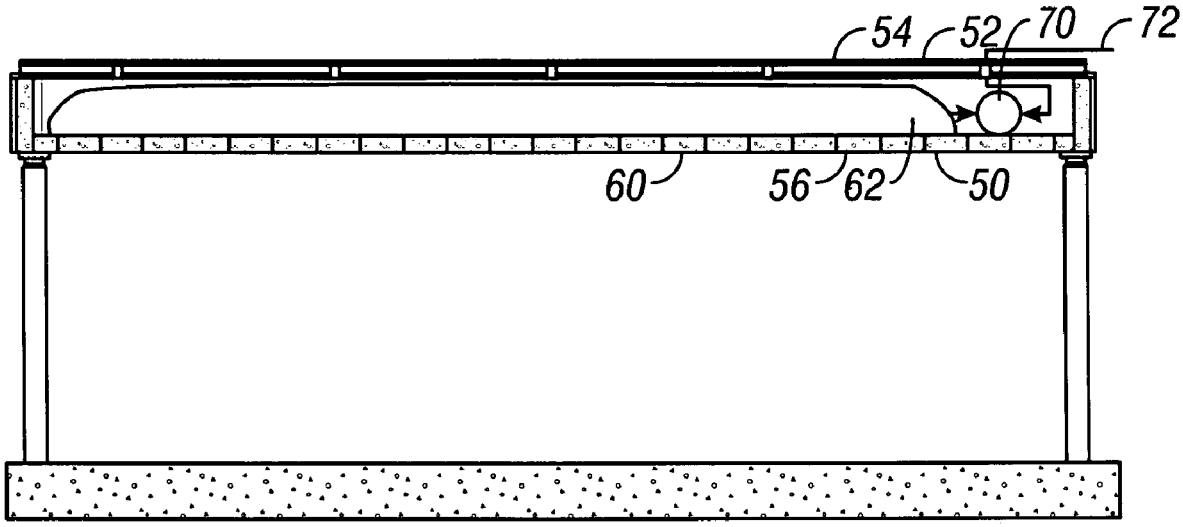
FIG. 46 is a platform section having a bladder tank disposed within.
Figure 47:
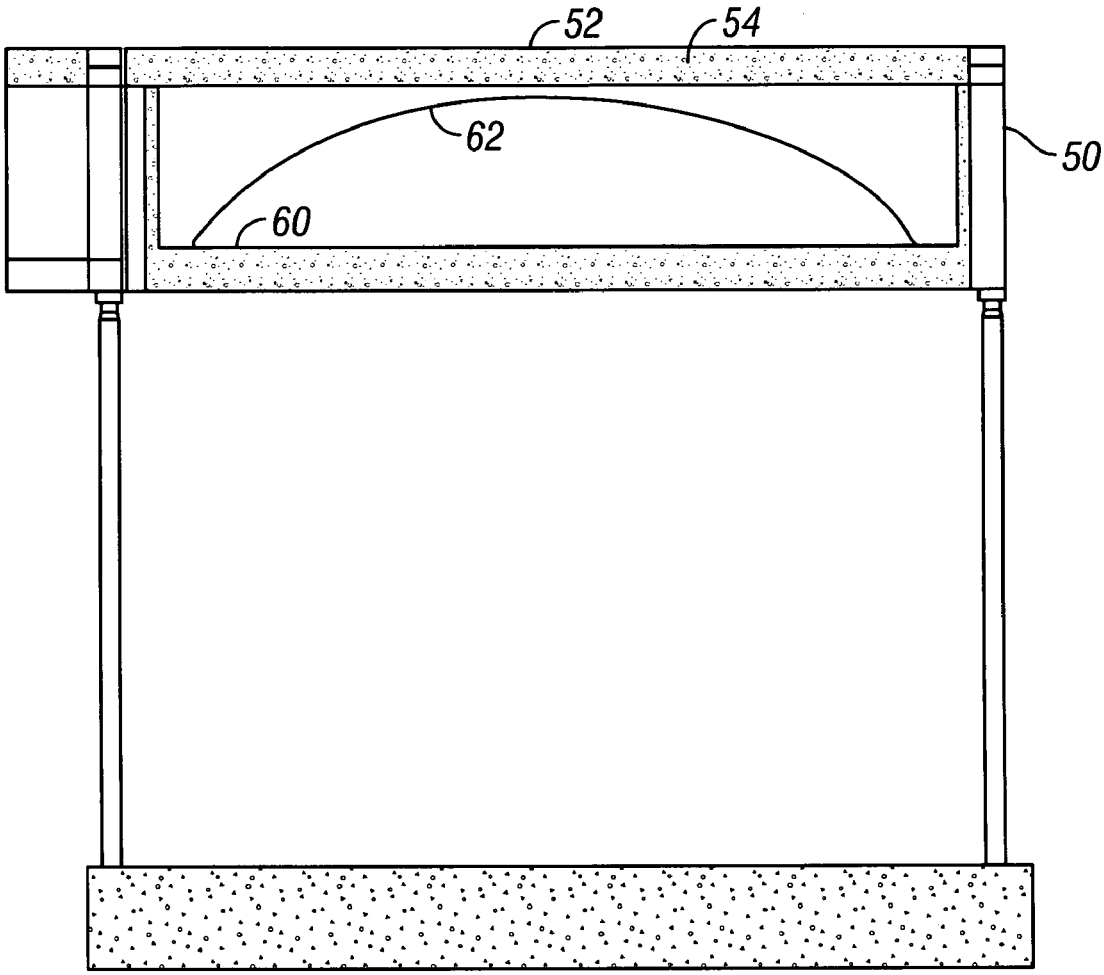
FIG. 47 is a cross-sectional view of the platform section and bladder tank assembly shown in FIG. 46.

Turning now to various storage structures that are useful in a platform environment, for example, liquid storage platform sections, an embodiment of the invention depicted in FIGS. 46 and 47 comprises a platform section 50 that has a deck section 52 installed on top of the platform. In some embodiments, support foam 54 disposed within deck section 52 provides a layer of insulation at the top of the deck portion; in a presently preferred embodiment, the layer of insulation is about six inches thick. A plurality of six-inch insulation members 56 have also been added to the ends, bottom, and both sides of the platform and deck sections, effectively making the storage module a large thermal container.

In some embodiments, the floor of thermal container 52 further comprises an electric heating element 60; lying on top of the heating element is a balloon type tank or collapsible pillow tank 62. In some embodiments, the balloon tank stores fresh water that can later be processed into either potable water or water suitable for use in showers and sinks. According to other embodiments, balloon tank 62 is used to store other liquids, for example, diesel fuel or well operation fluids. In further embodiments, a pump 70 is used to draw fluid out of the bladder tank prior to transfer of the fluid into other parts of the platform structure. In still further embodiments, pump 70 is used to draw liquids from other platform sections, and to pump the drawn fluids into the bladder tank through appropriate process connections 72, for example, a metal pipe or durable plastic conduit connection.

Those of ordinary skill in the art will appreciate that there are usually a great many platform areas that are stacked high with relatively heavy platform modules and drilling equipment. However, there are also many other areas, for example, the deck sections beneath the crane, which are lightly loaded. By using one of the liquid storage bladder configurations, fluid loads can be maintained in platform sections that functionally serve as open deck spaces. The liquid storage bladders are also lighter than the steel tank storage modules that are presently known, and thus the total weight required to be supported is reduced according to the invention.

Most liquids suitable for storage in the disclosed bladder will tend to freeze at very low temperatures, for example, the very low temperatures that would be expected in arctic drilling environments. In the example embodiment of FIGS. 46 and 47, problems associated with freezing fluids are overcome using one or more electric heaters disposed along the bottom of the bladder tank. According to further embodiments, however, one or more additional heating strips is applied directly to the bottom of the tank, or is instead applied to the bottom of an aluminum plate laid on the bottom of the platform section so that the bladder tank is disposed on top of the aluminum plate. The aluminum heating plates provide superior temperature distribution, and generally will not cause hot spots that can overheat a particular area of the bladder like other known methods of tank heating. According to further embodiments, hot air is circulated within the storage section to prevent the stored fluid from freezing; in still other embodiments, electric heaters are disposed within the fluid so that warm water is continuously circulated through the storage tank.

Figure 48:
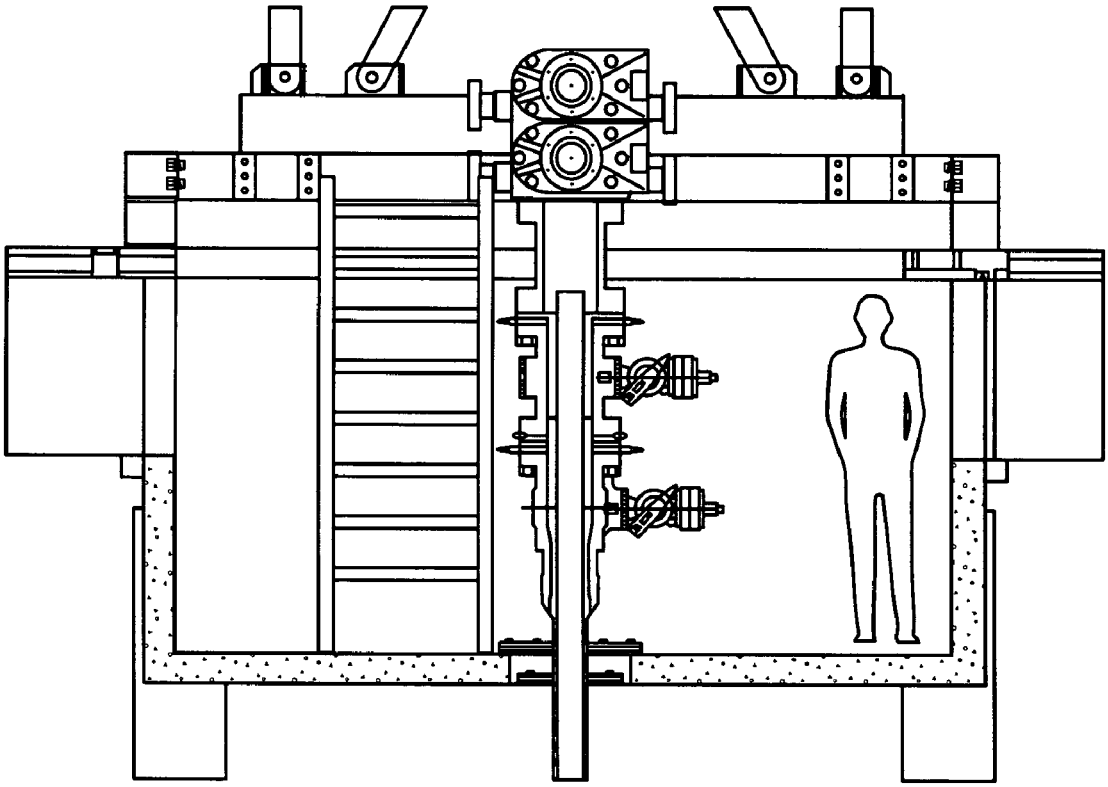
FIG. 48 is a wellhead cellar suitable for use in an arctic platform system.

FIG. 48 is a cross-sectional view of a wellhead cellar according to one aspect of the invention, in which an outer portion of the wellhead cellar is comprised of multiple layers, for example, an inner skin and an outer skin, with two-part polyurethane foam insulation disposed between the inner and outer skins. In the bottom of the wellhead cellar, there are at least two levels of seals provided to ensure the unit is as environmentally secure as possible and that the ground surface is protected from inadvertent spills. The disclosed wellhead cellar also permits the entire drilling operation to be carried out without disturbing any of the ground surface except for the production hole.

Figure 49:
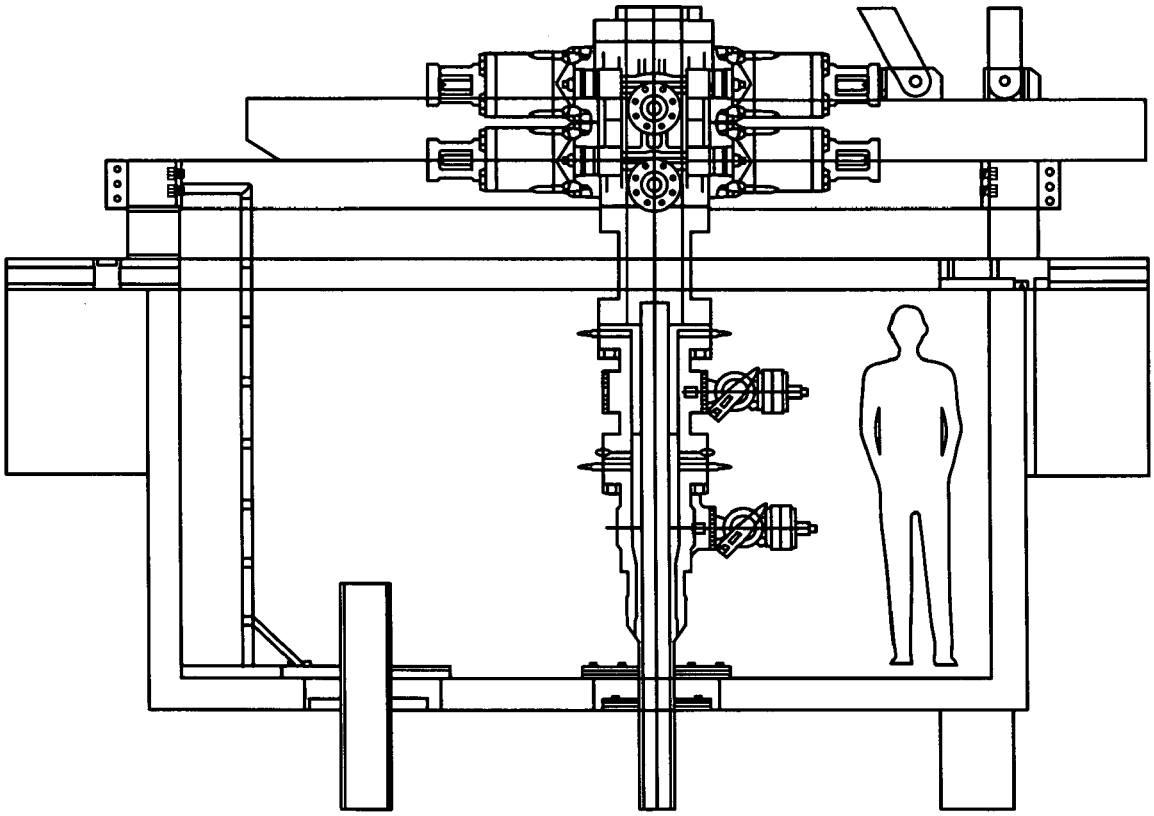
FIG. 49 is an alternative wellhead cellar suitable for use in an arctic platform system.

As seen in the example embodiment of FIG. 49, the wellhead center cellar further comprises additional sets of casing and the like suitable for use in additional wellbores. According to further embodiments of the invention, the backup casings are also sealed within the wellhead cellar to prevent leakage, and to maintain the environmental integrity of the drilling operation. In a further embodiment, a ladder or stairs provide access to personnel required to move into and out of the wellhead cellar.

Figure 50:
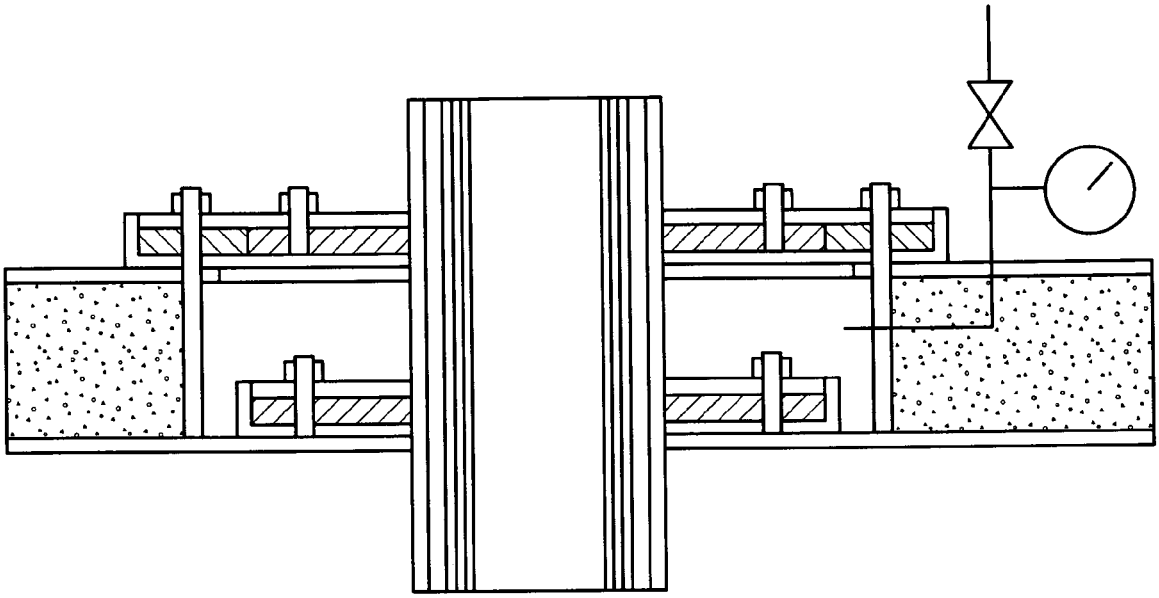
FIG. 50 is a cross-sectional view of the seals used to secure an inner and an outer skin of a wellhead cellar.

As seen in the example embodiment of FIG. 50, a wellhead cellar sealing assembly engages an outermost stream of production casing. The seals comprise an inner and outer skin, with polyurethane foam disposed in-between. According to some embodiments, each of the seals are energized using bolts attached by known fasteners in order to provide a secure and reliable sealing assembly for the protection of wellhead. Other means for energizing the seals include introduction of low pressure air feeds, for example, an air feed having about 2 PSI, so that the seals are held fast after attachment by means of compressive pressure or the use of a sealant such as foam.

Figure 51:
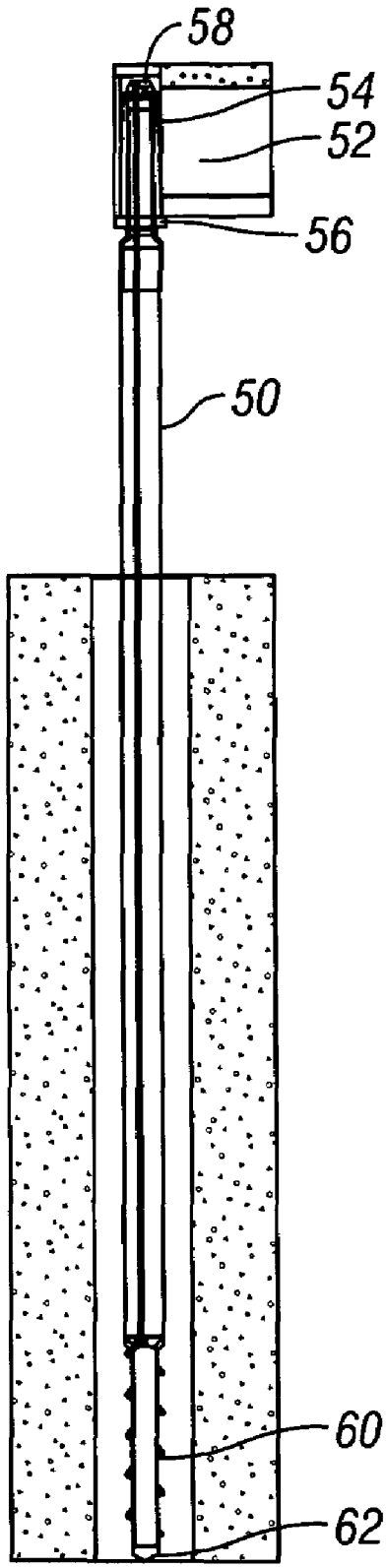
FIG. 51 is a post hole in which a platform support post is disposed.

FIG. 51 is a post hole in which a platform support post 50 is disposed according to further aspects of the invention. The support post 50 has an adjustable nut 56 for making fine adjustments to the level of the platform 52 disposed thereon, and a fluid transfer means 58 that permits fluid to be pumped from the platform down inside the body of the support post 52 for heating or cooling operations. A lower end 60 of support post 50 is contoured to permit pumped fluids to flow toward the bottom of the support post for full, uniform heating of the support post. At the lower end of the support post 50, a smaller diameter section 62 is for engagement with an extension member.

Figure 52:
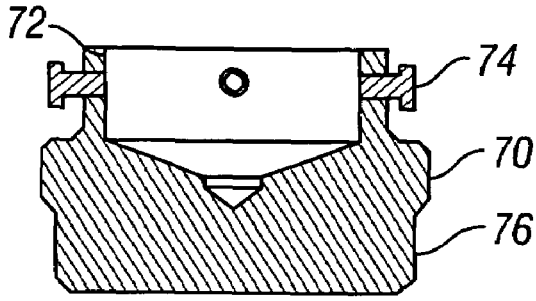
FIG. 52 is an adaptor useful for adding an extension onto the bottom of a support post.
Figure 53:
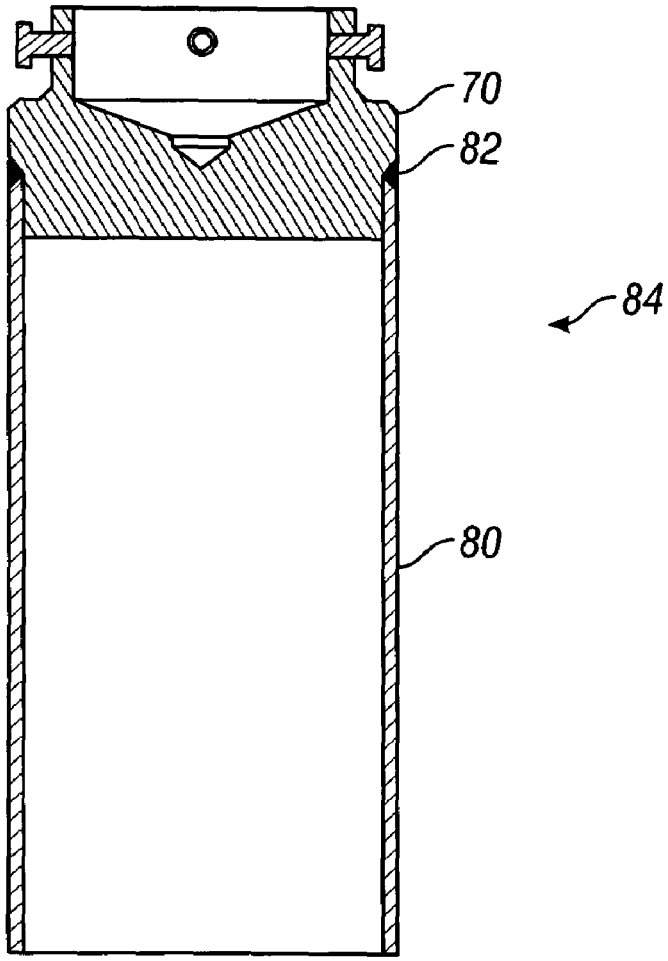
FIG. 53 is the adaptor of FIG. 52, with an additional pipe section welded thereon.

As seen in the example embodiment of FIG. 52, an adaptor 70 useful for adding an extension onto the bottom of a support post is provided. According to some embodiments, adaptor 70 has an internal bore 72 sized to engage a smaller diameter section 62 of the bottom of support post 50. According to certain embodiments, one or more fastening bolts 74 are also provided; in a particular example embodiment, the fastening bolts 74 are disposed at 90 degree intervals around the circumference of the device, and engage and lock onto the bottom of the support post 50. Disposed on a bottom portion of the adapter 70 is an extension receiving member 76, sized to engage a piece of extension pipe that is added to the bottom of the adapter 70. FIG. 53 shows the adaptor 70 of FIG. 52, with the mentioned extension pipe section 80 attached thereto. According to one aspect of the invention, the extension member 80 is welded onto a bottom portion of the extension receiving member 76, though in other embodiments any known fastening means will suffice so long as the connection between the extension member 80 and the extension receiving member 76 is secure and dependable. For example, certain embodiments use shear pins or the like to secure the extension member and the extension receiving member so that the connection will break apart when a predefined amount of force is applied.

Figure 54:
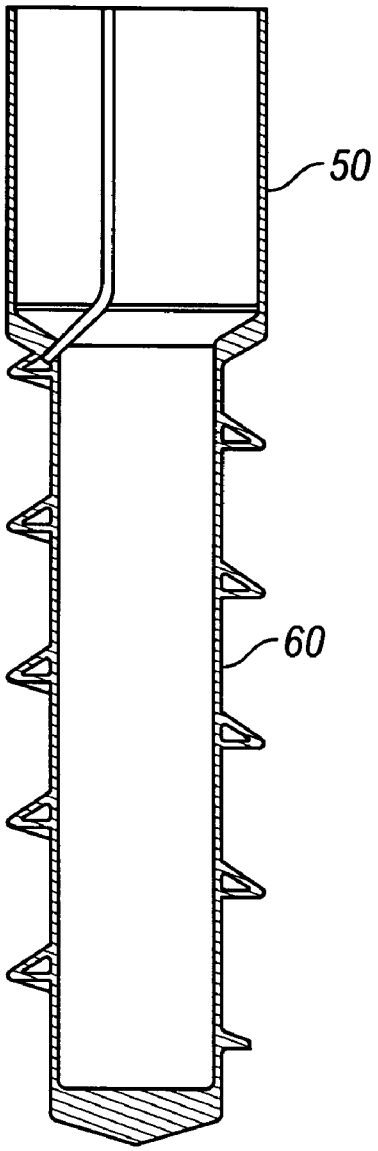
FIG. 54 is a partial section of a bottom portion of the support post shown in FIG. 51.
Figure 55:
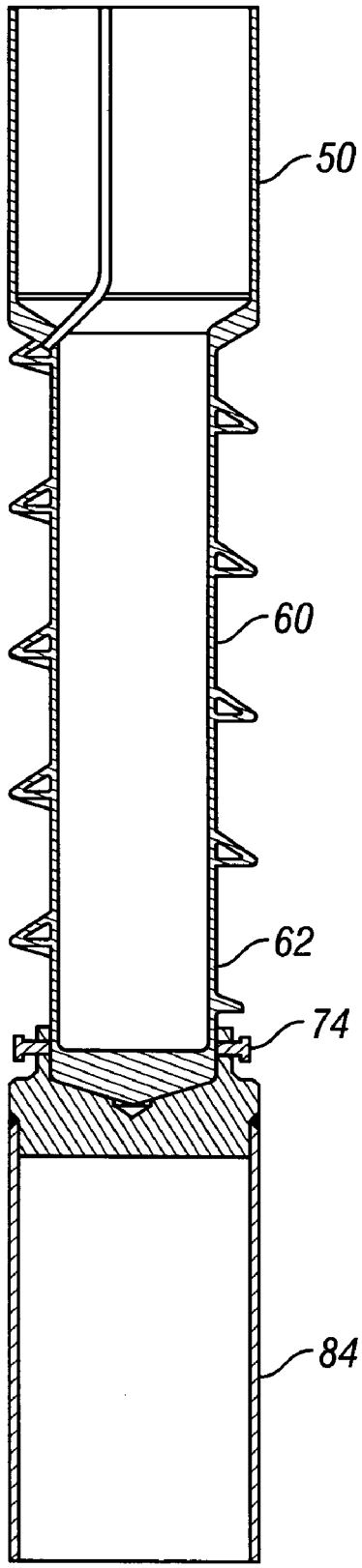
FIG. 55 is a partial section of a support post on which an extension has been added.

As seen in the embodiment of FIG. 54, a bottom portion of support post 50 has a lower end 60 sized so as to engage within an interior surface of extension receiving member 72 (see FIG. 52). In the embodiment of FIG. 55, the support post has an extension member added, with the outer surface of lower end 60 being attached to the extension receiving member 72 using a plurality of fastening bolts 74.

Figure 56:
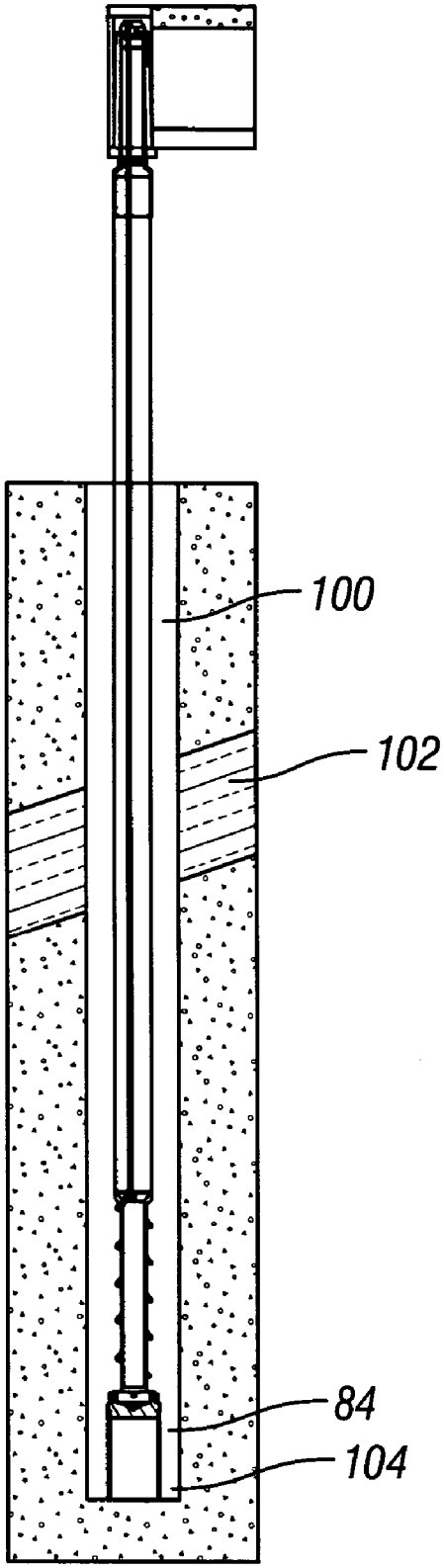
FIG. 56 is a post hole in which a platform support post is disposed.

According to the further embodiment of FIG. 56, a post hole 100 is depicted in which a platform support post is disposed. Extension member 84 has already been friction-locked to a bottom end of the support post. After the support post is inserted into the post hole, a slurry of water, sand and gravel is added to freeze the support post in place. At this point, the support post is ready for supporting the raised load for which it was designed.

Figure 57:
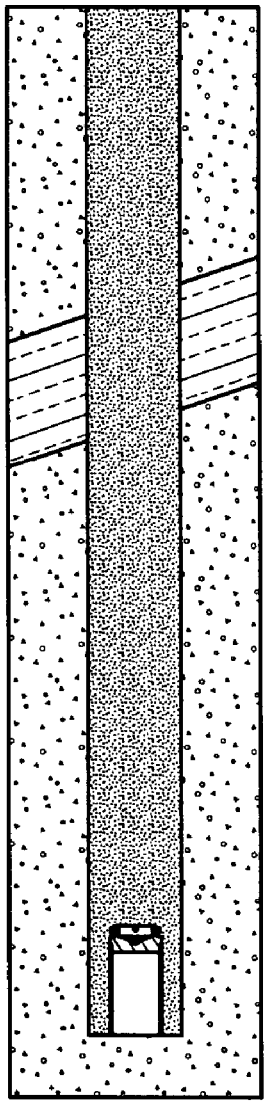
FIG. 57 is the post hole of FIG. 56 after the support post has been removed.

Referring now to the example embodiment of FIG. 57, the post hole shown in FIG. 56 is depicted after removal of the support post from the post hole. According to some embodiments, the support post is heated using circulated warm fluid so as to unfreeze the post from the surrounding ground formation. The plurality of bolts used to fasten the extension member to the extension receiving member are then removed or sheared, so that the support post can in turn be removed from the adapter and extension member. According to one embodiment, the adapter and extension member remain in the ground afterward, buried well beneath the surface of the surrounding ground formation. In some embodiments, the adapter and extension member are left in the ground about fifteen to twenty feet beneath the ground surface. In some embodiments, the adapter and extension are forever abandoned, and the post hole is filled in or covered over so that only minimal signs of the drilling operation are imprinted on the surrounding ground surface. However, in other embodiments, the adapter and extension member assembly are reused whenever production from the site is again desired, and thus the post hole is not filled in or covered over. According to still further embodiments, the adapter and extension member assembly are abandoned, and the upper portion of the post hole is refilled with a slurry of sand and ice. In still other embodiments, the post hole is re-filled with a mixture of tundra and ice, and thus the former drilling site cannot easily be discerned from the surrounding tundra after operations have been completed and the platform has been removed.

The foregoing specification is provided for illustrative purposes only, and is not intended to describe all possible aspects of the present invention. Moreover, while the invention has been shown and described in detail with respect to several exemplary embodiments, those of ordinary skill in the art will appreciate that minor changes to the description, and various other modifications, omissions and additions may also be made without departing from either the spirit or scope thereof.

The invention claim is:

1. A method of constructing a modular platform suitable for drilling and producing oil, gas and hydrate reserves, said method comprising:

providing a rectangular platform section, the platform section comprising two support beam members disposed substantially parallel to one another, the platform section further comprising interlocking means disposed along each of the four rectangular edges, wherein the interlocking means disposed along each edge is, independently of the interlocking means disposed along any of the other three edges, either a hook or a fence;

providing a plurality of support posts, wherein each support post has an upper portion, the upper portion further comprising a threadably adjustable shoulder nut;

disposing said platform section atop said threadably adjustable shoulder nuts of said plurality of support posts, with each of said support beam members substantially spanning a distance between two of said support posts; and disposing a deck section atop said two support beam members to provide a bridging support means between said two support beam members.

2. A method of constructing an arctic drilling platform, said method comprising:

providing a first rectangular platform section comprising four sides and four corners, and further comprising interlocking means disposed alone substantially the entire length of each of the four sides, wherein each interlocking means is a fence, so providing four fence sides and four corners each having two adjacent fence sides;

providing at least a second rectangular platform section comprising four sides and four corners, and further comprising interlocking means disposed along substantially the entire length of each of the four sides, wherein the interlocking means of a first side of the at least a second rectangular platform section is a hook, so providing a hook side, and each interlocking means of each of the three remaining sides of the at least a second rectangular platform section is a fence, so providing three fence sides and two corners having two adjacent fence sides;

optionally providing at least a third rectangular platform section comprising four sides and four corners, and further comprising interlocking means disposed along substantially the entire length of each of the four sides, wherein each of the interlocking means of a first side and of an adjacent second side of the at least a third rectangular platform section are hooks, and wherein each of the interlocking means of the remaining two adjacent sides of the at least a third rectangular platform section are fences, so providing two adjacent hook sides and two adjacent fence sides, respectively, and one corner having two adjacent fence sides;

providing a plurality of support posts wherein every corner having two adjacent fence sides of every first, at least a second, or optional at least a third rectangular platform sections is disposed atop a support post;

interlocking said first rectangular platform section with said at least a second rectangular platform section and optionally with said at least a third rectangular platform section, wherein every hook side abuts and interlocks with a fence side of an adjoining rectangular platform section.

3. The method of claim 2, wherein:

each of said first rectangular platform section, said at least a second rectangular platform section, and said optional at least a third rectangular platform section further comprise two support beam members disposed substantially parallel to one another;

each of said plurality of support posts further comprises an upper portion, the upper portion further comprising a threadably adjustable shoulder nut;

every corner having two adjacent fence sides from every first, at least a second, or optional at least a third rectangular platform sections is disposed atop a threadably adjustable shoulder nut of said upper portion of a support post; and each of said support beam members substantially spans a distance between two of said support posts.

4. The method of claim 3, wherein:

a deck section is disposed atop each of said two support beam members to provide a bridging support means between each of said two support beam members.

* * * * *